US006941098B2

(12) United States Patent
Miyaguchi et al.

(10) Patent No.: US 6,941,098 B2
(45) **Date of Patent: *Sep. 6, 2005**

(54) CLASSIFIER, DEVELOPER, AND IMAGE FORMING APPARATUS

(75) Inventors: Yohichiro Miyaguchi, Kanagawa-ken (JP); Masanori Horike, Kanagawa-ken (JP); Takeshi Takemoto, Kanagawa-ken (JP); Yutaka Ebi, Kanagawa-ken (JP); Toshiroh Higuchi, Kanagawa-ken (JP)

(73) Assignee: Ricoh Company, LTD, Tokyo (JP)

( * ) Notice: Subject to any disclaimer, the term of this patent is extended or adjusted under 35 U.S.C. 154(b) by 114 days.

This patent is subject to a terminal disclaimer.

(21) Appl. No.: 10/385,535

(22) Filed: Mar. 12, 2003

(65) Prior Publication Data

US 2003/0210928 A1 Nov. 13, 2003

(30) Foreign Application Priority Data

Mar. 13, 2002 (JP) ..... 2002-069106

(51) Int. Cl.[7] ..... G03G 15/08
(52) U.S. Cl. ..... 399/252; 399/266; 399/291
(58) Field of Search ..... 399/251, 265, 399/266, 289, 290, 291, 252, 294, 295; 347/55, 140

(56) References Cited

U.S. PATENT DOCUMENTS

| | | | | | |
|---|---|---|---|---|---|
| 3,113,042 | A | * | 12/1963 | Hall | 399/294 |
| 4,558,941 | A | * | 12/1985 | Nosaki et al. | 399/266 |
| 4,598,991 | A | * | 7/1986 | Hosoya et al. | 399/266 |
| 5,027,157 | A | * | 6/1991 | Hotomi et al. | 399/266 |
| 5,142,336 | A | * | 8/1992 | Hotomi et al. | 399/281 |
| 5,200,762 | A | | 4/1993 | Katano et al. | |
| 5,281,982 | A | * | 1/1994 | Mosehauer et al. | 399/291 |
| 5,317,438 | A | | 5/1994 | Suzuki et al. | |
| 5,327,522 | A | | 7/1994 | Furuta et al. | |
| 5,333,241 | A | | 7/1994 | Furuta et al. | |
| 5,402,220 | A | | 3/1995 | Tanaka et al. | |
| 5,412,413 | A | | 5/1995 | Sekiya et al. | |
| 5,504,838 | A | | 4/1996 | Furuta et al. | |
| 5,508,520 | A | | 4/1996 | Shoji et al. | |
| 5,532,807 | A | | 7/1996 | Takemoto | |
| 5,581,662 | A | | 12/1996 | Furuta et al. | |
| 5,619,617 | A | | 4/1997 | Furuta et al. | |
| 5,761,591 | A | * | 6/1998 | Yamaguchi | 399/289 |
| 5,854,465 | A | | 12/1998 | Kishi et al. | |
| 6,134,412 | A | * | 10/2000 | Thompson | 399/266 |

(Continued)

FOREIGN PATENT DOCUMENTS

| | | | | |
|---|---|---|---|---|
| JP | 63-013068 | * | 1/1988 | G03G/15/08 |
| JP | 07-267363 | * | 10/1995 | G03G/15/08 |
| JP | 08-149859 | * | 6/1996 | G03G/15/08 |
| JP | 2000-143026 | | 5/2000 | |
| JP | 2002-287495 | * | 10/2002 | G03G/15/08 |

OTHER PUBLICATIONS

U.S. Appl. No. 10/385,535, filed Mar. 12, 2003, Miyaguchi et al.

(Continued)

*Primary Examiner*—Hoan Tran
(74) *Attorney, Agent, or Firm*—Oblon, Spivak, McClelland, Maier & Neustadt, P.C.

(57) ABSTRACT

A classifier having a simple constitution for classifying powder with a high accuracy is provided. The classifier is provided with a transfer board having a plurality of electrodes for generating electric fields for transferring and hopping the powder by an electrostatic force. The classifier is further provided with an opposite roller generating an electric field for transporting and attaching the powder (toner) transferred and hopped on the transfer board to the opposite roller, which is opposite to the transfer board.

22 Claims, 37 Drawing Sheets

U.S. PATENT DOCUMENTS

| | | | | | |
|---|---|---|---|---|---|
| 6,137,979 | A | * | 10/2000 | Gartstein et al. | 399/266 |
| 6,175,707 | B1 | * | 1/2001 | Eklund et al. | 399/265 |
| 6,367,914 | B1 | | 4/2002 | Ohtaka et al. | |
| 6,597,884 | B2 | * | 7/2003 | Miyaguchi et al. | 399/266 |
| 6,708,014 | B2 | * | 3/2004 | Miyaguchi et al. | 399/266 |

OTHER PUBLICATIONS

U.S. Appl. No. 10/863,294, filed Jun. 9, 2004, Horike et al.
U.S. Appl. No. 10/385,535, filed Mar. 12, 2003, Miyaguchi et al.
U.S. Appl. No. 10/805,362, filed Mar. 22, 2004, Miyaguchi et al.
U.S. Appl. No. 10/385,535, filed Mar. 12, 2003, Miyaguchi et al.
U.S. Appl. No. 10/817,249, filed Apr. 5, 2004, Nakano et al.
U.S. Appl. No. 10/385,535, filed Mar. 12, 2003, Miyaguchi et al.
U.S. Appl. No. 10/659,468, filed Sep. 11, 2003, Shakuto et al.
U.S. Appl. No. 10/385,535, filed Mar. 12, 2003, Miyaguchi et al.
U.S. Appl. No. 10/825,318, Apr. 16, 2004, Naruse et al.
U.S. Appl. No. 09/330,669, filed Jun. 11, 1999, Yasui.
U.S. Appl. No. 09/765,608, filed Jan. 22, 2001, Hayashi et al.
U.S. Appl. No. 09/948,576, filed Sep. 10, 2001, Miyaguchi et al.
U.S. Appl. No. 10/050,865, filed Jan. 18, 2002, Ohtaka et al.
U.S. Appl. No. 10/098,125, filed Mar. 15, 2002, Miyaguchi et al.
U.S. Appl. No. 10/385,535, filed Mar. 12, 2003, Miyaguchi et al.

* cited by examiner

CLASSIFIER, DEVELOPER, AND IMAGE FORMING APPARATUS

CROSS-REFERENCE TO RELATED APPLICATION

This application claims the priority benefit of Japanese application serial no.2002-069106, filed on Mar. 13, 2002.

BACKGROUND OF THE INVENTION

1. Field of the Invention

This invention relates in general to a classifier, a developer, and an image forming apparatus.

2. Description of Related Art

Copiers, printers, facsimiles and the like, have been known as image forming apparatuses. Some of them employs such an image forming process that a latent image is formed on a latent image carrier using an electrophotographic process, and a powder developing agent (hereinafter, also called toner) is attached to the latent image to develop it as a visible toner image, then the toner image is transferred to a recording medium, including an intermediate transferring member, so that an image is formed.

As a developer developing latent images, which is employed for such image forming apparatuses, such a developer has been known that toner agitated in a developer is carried on the surface of a developing roller, which is a developing agent carrier, and the developing roller is rotated to transfer the toner to the position where the toner is opposite to the surface of a latent image carrier, then the latent image of latent image carrier is developed. After the development, the part of the toner that has not been transferred to the latent image carrier is collected into the developer as the developing roller is rotated, then new toner is agitated, charged and carried on the developing roller to be transferred again.

Another application of an image forming apparatus is also disclosed in the Japanese Laid Open Publication No. 9-197781 and 9-329947. In the disclosed apparatus, a jumping developing method is employed, in which toner is transferred from a developing roller to a latent image carrier without any contact in-between.

Another application of an image forming apparatus is further disclosed in the Japanese Laid Open Publication No. 5-19615. In this apparatus, toner is transferred on the surface of a developing roller by an electrostatic force, and an attractive force generated between the toner and a latent image carrier separates the toner from the surface of the developing roller, thus attaching the toner to the surface of the latent image carrier. Still, another application of an image forming apparatus is disclosed in the Japanese Laid Open Publication No. 59-181375. In this application, toner is transferred to a position where the toner is opposite to a latent image carrier, using a transfer board for transferring the toner by an electrostatic force, then the toner is separated by an attractive force generated between the toner and the latent image carrier and is attached on the surface of latent image carrier.

The Japanese Laid Open Publication No. 7-267363 discloses a powder transfer apparatus for transferring powder, such as toner, using space-traveling-waves fields. This apparatus is provided with electrodes, to which a drive voltage is applied to form space traveling wave fields around the electrodes. The traveling wave fields repel and drive the charged powder, transferring it in the transporting direction of electric fields.

As for a classifier for classifying powder, such as toner, a classifier using a screening or wind force classifying method is known. Other application is disclosed in the Japanese Laid Open Publication No. 8-149859, in which such a classifier is described that classification (separation) is carried out by using the space-traveling-wave fields described above, which make electrostatic force, gravity, and centrifugal force act all together on toner. Besides, the Japanese Laid Open Publication No. 2000-140683 and the Japanese Laid Open Publication No. 2000-140700 disclosed another method such that a voltage is applied to generate a potential vertical to the transfer direction of charged powder so that the powder is separated from the transfer surface according to its specific charge.

To form high quality images using such image forming apparatuses, it is important to keep uniform the quantity of charge and mass of the grains of toner for development. However, it has been found difficult for conventional image forming apparatuses to achieve a uniform attachment of toner. Therefore, in conventional methods, toner is pre-classified in the manufacturing process by screening or applying wind force to uniform the toner to a certain extent, and is supplied to an image forming apparatus.

However, even if the substantially uniformed toner is supplied to the image forming apparatus, the toner is not always uniformly charged because the toner is charged in the image forming apparatus in the first place. Charging the toner in the apparatus inevitably cause the unevenness of q/m (quantity of charge per mass) and of the diameters of the grains of toner, thus posing a problem that there is a limit for forming a high quality image.

Besides, a conventional classifier tends to become a large-sized one. A classifier using a method of electrostatic transfer and gravity to classify toner also has a problem that an exact classification is difficult.

SUMMARY OF THE INVENTION

According to the foregoing description, it is an object of this invention to provide a classifier having a simple constitution, which achieves a high classification accuracy utilizing a ETH (Electrostatic Transport & Hopping) phenomenon, a developer provided with the classifier, which enables high quality development, and an image forming apparatus provided with the above classifier and developer enabling the forming of high quality images.

The ETH represents a phenomenon that powder receives the energy of phase-shifting fields and the energy is transformed into a mechanical energy, which moves the powder itself dynamically. The phenomenon includes the horizontal moves (transfer) and vertical moves (hopping) of the powder by an electrostatic force. It is the phenomenon that the powder comes to have a component in the transporting direction and hops on the surface of an electrostatic transfer member, due to the phase-shifting fields. Hereinafter, a development utilizing the ETH phenomenon is called ETH development.

In separately describing the behavior of powder on a transfer member, hereinafter, the terms of "transfer", "transfer velocity", "transfer direction" and "transfer distance" are used for the powder moving in the horizontal direction to a board, the terms of "hopping", "hopping velocity", "hopping direction" and "hopping height (distance)" are used for the powder jumping up (moving) in the vertical direction on the board, and "transfer and hopping" on the transfer member is generally called "transport." The term "transfer" included in the terms "transfer apparatus" and "transfer board" is synonymous with "transport."

The present invention provides a classifier for classifying a powder. The classifier comprises a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member. It will be appreciated that, in this specification, the term "powder" is used to also represent "fine powder", "grains of powder", "fine grains of powder", "particles", "fine particles", etc, so such terms are not excluded as the terminology not standing for the definition of "powder."

The opposite member may be an opposite transfer member which has a plurality of electrodes for generating electric fields and which is configured to for transfer said powder by an electrostatic force. In this case, the opposite transfer member may be arranged in such a way that part or the whole of the opposite transfer member is inclined against the transfer member.

The opposite member may be provided as a rotary roller member, or a rotary belt member which may be inclined against the transfer member.

Further, the opposite member may comprise an array of electrode wires, where a voltage for generating electric fields is applied to each of the electrode wires. It is desirable to form a protective film on the electrode wires. It is also desirable to further comprise a slit member having slit holes arranged between the electrode wires, which are arranged at a position substantially opposite to said transfer member, and the transfer member.

Further, the opposite member may comprise a slit member having slit holes; and electrodes formed on wall surfaces of the slit holes.

It is desirable for the transfer member of the classifiers described above that the width of respective electrodes of the transfer member in the transporting direction of the powder be more than 1 to 20 times the average grain diameter of the powder, as well as the space between respective electrodes in the same direction be also more than 1 to 20 times the average grain diameter of the powder, and that drive waveforms of more than n (a natural number of 3 or more) phases be applied to each electrode.

It is also desirable that the transfer member has an organic or inorganic surface protective layer whose thickness is not more than 10 $\mu$m.

It may be also arranged in such a way that the classifier has a plurality of said opposite members, and the plurality of said opposite members selectively catch the particles of said powder depending on a quantity of charge or a mass of the particles of said powder.

The present invention further provides a classifier for classifying powder, in which the classifier transports said powder while transferring and hopping the powder by an electrostatic force, comprising a member configured to selectively catch particles of said powder transferred and hopped by forming an electric field.

The invention also provides a developer, comprising: a classifier configured to classify a powder; and a developing means for developing a latent image on a latent image carrier the classified powder to form a visual image on the latent image carrier. The classifier is any classifier described above.

The developing means may comprise a developing roller facing to the latent image carrier, which can also be used as the opposite member. The developing means may also be a member having a plurality of electrodes for generating electric fields for transferring and hopping the powder by an electrostatic force at a position near the latent image carrier, and the member can also be used as the opposite member. Further, the developing means may comprises a rotary belt member, at least part of which is opposite to the latent image carrier, and the belt member can also be used as the opposite member.

The present invention further provides an image forming apparatus, comprising: a latent image carrier; and a developer configured to develop a latent image with a powder. The developer can be the developer mentioned above.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the flowing description taken in connection with the accompanying drawings in which:

DESCRIPTION OF THE PREFERRED EMBODIMENT

Figure 1:
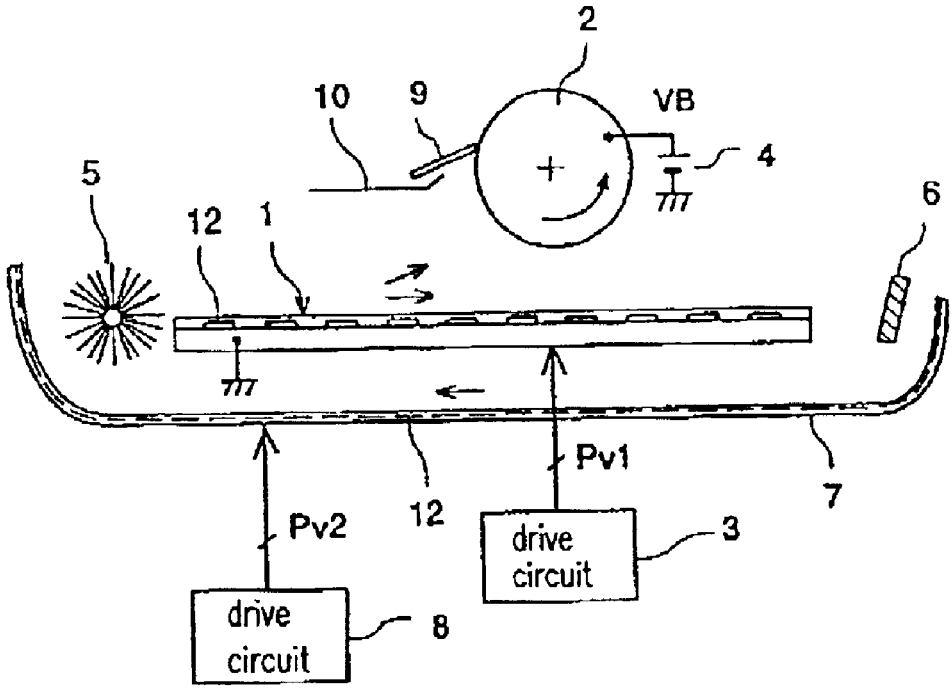
FIG. 1 is a schematic block diagram for explaining the first embodiment of the classifier of this invention.

Hereinafter, the preferred embodiments of the present invention are to be described referring to the drawings. First, the first embodiment of the classifier of this invention is described referring to FIG. 1, which is a schematic block diagram of the classifier.

The classifier comprises a transfer board 1, which is a transfer member having a plurality of electrodes for generating electric fields for transferring and hopping toner, i.e., powder, and an opposite roller 2, which is an opposite member (also functions as other member) to which the toner transferred on the transfer board 1 is transported and attached.

The classifier also comprises a drive circuit 3 applying drive waveforms Pv1 having n phases (n stands for a natural number of 3 or more) to each electrode of the transfer board 1 so as to generate traveling waveform fields for transferring and hopping the toner. The opposite roller 2 is provided with a bias power source 4 for applying a bias voltage having a polarity opposite to the charge of the toner. The bias voltage is positive when the toner is negatively charged, and the bias voltage is negative when the toner is positively charged. It will be appreciated that the description is made on the assumption that the toner is negatively charged.

A charging means 5 is arranged on the toner supply side of the transfer board 1. The charging means 5 comprises a charging brush (or maybe a unit other than the charging brush) and a magnet roller for charging the toner, which is supplied from a toner supply (not shown in the drawings) or recovered, and sending the toner to the transfer board 1. A collecting electrode 6 is arranged on the residual toner discharging side of the transfer board 1, where the electrode 6 collects the part of toner that is not transported and attached to the opposite roller 2. A recovery/transport member 7 is also provided for transporting the toner collected by the collecting electrode 6 to the charging means 5 by an electrostatic force, where the recovery/transport member is provided with a drive circuit 8 for applying a drive voltage Pv2 to the electrodes provided on the recovery/transport member 7, the drive voltage generating electric fields for transporting the toner.

The opposite member 2 has a blade 9 for removing the toner sticking on the opposite roller 2, and a gutter 10 for storing the toner removed by the blade 9. (The removed toner can be supplied to the developing means of the developer).

Figure 2:
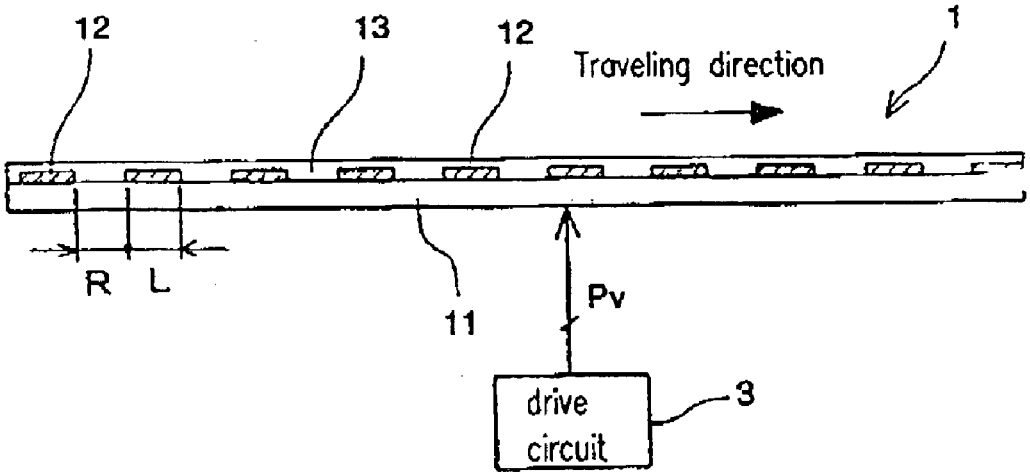
FIG. 2 is a front view of the transfer board of the classifier of this invention.
Figure 3:
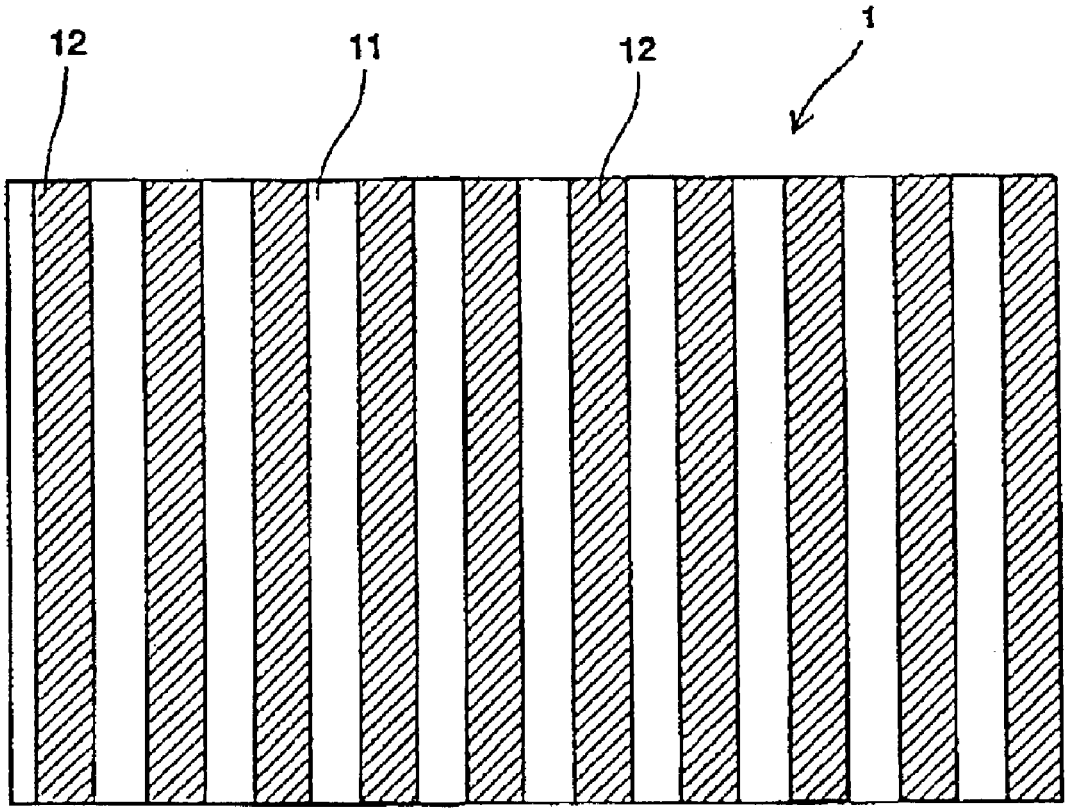
FIG. 3 is a flat view of the above transfer board.

Now, the transfer board 1 is described in detail referring to FIG. 2 and FIG. 3. FIG. 2 is the schematic sectional view of the transfer board 1 and FIG. 3 is the flat view of the same. The transfer board 1 has a support board 11 on which a plurality of electrodes 12 are arranged at every a prescribed distance in the transport direction of powder, (i.e., transporting direction of powder or moving direction of powder shown by an arrow in FIG. 2), where three units of the electrode 12 are made one set for generating drive waveforms. The support board 11 is laminated with a surface protective film 13 made of an inorganic or organic insulating material, which functions as an insulating transfer surface forming member, i.e., a protective film covering the surface of the electrodes 12, on which a transfer surface is formed.

The support board 11 may be a board consisting of such an insulating material as glass, resin, or ceramic, or a board consisting of a conductive material, such as SUS, with an insulating film, such as $SiO_2$, formed thereon, or a board consisting of a deformable material, such as polyimide.

In forming the electrodes 12, a film of conductive material, such as Al, Ni—CR and the like, is formed on the support board 11 at a thickness of 0.1 to 1.0 $\mu$m, or desirably a thickness of 0.5 to 2.0 $\mu$m. Then a required electrode patterns is formed on the film, using a photolithography technique, to form the electrodes 12. The width L of the respective electrodes 12 in the transporting direction of powder is made 1 to 20 times the average diameter of the grains of traveling powder. The space R between each electrode 12 in the transporting direction of powder is also made 1 to 20 times the average diameter of the grains of traveling powder.

The surface protective layer 13 is formed as a film consisting of such a substance as $SiO_2$, $TiO_2$, $TiO_4$, SiON, BN, TiN, or $Ta_2O_5$, where the thickness of the film is 0.5 to 10 $\mu$m, or desirably 0.5 to 3 $\mu$m.

The recovery/transport member 7 has the same constitution as that of the transfer board 1. The base board of the recovery/transport member 7 is a flexible board consisting of a polyimide film or the like on which a plurality of electrodes are provided, and the base board is covered with a surface protective film. Using the flexible board in such a manner makes possible to set the course of recovering and transferring the toner freely. The drive circuit 8 for applying drive waveforms to the electrodes of the recovery/transport member 7 applies multiple phase drive waveforms having the phase patterns reverse to that of the waveforms from the drive circuit 3 so as to transport the charged toner in the direction reverse to the transport direction on the transfer board 1.

Next, the operation and function of transfer board 1 are described. The recovery/transport member 7 also operates in similar to the transfer board 1, but the recovery/transport member 7 functions mainly as a transfer member.

When the drive circuit 3 applies drive waveforms of n phases to a plurality of the electrodes 12 of the transfer board 1, the electrodes 12 generate phase-shifting fields (traveling wave fields), which either repel or attract respective grains of charged powder on the transfer board 1. As a result, the powder is transferred as it hops in the transporting direction of the electric fields.

Figure 4:
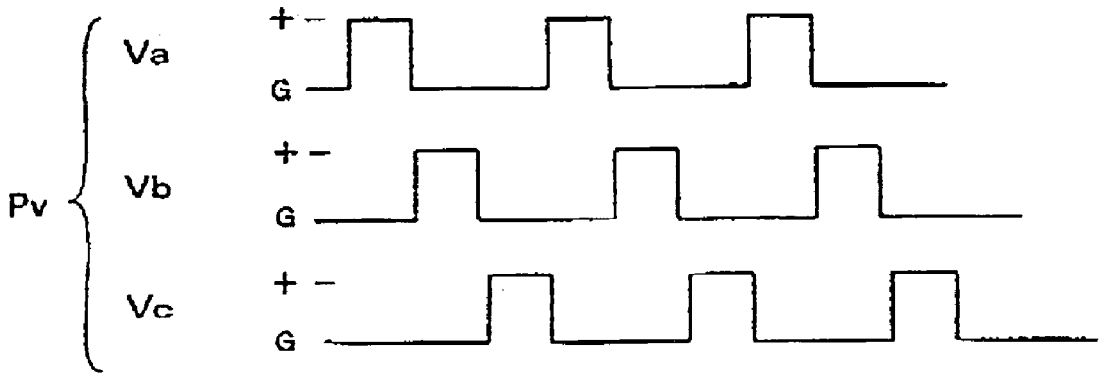
FIG. 4 is an explanatory drawing showing one example of drive waveforms which are given to the transfer board.

For example, as shown in FIG. 4, respective pulse drive waveforms Va, Vb, and Vc, each of which shifts between the ground potential of G (0 V) and a positive voltage, are applied by the drive circuit to the electrodes 12 of the transfer board 1 in such a way that the applying timing of each waveform is shifted to each other.

Figure 5:
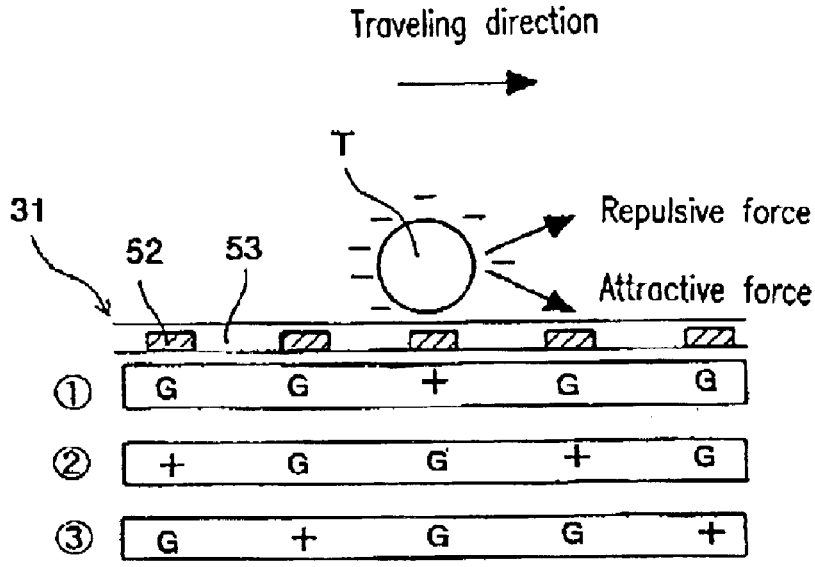
FIG. 5 is an explanatory drawing for describing the transfer and hopping of powder.

At a given moment, as shown in FIG. 5, when a negatively charged grain of the toner T is on the transfer board 1 as the pulse drive waveform is applied to a series of the electrodes 12 of the transfer board 1 to give them the potential status of shown in FIG. 5, the negatively charged grain of toner T is attracted to the electrode 12 with a positive potential.

When another waveform is applied according to a prescribed timing, the potential status of the electrodes becomes ② as shown in FIG. 5, where a repulsive force from the electrode 2 of "G" on the left and an attractive force from the electrode 12 with a positive potential on the right act together on the negatively charged grain of toner T. As a result, the grain of toner T moves to the positive electrode 12. Then, another waveform is applied according to a prescribed timing, the potential status of the electrodes becomes ③ as shown in FIG. 5, where a repulsive force and an attractive force act together on the negatively charged grain of toner T as in the case of ②, moving the grain of toner T further to another positive electrode 12.

As described above, when the multiphase drive waveforms with shifting voltage are applied to a plurality of the electrodes 12, the traveling waveform fields are generated on the transfer board 1, and the negatively charged toner T is transferred as it hops in the transporting direction of the traveling waveform fields. It will be appreciated that when the toner is positively charged, reversing the shifting pattern of the drive waveforms brings the same result as described above.

Figure 6:
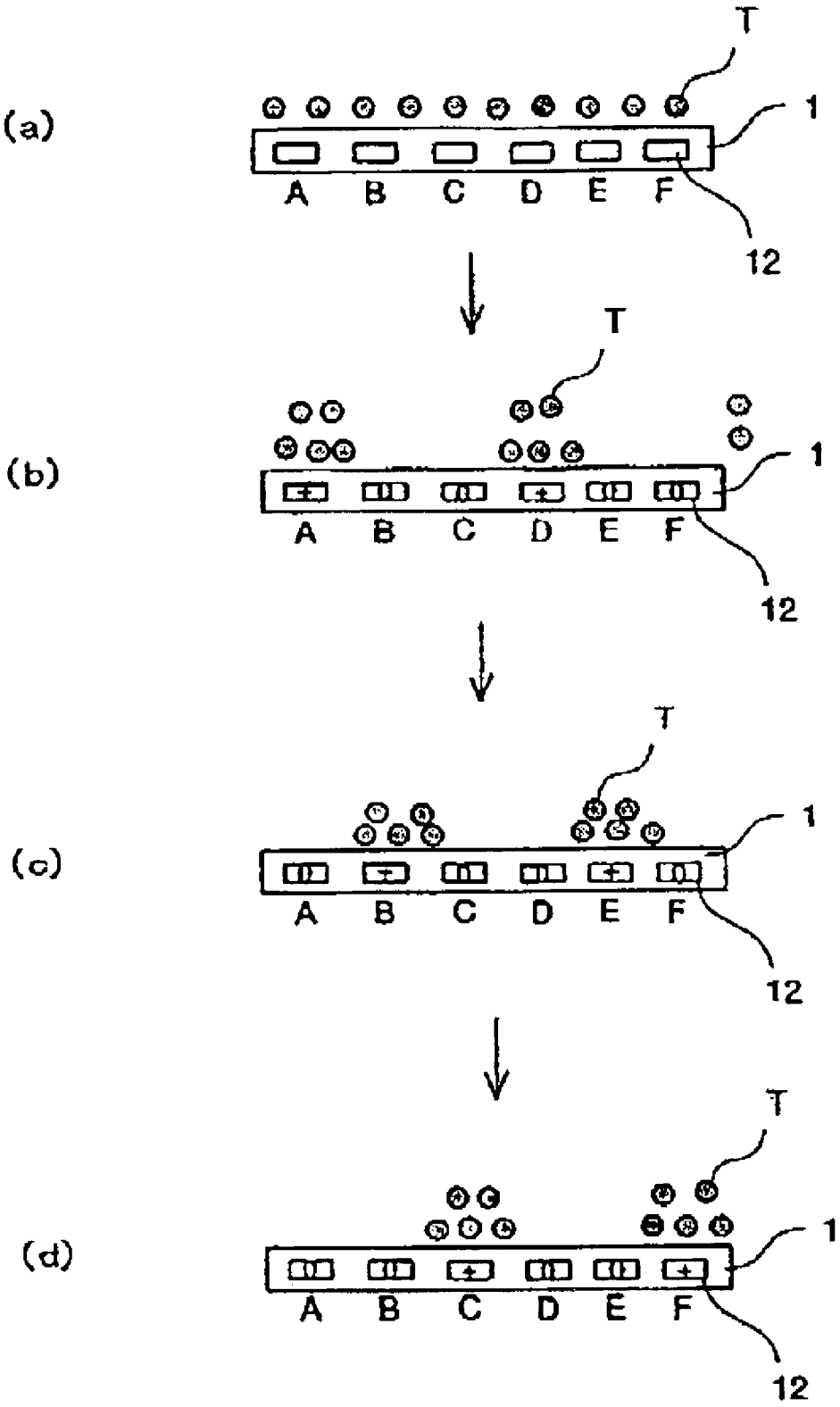
FIG. 6 is an explanatory drawing showing a specific example of the transfer and hopping of the powder.

FIG. 6(*a*) shows a state that the negatively charged grains of toner T are on the transfer board 1 when the electrodes A to F have no potential (G). When the electrodes A and D become positive, as shown in FIG. 6(*b*), the negatively charged grains of toner T are attracted to the electrodes A, D and move onto them. Then, according to the prescribed timing, the voltage of both electrodes A, D become zero, as shown in FIG. 6(*c*), while the electrodes B, E become positive. At this moment, the grains of toner T on the electrodes A, D are repelled by the electrodes A, D and attracted to the electrodes B, E, simultaneously, thus transferred to the electrodes B, E. Then, at another shift of waveforms, the voltage of both electrodes B, E become zero, as shown in FIG. 6(*d*), while the electrodes C, F become positive. At this moment, the grains of toner T on the electrodes B, E are repelled by the electrodes B, E and attracted to the electrodes C, F, simultaneously, thus transferred to the electrodes C, F. In this manner, the negatively charged grains of toner are sequentially transferred to the right, as shown in FIG. 6, by the traveling waveform fields.

The multiphase (3 phase) drive waveforms applied to the electrodes of the transfer board 1 is described in detail. First, the relation between the polarity of voltage applied to the electrodes and the moving direction of the charged toner (powder) is described. When the toner is negatively charged and the applied voltage is zero or positive, the grains of toner jump in the reverse direction to that of an electric line of force heading from a positive electrode to an electrode of zero voltage. When the toner is positively charged, the grains of toner jump in the same direction of the electric line of force.

Figure 7:
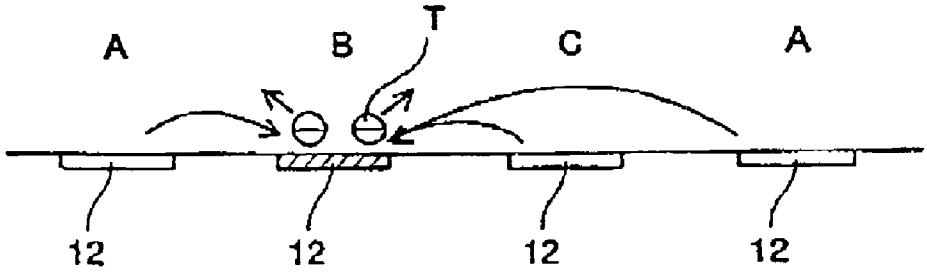
FIG. 7 is an explanatory drawing for describing the time and duty of applied voltage generating drive waveforms.

In FIG. 7 shows grains of toner on the electrode (B phase electrode) to which B phase pulse (drive waveform Vb) is applied. The behavior of the toner to an applying voltage pulse duty is described using FIG. 7. When the negatively charged grains of toner T are attracted to the B phase electrode while it is positive, the grains of toner T start jumping in the reverse direction to that of an electric line of force heading from a positive electrode to the B phase electrode at the point that the voltage of the B phase electrode is shifted to zero.

When the traveling waveform fields are generated by applying pulse voltage (drive waveforms) of n phase (n stands for a natural number of 3 or more) to each electrode, the positive voltage applying duty of applied voltage pulse is set in such a way that a voltage applying time per one phase is less than {repetition frequency time×(n−1)/n}. In this manner, transfer and hopping of the toner can be made more effectively.

Figure 8:
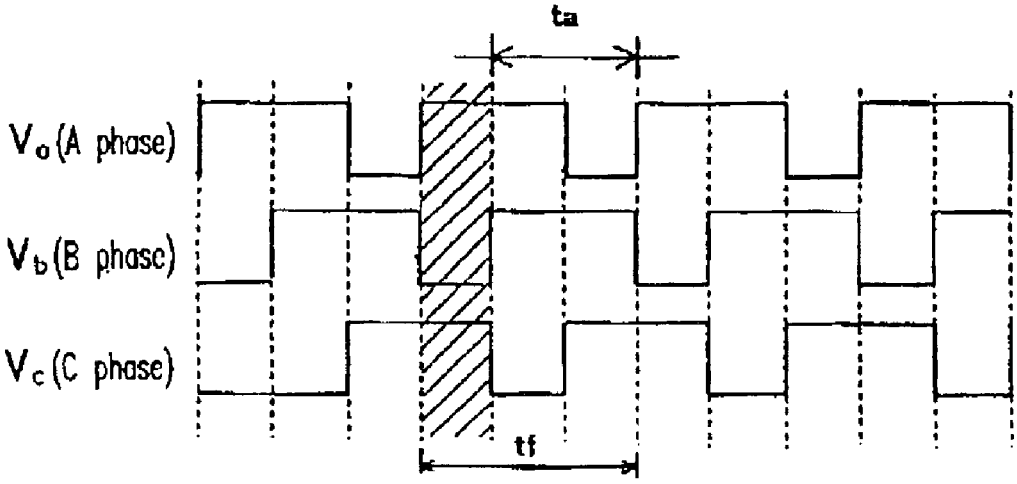
FIG. 8 is an explanatory drawing showing one example of the drive waveforms, which is generated by an applied voltage with a duty of 67%.
Figure 14:
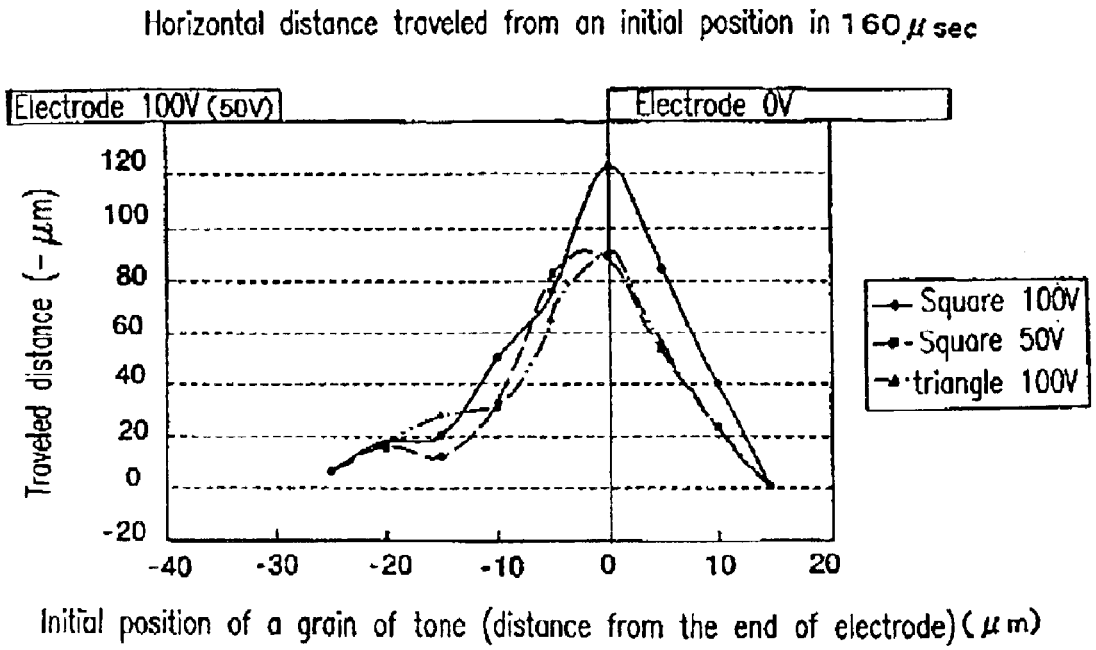
FIG. 14 is an explanatory drawing for describing the relation between the shape of drive waveform and the distance of horizontal travel of the powder.

For example, when three phases of drive waveforms A, B, C are applied and the voltage applying time t a of each phase is set to about 67% of the repetition frequency time t f, as shown in FIG. 8, both A phase and C phase come to positive when B phase come to zero voltage. Therefore, an electric field distribution given by a series of electrode of A phase, of B phase, and of C phase is symmetrical with respect to the electrode of B phase, as shown in FIG. 14.

As a result, grains of toner on the half side in the transfer direction of the electrode of B phase are moved in the direction of transfer and hopping, but grains of toner on the opposite half side is moved in the reverse direction, which reduces the efficiency of the transfer. Therefore, setting the voltage applying time t a for each phase to less than about 67% of the repetition frequency time t f prevents the decline of transfer efficiency when three-phase drive waveforms are used. When four-phase drive waveforms are used, setting the voltage applying time for each phase to less than about 75% of the repetition frequency time prevents the decline of transfer efficiency. For a purpose of making grains of toner jump straight up from the electrode (less priority to the transfer), setting the voltage applying time for each phase t a to less than about 67% of the repetition frequency time t f will make the grains of toner hop in the most effective manner.

Figure 9:
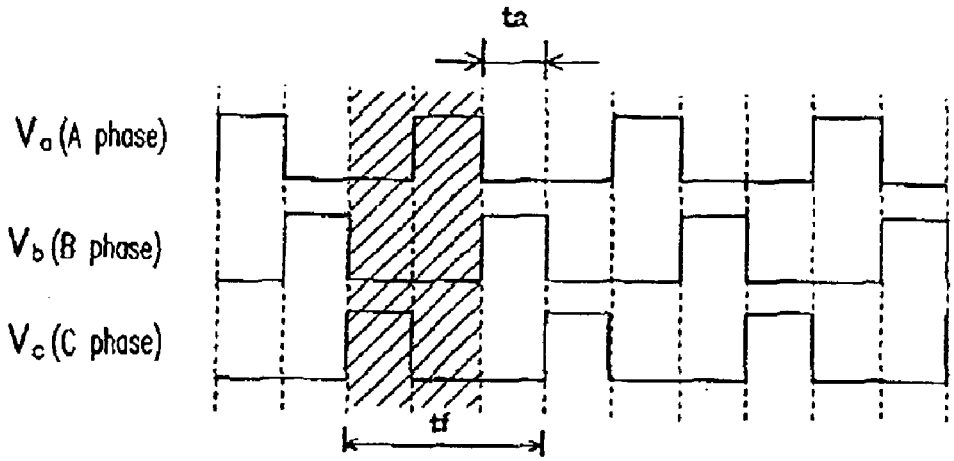
FIG. 9 is an explanatory drawing showing one example of the drive waveforms, which is generated by an applied voltage with a duty of 33%.

FIG. 9 shows a case where the drive waveforms of three phases of A, B, C are applied and the voltage applying time t a for each phase is set to about 33% of the repetition frequency time t f, that is, set to {repetition frequency time/n}. In this setting, at the moment when the applied voltage of the electrode of B phase comes to zero, the electrode of A phase comes to zero voltage and the electrode of C phase comes to positive, thus the transporting direction of powder becomes A to C. Therefore, the grains of toner on the electrode of B phase become under influence of an electric field making the grains of toner repelled by the electrode of A phase and attracted to the electrode of C phase. Thus, the efficiency of transfer and hopping is improved.

Therefore, in adjusting an applied voltage for each electrode, the transfer efficiency can be improved when the voltage applying time is set so as to make the electrode on the upstream side of transporting direction repulsive and one on the downstream side attractive when a given electrode is adjacent to the electrodes on both sides of transfer direction. When a drive frequency is high, setting the voltage applying time to more than {repetition frequency time/n} to less than {repetition frequency time×(n−1)/n} allows grains of toner on the given electrode to easily gain an initial velocity, so that the repetition frequency of transfer can be increased without reducing the transfer efficiency, which is particularly advantageous for a high speed transfer.

To achieve effective transfer and hopping, it is important to give an initial velocity higher than a prescribed value to the powder (toner) on the transfer board. For that purpose, an electric field having a necessary strength is made to act on the toner on the transfer board. The necessary strength is a strength needed to allow each grain of toner break away from an absorption force, such as a mirror image force, a van der Waals force and the like capturing the grain according to its charge, and jump up.

The strength of a desirable electric field capable of giving a force effective for transfer and hopping of the toner is more than (5E+5) V/m. As a strength for eliminating a problem of absorption, more than (1 E+6) V/m is desirable. Further, as a more desirable strength to give an enough force, more than (2E+6) V/m is desirable. When the grains of toner gaining an enough velocity from an electric field having this strength move to a distance where the influence of the field does not reach, the efficiency of transfer and hopping is hardly affected even when the voltage relation, as described for A, B, and C phases above, between a given electrode and the adjacent positive electrodes on the downstream and the adjacent electrode of zero voltage on the upstream comes to collapse.

For example, when a voltage of 100 V is applied to the electrode, the effect of field from the electrode becomes almost none at the point 50 $\mu$m above the electrode. Besides, the strength of field is reduced to ⅕ at the point 30 $\mu$m above the surface of the electrode. Therefore, when a grain of toner accelerated to jump upward has an average velocity of 0.3 to 1 m/sec, it takes 30 to 100 $\mu$sec for the grain to travel through the distance of 30 $\mu$m to reach the point where the strength of field declines to ⅕.

Therefore, it is desirable to set a voltage applying time of more than 30 $\mu$sec to apply a voltage to a given electrode of a specific phase for repelling the powder, to the adjacent electrode on the upstream for repelling, and to the adjacent electrode on the downstream for attracting, simultaneously. In the above example shown in FIG. 7, more than 30 $\mu$sec of the voltage applying time makes the upstream side adjacent electrode (electrode of A phase) zero voltage and the downstream side adjacent electrode (electrode of C phase) positive against the electrode of B phase. The voltage applying time described above is a narrower condition for a positive voltage applying pulse duty.

Next, a description is to be made for the width L of a plurality of the electrodes 12 of the transfer board 1, on which the toner (powder) is transferred as it hop, the space R between the electrodes, the shape of drive waveforms, and the surface protective layer 13. The width L of electrodes and the space R between the electrodes substantially affects the transfer efficiency and hopping efficiency of the powder (toner).

The grains of toner between electrodes are moved along the surface of the board to the adjacent electrode due to electric fields formed horizontally. Meanwhile, most of the grains of toner on the electrode jump upward from the board surface with a given initial velocity at least having a vertical component.

The grains of toner near the end of electrode jump across the adjacent electrode as they move. Therefore, when the width L of electrodes is wide, the number of the grains of toner on the electrodes increase, so the grains of toner to make a long leap increase since they jump across a wide electrode, thus improving the transfer efficiency. However, a too large width of electrodes leads to a decrease of the strength of an electric field near the centers of electrodes, allowing the grains of toner to stick to the electrodes, thus reducing the transfer efficiency. The inventor found an appropriate width of the electrode for enabling an effective transfer and hopping of powder at a low voltage.

The space R between electrodes determines the strength of electric field between the electrodes because the strength of electric field changes according to the relation between a distance and an applied voltage. The narrower the space R is, the stronger the electric field is, so it becomes easy for grains of toner to acquire an initial velocity for the transfer and hopping when the space R is narrow. However, the moving distance of grains of toner traveling from electrode to electrode at one leap get shorter if the space R is narrower. In such a case, the transfer efficiency cannot be improved unless the drive frequency is increased. In solving this problem, the inventor also found an appropriate space between the electrodes for enabling an effective transfer and hopping of powder at a low voltage.

The thickness of a protective layer covering the surface of electrode affects the strength of electric fields on the surface of electrode. Particularly, the electric line of force of vertical component is strongly affected in determining the efficiency of hopping.

Therefore, it is necessary to set an appropriate relation among the width of electrodes, the space between electrodes, and the thickness of the surface protective layer in order to solve the problem of toner absorption on the electrode surface and enable the effective transfer at a low voltage.

When the width L of electrodes is set to the same size as that of the diameter of grains of toner (diameter of grains of powder), the width L is the minimum size for transferring or hopping at least one grain of toner. If the width L is narrower than the above size, the electric field acting on the grain of toner becomes weaker, which leads to less force of transfer and jumping, thus it becomes difficult to put the electrodes in practical use.

As the width L go wider, the electric line of force come to incline in the transfer direction (horizontal direction), especially near the center of the space above the electrode, generating an area where a vertical electric field is weak, thus reducing the force for hopping the grains of toner. Too large width L may cause the grains of toner to deposit on the electrode as an absorption force capturing the grains according to their charge, such as a mirror image force, a van der Waals force, and an absorption force caused by water content, surpasses the vertical component of the grains of toner.

In consideration for transfer and hopping, it is concluded that the width L for allowing 20 grains of toner to be positioned on the electrode will suppress the absorption, making possible to carry out an effective transfer and hopping with given drive waveforms having a low voltage of about 100 V. The width L wider than the above size will form an area where the absorption occurs over the electrode. In this case, for example, when the average grain diameter of toner is 5 $\mu$m, the width L is set to 5 $\mu$m to 100 $\mu$m.

A more desirable range of the width L for effective transfer by drive waveforms having an applied voltage of lower than 100 V is the range 2 to 10 times the average grain diameter of powder. By setting the width L within this range, the decrease of the strength of electric field near the center of the electrode surface can be suppressed to the ratio of ⅓ or less, and the decrease of the hopping efficiency becomes the ratio of 10% or less, thus a sharp decline of the transfer efficiency can be avoided. In this case, for example, when the average grain diameter of toner is 5 $\mu$m, the width L is set to 10 $\mu$m to 50 $\mu$m.

Further desirable width L of electrodes is the range 2 times to 6 times the average grain diameter of powder. In this case, for example, when the average grain diameter of toner is 5 $\mu$m, the width L is set to 10 $\mu$m to 30 $\mu$m. It has proved that setting the width L within this range substantially improves the transfer efficiency.

Figure 10:
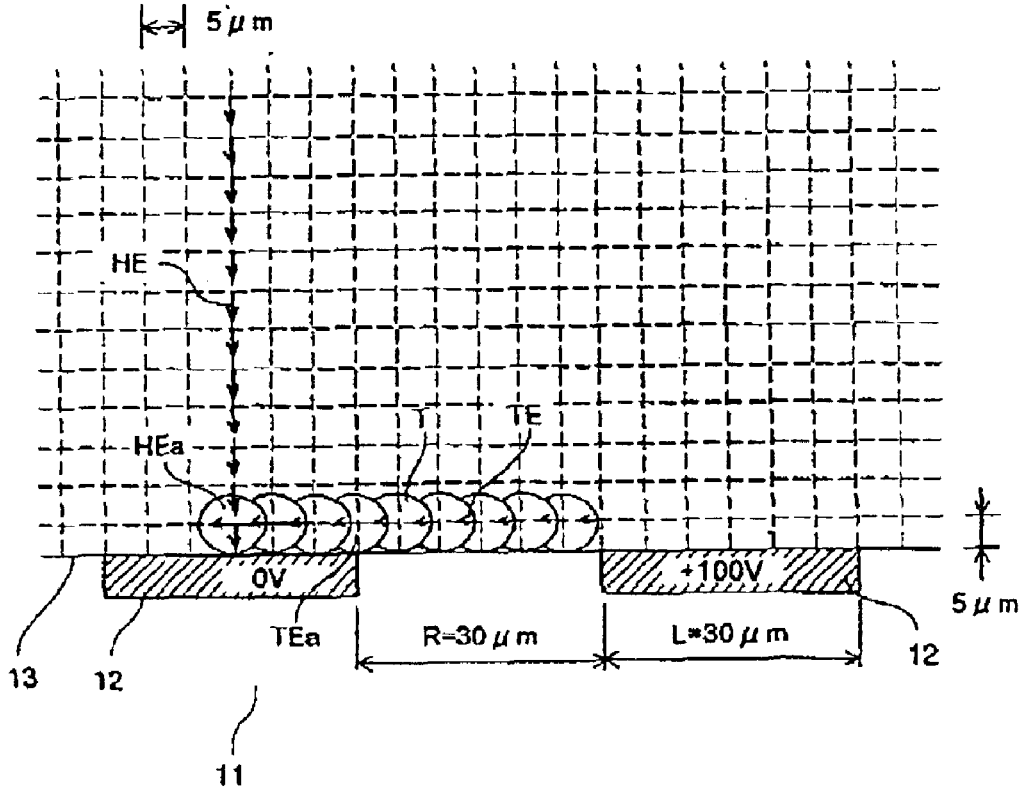
FIG. 10 is an explanatory drawing for describing the width of and the spaces between electrodes.

A test has been conducted in the condition as shown in FIG. 10, where the width L of the electrode 12 on the transfer board 1 is 30 $\mu$m, the space R between electrodes is 30 $\mu$m, the thickness of the electrode 12 is 5 $\mu$m, the thickness of the protective layer 13 is 0.1 $\mu$m, and each voltage applied to adjacent two electrodes 12, 12 is +100 V and zero. In this condition, the strength of a transfer field TE and a hopping field HE for the width L and the space R are measured, respectively. The result of the measurement is shown in FIGS. 11 and 12.

Each appraisal data is a combined result from simulations, measurements, and observations of the behavior of the grains of toner using a high speed video. Though only two electrodes 12 are shown in FIG. 10 for describing the detailed behavior of the grain of toner, actual simulations and tests are conducted on an area including substantial number of electrodes. The grain diameter T of toner is 8 $\mu$m, and the charge of one grain is −20 $\mu$C/g.

Figure 11:
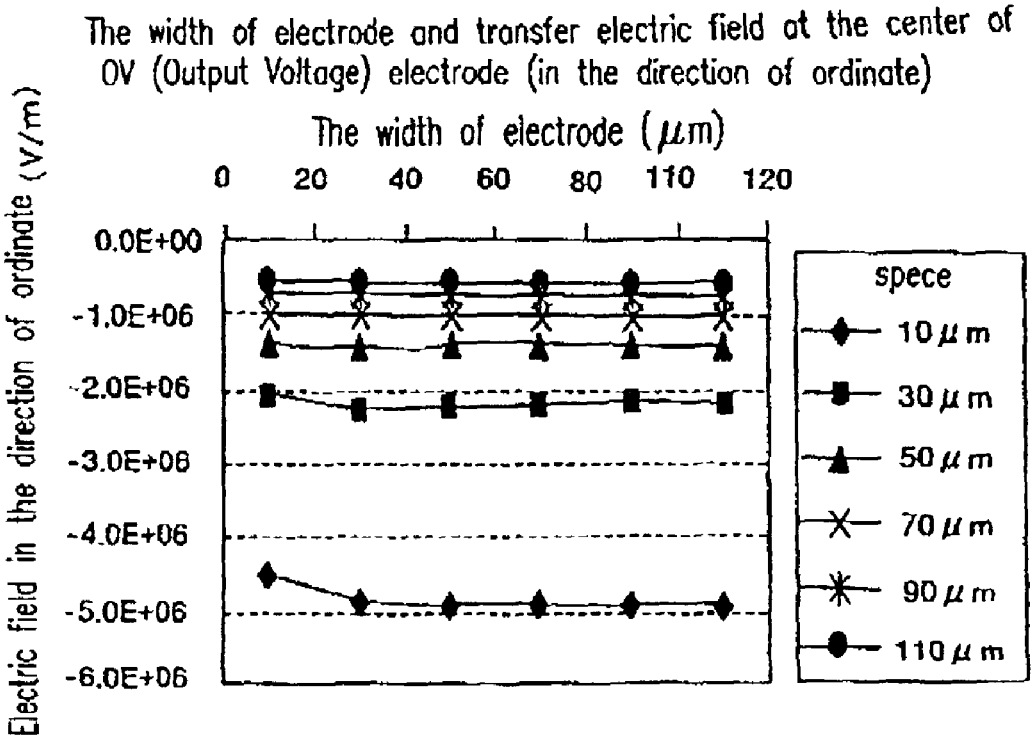
FIG. 11 is an explanatory drawing for describing the relation between the width of electrodes and the electric field (X direction) at the end of an electrode with zero voltage.
Figure 12:
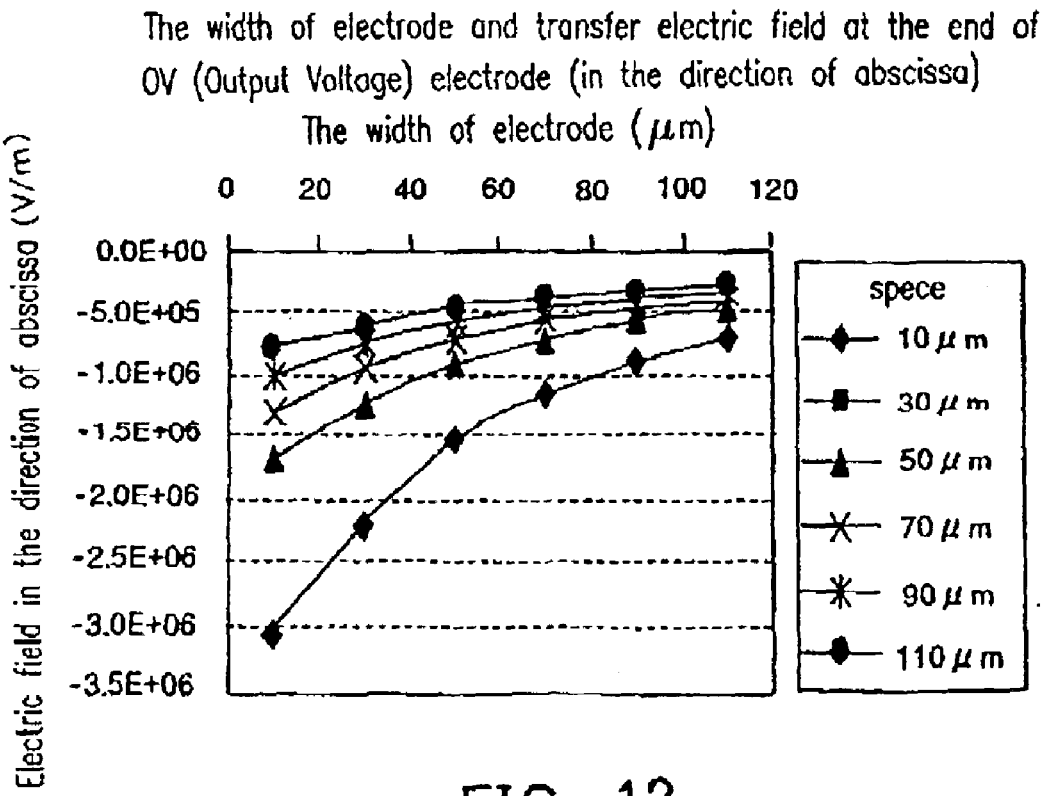
FIG. 12 is an explanatory drawing for describing the relation between the width of electrodes and the electric field (Y direction) at the end of an electrode with zero voltage.

The field strength as shown in FIGS. 11 and 12 is the field strength value of a typical point on the surface of the electrode. A typical point TEa in a transfer field TE is the point 5 $\mu$m above the end of electrode, as shown in FIG. 10, and a typical point HEa in a hopping field HE is the point 5 $\mu$m above the center of electrode, as shown in FIG. 10. The typical point TEa represents the spot where the electric field force acting on the grain of toner is strongest in the direction of abscissa, while the typical point HEa represents the spot where the electric field force is strongest in the direction of ordinate.

According to FIGS. 11 and 12, it is found that the strength of electric field capable of giving a force effective for transfer and hopping of the toner is more than (5E+5) V/m. As the strength for eliminating a problem of absorption, more than (1 E+6) V/m is desirable. Further, as a more desirable strength to give an enough force, more than (2E+6) V/m is desirable.

Since the electric field strength in the transfer direction declines as the space R between electrodes becomes wider, it is necessary to set the space R, as a value corresponding to the above range of field strength, within a range of 1 to 20 times the average grain diameter of toner, or desirably of 2 to 10 times, or more desirably of 2 to 6 times.

As indicated in FIG. 12, the hopping efficiency also decreases as the space R becomes wider. However, the space R within the range of 20 times the average grain diameter provides the hopping efficiency for practical use. When the width R is over the above range, the absorption force of grains of toner increases to the extent that cannot be neglected, capturing some grains of toner to prevent them from jumping. Therefore, the space R between electrodes must be 20 times or less the average grain diameter of toner.

As described heretofore, the electric field strength in the direction of ordinate is determined by the width L of electrodes and the space R between electrodes, and the narrower the width L and space R are, the stronger the electric field strength is. The electric field strength near the end of electrode in the direction of abscissa is also determined by the space R between electrodes, where the narrower the space R is, the stronger the electric field strength is.

As described above, the width of electrode in the transporting direction of the powder is set to 1to 20 times the average diameter of the powder and the space between electrodes in the transporting direction of the powder is set to also 1to 20 times the average diameter of the powder. In this manner, it is possible to make an electrostatic force of enough strength act on charged grains of the powder on or between the electrodes so that the grains of powder beak away from an absorption force, such as mirror image force, van der Waals force and the like, to be transferred or hop. Thus, the deposition of powder can be prevented, and a stable and effective transfer and hopping of powder can be made at a low voltage.

According to the inventor's study, the transfer and hopping in the above electrode constitution has proved to be effective when the average diameter of toner is 2 to 10 μm, and Q/m of negatively charged toner is −3 to −40 μC/g, more preferably −10 to −30 μC/g, and Q/m of positively charged toner is +3 to +40 μC/g, more preferably +10 to +30 μC/g.

Figure 13:
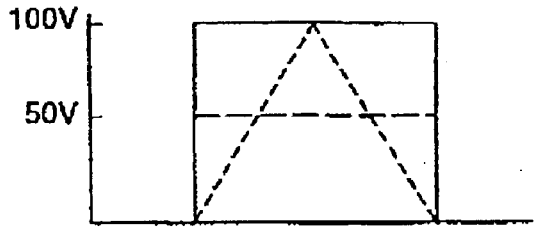
FIG. 13 is an explanatory drawing for describing the shape of drive waveform.

Next, the shape of the drive waveforms applied to each electrode of the transfer board is described. According to the constitution shown in FIG. 10, the initial position and the horizontal travel distance in a prescribed time (160 μsec) of the grains of toner has been measured under the condition that the average grain diameter of toner is 8 μm, Q/m of toner is −20 μC/g, and square (pulse) drive waveforms (a waveform having voltage value of 10 V and a waveform having voltage value of 50 V) and triangle drive waveforms (maximum voltage value of 100 V) are applied, as shown in FIG. 13. The result of measurement is shown in FIG. 14.

As indicated in FIG. 14, the square drive waveform of 50 V makes the grains of toner travel at a shorter distance, compared to that by the square drive waveform of 100 V. The triangle drive waveforms having a rise-time and a downtime of 80 μsec make the grains of toner travel at the same distance as that by the square drive waveform of 50 V.

As for the strength of the electric field forcing the toner on the transfer board to travel and hop, the strength near the board, which determines the initial velocity of the grains of toner, is important. In other words, when an applied voltage is increased and the electric field strength is enhanced after the grain of toner has left far away from the board surface, the field does not contribute to the transfer and hopping anymore, thus the transfer efficiency is reduced.

For example, when the grain of toner accelerated to jump upward has an average velocity of 0.3 to 1 m/sec, it takes 30 to 100 μsec for the grain to travel through the distance of 30 μm to reach the point where the strength of field declines to ⅕. Therefore, in this case, the time constant of applied voltage of drive waveform of 30 to 100 μsec gives the grains of toner the initial velocity, enabling the transfer and hopping of the toner.

Figure 15:
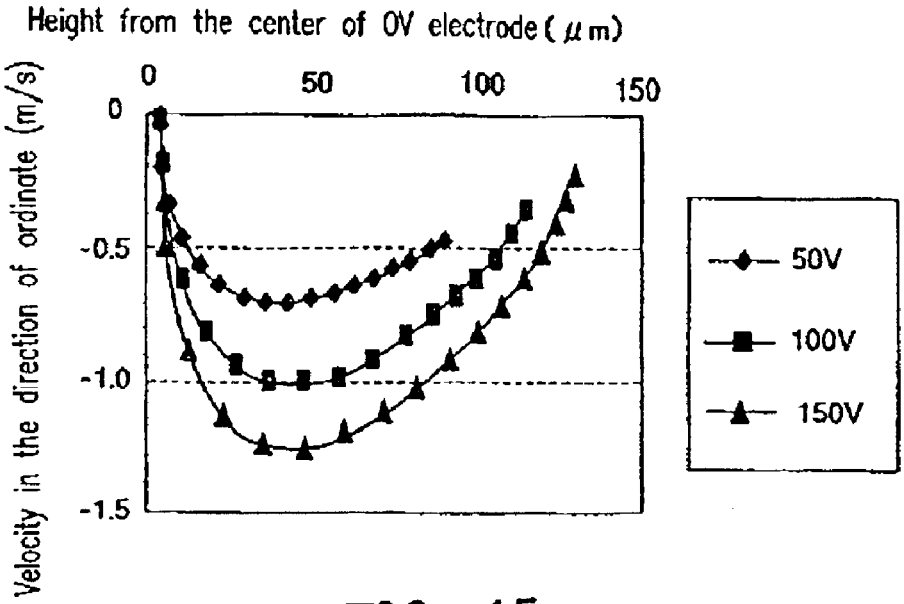
FIG. 15 is an explanatory drawing for describing the relation between the voltage value of drive waveform and the Y directional velocity and hopping height of the powder.

FIG. 15 shows the result of a test in which the velocity of the grains of toner in the hopping direction (hoping velocity) is measured. In the test, the constitution shown in FIG. 10 is used, and the average grain diameter of toner is 8 μm, Q/m of the grains of toner is −20 μC/g, and square drive waveforms with a high voltage value of 50 V, 10 V, and 150 V are applied. The FIG. 15 shows the velocity change of the grains of toner per 10 μsec and the height of the grains of toner from the electrode. The test result shows that the grains of toner reaches the height of almost 100 μm after a prescribed time (160 μsec) has passed.

The drive waveform is not limited to square (pulse) drive waveform, but other drive waveform, such as a triangular wave having a time constant, also enable the transfer and hopping move. Besides, a sine wave having a time constant equal to that of the above waveforms can also be put in practical use to enable the transfer and hopping move.

Next, the surface protective layer 13 is described. By providing a surface protective layer, an attachment of fine particles and the like on the electrode surface is prevented so that the electrodes are protected from fouling. The protective layer can keep the surface of board in a good condition for transfer of the toner, can prevent a creeping leak occurring under a highly moist environment, and eliminates the fluctuation of Q/m to maintain the quantity of charge of the grains of powder in a stable manner.

Figure 16:
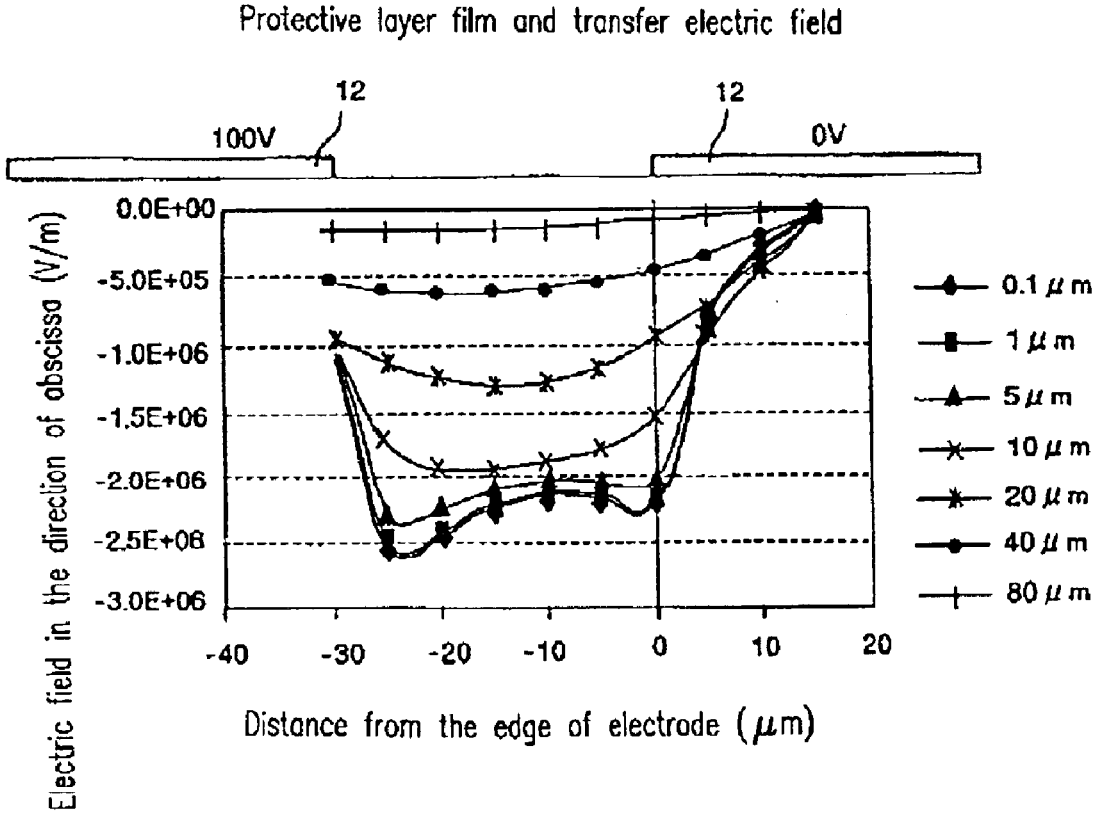
FIG. 16 is an explanatory drawing for describing one example of the relation between a thick film of surface protective layer and the strength of fields.

FIG. 16 shows the result of calculation of the electric field strength in the direction of abscissa when the thickness of surface protective layer is changed within a range of 0.1 to 80 μm in the constitution shown in FIG. 10.

The dielectric constant ∈ of the surface protective layer is higher than that of air, where ϵ=more than 2. As indicated in FIG. 16, when the film thickness of the surface protective layer (the thickness of a film formed between the surface of electrode and the surface of transfer board) is too thick, the strength of the electric field acting on the toner on the surface decreases. Under consideration for the elements of transfer efficiency, moisture or temperature environment and the like, a condition for the surface protective layer that can be put in practical use without a problem of a low efficiency of transfer move is that the thickness of the surface protective layer is 10 μm or less, where 30 μm of thickness will result in the loss of transfer efficiency by 30%, and 5 μm of thickness is more desirable because the decrease of the efficiency can be suppressed to less than several % at this thickness.

Figure 17:
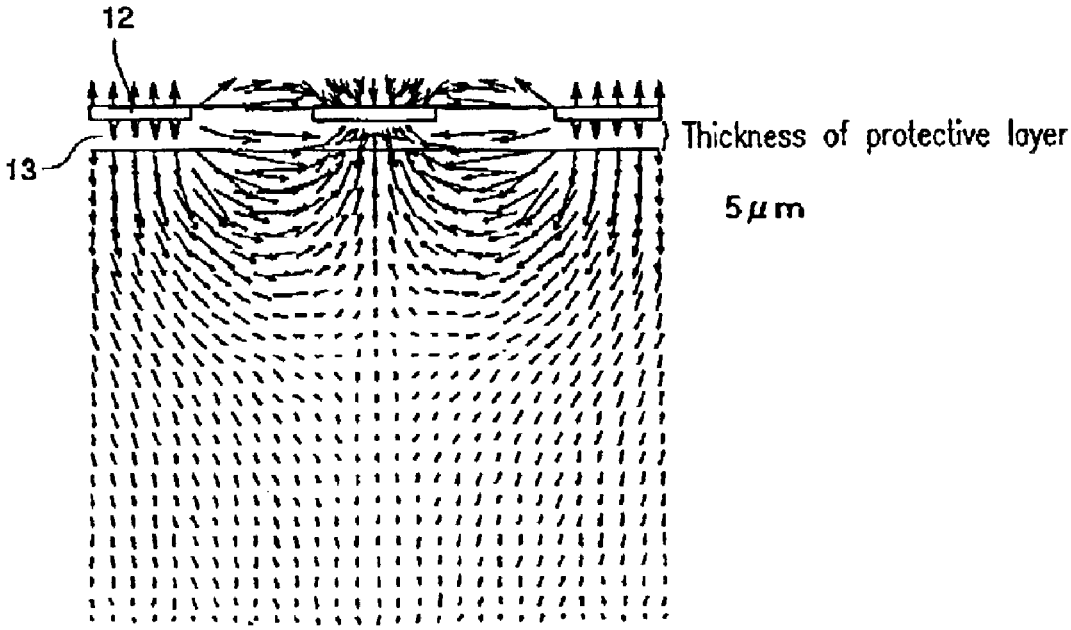
FIG. 17 is an explanatory drawing for describing the relation between the thick film of surface protective layer and the strength of fields.
Figure 18:
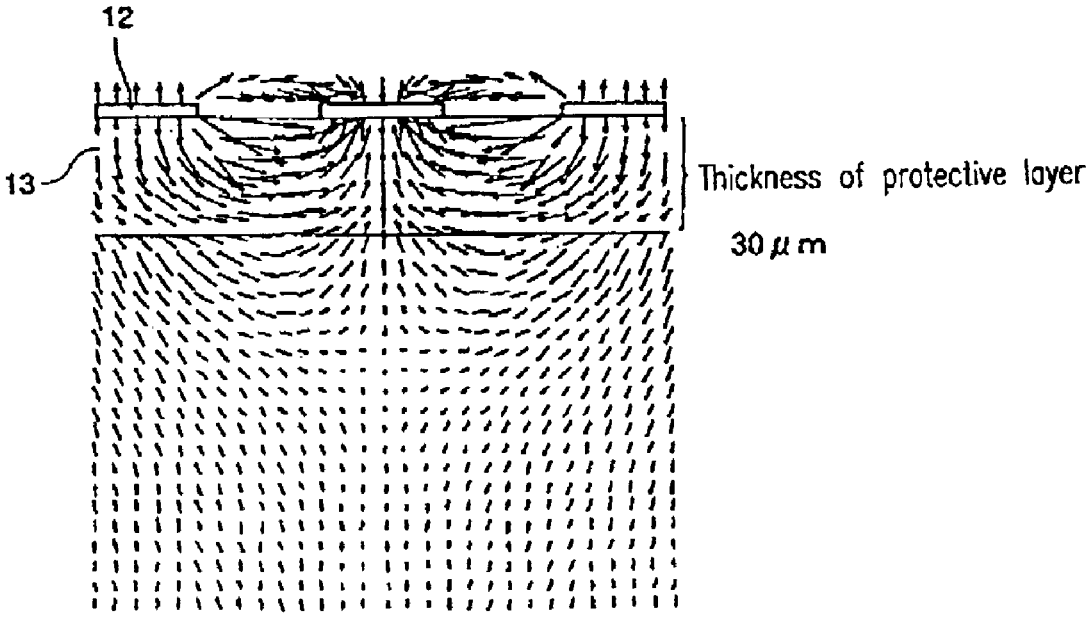
FIG. 18 is another explanatory drawing for describing the relation between the thick film of surface protective layer and the strength of fields.

FIGS. 17 and 18 show examples of the electric field strength affects the hopping on the electrode surface. FIG. 17 shows a case where the thickness of the surface protective layer is set to 5 μm, while FIG. 18 shows a case where the thickness of the surface protective layer is set to 30 μm. In both cases, the width of electrodes is 30 μm, the space between electrodes is 30 μm, and the applied voltage is 0 V and 100 V.

As indicated in FIGS. 17 and 18, making the surface protective layer thicker increases electric fields heading for the adjacent electrode through the protective layer having a dielectric constant higher than that of air. As a result, the vertical component of the field is reduced, so that the thickness of the surface protective layer reduces the strength of electric field acting on the grains of toner on the surface.

Therefore, the electric line of force of vertical component, which acts on the grains of toner to hop them, depends greatly on the thickness of protective layer. The strength of electric field capable of giving a force effective for hopping of the toner at a low voltage of about 100 V is, as the strength eliminating a problem of absorption, more than (1E+6) V/m. As a more desirable strength to give an enough force, more than (2E+6) V/m is desirable. To obtain electric fields of such ranges, the thickness of protective layer must be 10 μm or less, and more desirably 5 μm or less.

It is desirable that the surface protective layer consist of a material of which the resistivity is more than 10*E 6 Ωcm and dielectric constant ϵ is more than 2.

As described above, it becomes possible to make the vertical component of electric fields act strongly on the powder to improve the efficiency of hopping by providing the surface protective layer to cover the electrode surface and setting the thickness of the layer to 10 μm or less.

Next, the thickness of electrodes 12 is described. When a surface protective layer of several μm covering the electrode surface is formed, uneven parts are formed on the surface of the transfer board, corresponding to an area where the electrode is under the protective layer and an area where no electrode is under the protective layer. However, when each electrode is formed into a thin layer of less than 3 μm, the unevenness of the transfer board surface can be offset and grains of powder (toner) having the average diameter of about 5 μm can be transferred smoothly. Therefore, forming electrodes having each thickness of 3 μm or less makes possible to put the transfer board having the thin surface protective layer to practical use without a need of a flattening treatment for the transfer board surface. Since such a transfer board has the surface protective layer, the decrease of electric field strength for transfer and hopping of powder is eliminated, and more effective transfer and hopping can be carried out.

Next, specific examples of the above transfer board are described. When the electrostatic transfer apparatus of this invention is used for the image forming apparatus, a specific size of a transfer board for the transfer and hopping is required. The transfer board must be rectangular and is at least 21 cm long or more and 30 cm wide or more, where fine patterns are formed on such a large area. To that end, it is desirable to laminate a thin-layered electrode and a thin protective film (surface protective layer) in order on a base material (support board) to form the transfer board.

For example, when manufacturing a transfer board having a flexible fine pitch thin-layered electrode, a polyimide base film having a thickness of 20 to 100 μm is used as a base material (support board 11), and a film of 0.1 to 3 μm thick consisting of Cu, Al, Ni—Cr, or the like is formed on the base material by a vapor deposition method. A base material of 30 to 60 cm wide can be manufactured using a roll-to-roll machine, so mass productivity is improved. A plurality of electrodes each having a width of 1 to 5 μm are formed simultaneously in a bath line.

The vapor deposition method includes a sputtering method, an ion plating method, a CVD (chemical vapor deposition) method, an ion beam method. For example, when the electrodes are formed by the sputtering method, a Cr film may be interposed between polymide base film and the electrodes so that the adhesiveness between the polyimide and the electrodes is improved. The adhesiveness can also be improved by a plasma treatment or a primer treatment, which is carried out as a pre-treatment.

As a manufacturing method other than the vapor deposition method, electro-deposition method may also be employed for forming a thin-layered electrode. In this method, first, electrodes are formed on a polyimide base material through a non electrolytic plating process. Then the base material is dipped in a tin chloride bath, a lead chloride bath, and a nickel chloride bath in order to form a substrate electrode. After that, the base material is subjected to a electrolyte plating process in a nickel electrolytic solution, where a nickel film of 1 to 3 μm thick is formed in a roll-to-roll process.

The base material coated with the nickel film is further subjected to a series of processes of resist coating, patterning, and etching, then the electrodes 12 are formed. When thin-layered electrodes of 0.1 to 3 μm thickness are to be formed, fine-patterned electrodes, each of which has a width of 5 to 10 μm and is arranged between a space of 5 to 10 μm, can be formed in a precise manner by a photolithography or an etching.

In forming the surface protective layer 13, a film of 0.5 to 2 μm thick consisting of $SiO_2$, $TiO_2$ or the like is formed by a sputtering method and the like. Or, manufactured electrodes are coated with a PI (polyimide) film of 2 to 5 μm thick, which is the protective layer, by a roll coater or other coating apparatus, then is baked to be finished. If PI is insufficient as the protective layer, a $SiO_2$ film or other inorganic film of 0.1 to 2 μm thick may be further formed on the PI film by a sputtering method and the like.

The flexible transfer board having the constitution described above can be attached on a cylindrical drum, or formed into a partially bent shape.

As another example, it is possible to make a polyimide base film of 20 to 100 μm thick as a base material (support board 11) and a Cu film, a SUS film or the like, which is 10 to 20 μm thick, is formed on the base material as an electrode material. In this case, a metal material is coated with a polyimide by a roll coater to form a polymide film of 20 to 100 μm thick, and the coated material is baked. Then, the pattern of electrodes 12 is formed on the metal material by a photolithography or etching, and the surface of the electrodes 12 is coated with a polyimide layer, which is the protective film 13. If there is a surface unevenness corresponding to the thickness of the metal material electrodes of 10 to 20 μm, a sub-flattening process is carried out, where an allowable unevenness is included.

For example, when a spin-coating of a polyimide material or polyurethane material, which has a viscosity of 50 to 10,000 cps, or more desirably, of 100 to 300 cps, is carried out and the material is left alone, the surface tension of the material smoothes out the unevenness of the board, flattening the top surface of the transfer board. The coated material is further subjected to a heat treatment and is made into a stable protective film.

In another example of further improving the strength of the flexible transfer board, a material consisting of SUS, Al or the like, which is 20 to 30 μm thick, is used as a base material. The base material is coated with a diluted polyimide material of 5 μm thick by a roll coater, where the polyimide material is provided as an insulating layer between the base material and the electrode. The polyimide material is, for example, pre-baked for 30 minutes at 150° and is post-baked for 60 minutes at 350° to form a thin polyimide film, which comprises the support board 11.

The support board 11 is subjected to a plasma treatment or a primer treatment in order to improve the adhesiveness of the polyimide film. Then, a thin electric layer of Ni—Cr of 0.1 to 2 μm thick is formed on the above support board 11 by a vapor deposition method, and the fine patterned electrodes 12 described above are formed by a photolithography or an etching. Further, the surface protective layer 13 of 0.5 to 1 μm thick consisting of $SiO_2$, $TiO_2$ or the like is further formed on the electrodes by a sputtering method to form a flexible transfer board.

In this example, a metal material used as the base material for the transfer board 1 is the same material as that of a cylindrical drum, or the one whose linear expansion coefficient is almost coincides with the cylindrical drum, when the transfer board 1 is wound around the cylindrical drum. In this manner, it is possible to prevent the shrinkage of the transfer board caused by the linear expansion coefficient difference between the transfer board 1 and the cylindrical drum at a given temperature. Besides, when the transfer board is used for the developing part of the image forming apparatus, the base material consisting of SUS, Al or the like can be used as a bias electrode between a photo sensitive body.

The transfer board 1 manufactured as described above is flexible so that it can be wound around a cylindrical drum, or part of it can be bent for more practical use. Besides, the mass production of such a transfer board is possible using a roll-to-roll process. Thus, transfer boards having highly accurate fine pitch electrodes can be manufactured at a low cost.

Each transfer board described above need to be provided with an electrode commonly connected to each electrode for generating traveling wave fields. In a case of two-phase fields, both electrodes can be formed simultaneously. In a case of three-phase fields, a jumping pattern is formed via an insulating layer for one phase.

Next, the relation between the charge polarity of traveling powder and the material for the top layer of surface protective layer is described. The top layer of surface protective layer means the surface protective layer itself when the surface protective layer consists of a single layer, while the top layer refers to the layer forming the surface in contact with the powder when the surface protective layer comprising a plurality of layers.

For the transfer of toner used for the image forming apparatus, a melting temperature and transparency is considered in selecting a resin material constituting 80% of the toner. Generally, styrene-acrylate copolymer, polyester resin, epoxy resin, polyole resin or the like is selected. Such a resin has an effect on the charge characteristic of the toner, and a charge control agent is added to the resin to control the quantity of charge. As a charge control agent for black toner (BK), for example, nigrosine die or fourth-ammonium salt class is used for positively charged toner, while azo-containing metal complex or salicylic acid metal complex is used for negatively charged toner. As a charge control agent for color toner, for example, fourth-ammonium salt class or imidazole complex class is used for positively charged toner, while salicylic acid metal complex, salt class, or organic boron salt class is used for negatively charged toner.

The toner comes in contact with and is separated from the surface protective layer repeatedly while it is transferred and hop on the transfer board by phase-shifting fields (traveling wave fields). As a result, the toner receives the effect of a friction charge. The quantity and polarity of friction charge depends on the charge series of materials causing friction.

In this case, the charge quantity of the toner is kept at a saturation quantity of charge that is determined mainly by the charge control agent, or a little less. In this manner, the efficiency of transfer, hopping, and photosensitive phenomenon can be improved.

When the charge polarity of toner is negative, it is desirable to use, as a material forming the top layer of surface protective layer, a material positioned near the material of the charge control agent (if the area for transfer and hoping is small) in the order in the friction charge series, or a material positioned on the positive side in the friction charge series. For example, when the charge control agent is the salicylic acid metal complex, it is desirable to use a polyamide material, such as polyamide (nylon) 66, nylon 11 and the like.

When the charge polarity of toner is positive, it is desirable to use, as a material forming the top layer of surface protective layer, a material positioned near the material of the charge control agency (if the area for transfer and hoping is small) in the order in the friction charge series, or a material positioned on the negative side in the friction charge series. For example, when the charge control agent is the fourth-ammonium salt class, it is desirable to use a material positioned near fourth-ammonium salt in the friction charge series, or a Teflon (registered trademark) material, such as fluorine.

Figure 19:
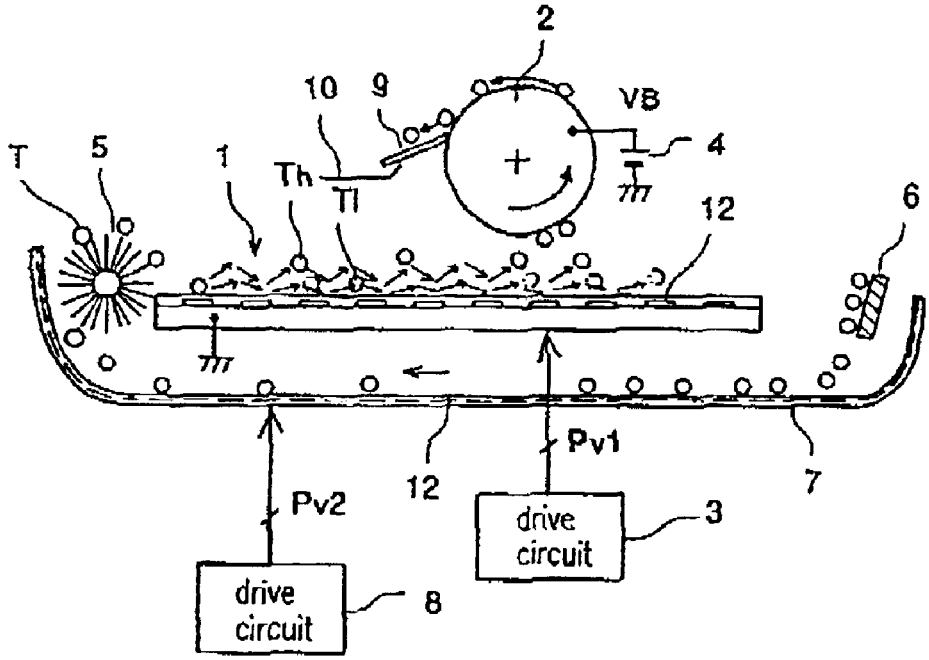
FIG. 19 is an explanatory drawing for describing the operation of the classifier of the first embodiment.

Next, the operation of the classifier constituted as described above is described referring to FIG. 19 and other drawings. As shown in FIG. 19, when the toner T charged by the charging brush 5 is supplied to the transfer board 1, the toner T is transferred on the transfer board 1 in the arrowed direction as it hops. During the transfer, each grain of toner acts differently on the electric fields according to the strength of the fields generated by the electrodes 12, because the mass and the quantity of charge of each grain of toner T varies. As a result, some grains of toner Th make a great hop and are transferred on the transfer board 1, and other grains of toner Tl make a small hop or no hop at all and are transferred as grains of toner Th, Tl respond to the strength of the generated electric field. Although the extent of hopping varies, the grains of toner Th and Tl are cited as a typical example for two patterns of hopping for further description.

The grains of toner Th, Tl are transferred on the transfer bard 1 as they hop to the vicinity of the opposite roller 2, where a bias voltage (positive) having the polarity reverse to the charge polarity of the toner T (negative) has been applied to the opposite roller 2. Then, the grains of toner Th hopping high on the transfer board 1 are attracted to the opposite roller by its electric field and are transported to the opposite roller 2, then are attached to the surface thereof. The attached grains of toner Th is moved via the rotation of the opposite roller 2 to a blade 8, where the grains of toner Th are removed from the surface of the opposite roller 2 and are sent to a storing part or a developing means, which are not illustrated.

Meanwhile, the grains of toner Tl, which hop low or do not hop on the transfer board 1, receive almost no influence of the electric field generated by the opposite roller 2. Therefore, the grains of toner Tl are keep transferred along the transfer board surface to reach the other end of the transfer board 1, where the grains of toner Tl are collected by the collecting electrode 6 and are dropped on the recovery member 7. Then, the grains of toner Tl are transferred again toward the charged brush 5 by traveling wave fields form the recovery member 7. The charged brush 5 recharges the grains of toner Tl, supplying them again to the transfer board 1.

Therefore, the toner T transferred on the transfer board 1 is separated (classified) into the grains of toner Th and the grains of toner Tl.

As described above, the extent of hopping (height of hopping) of the toner T depends on a drive voltage given to the electrodes of the transfer board 1 (generated electric fields). However, the extent of hopping of the toner T depends also on the characteristics of grains of toner and the characteristics within a certain range allow the grains of toner Th to reach the opposite roller 2 and stick to the surface thereof. The grains of toner having a small mass, a great charge, or a large q/m make a great jump (hop) on the transfer board 1. Accordingly, grains of toner hopping high on the transfer board 1 are transported and attached to the opposite roller 2, and other grains of toner are kept transferred along the surface of the transfer board 1. In this manner, the classification, or separation, of toner can be made according to the characteristic differences of grains of toner.

Figure 20:
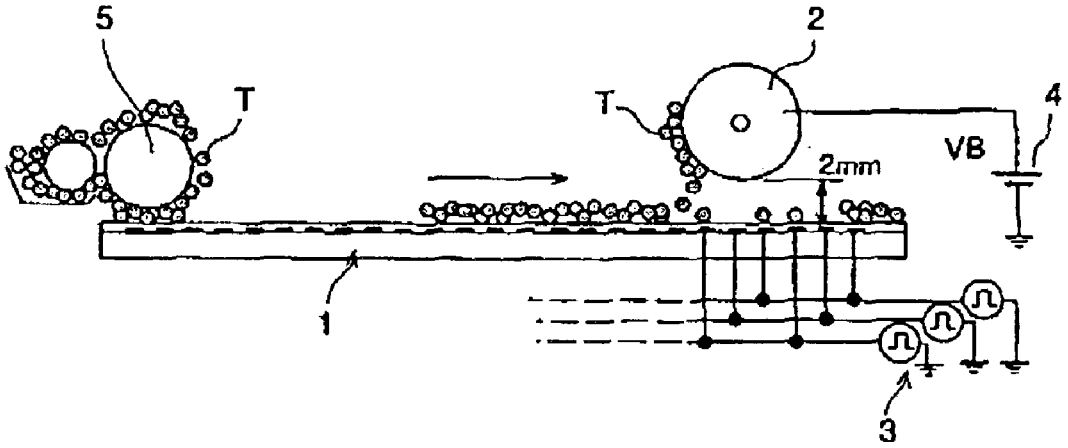
FIG. 20 is an explanatory drawing for describing the classifying operation of the above classifier.

The inventors have conducted a classification test of toner in the constitution shown in FIG. 20. In the test, the toner is charged by a charging means 5 using a magnet roller on one end of the transfer board 1, from which the toner is supplied. The opposite roller 2 is made opposite to the transfer surface of the transfer board 1 consisting of an aluminum roller, where the distance between the transfer surface and the opposite roller 2 is 2 mm. The opposite roller 2 is provided with a bias power source 4, from which a bias voltage of DC 40 V and DC 20 V is selectively applied.

Figure 21:
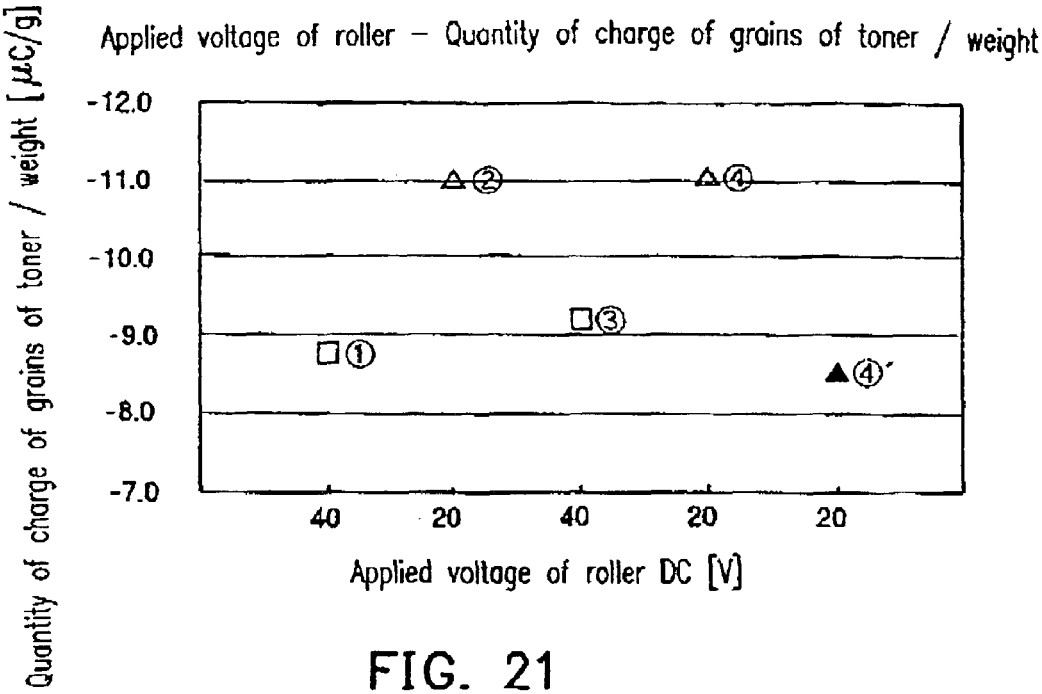
FIG. 21 is an explanatory drawing for describing one example showing that the grains of toner is classified according to the quantity of charge by a roller applied voltage.

The relation between the applied voltage of roller and the quantity of charge/mass ($\mu$C/g) of grains of toner attached to the opposite roller 2 is shown in FIG. 21. A bias voltage VB is changed sequentially between 40 V and 20 V so that the repeatability of results is assessed.

Figure 22:
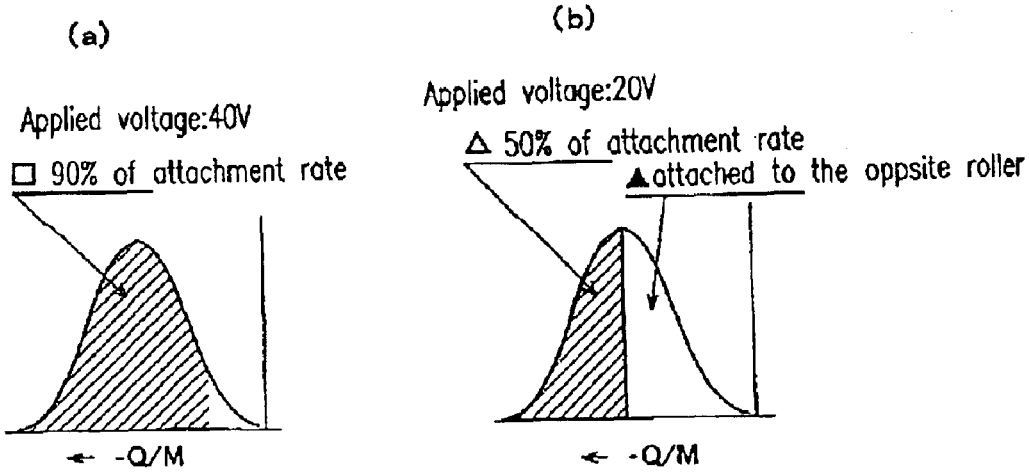
FIG. 22 is an explanatory drawing for further describing the example shown in FIG. 21.

When the bias voltage of 40 V is applied to the opposite roller 2, 90% of the grains of toner having the −Q/M (Quantity of charge/Mass) distribution shown in FIG. 22(*a*) is attached to the opposite roller 2, and the charge of attached grains of toner is about −8.8 to −9.2 ($\mu$C/g), as shown in FIG. 21.

When the bias voltage of 20 V is applied to the opposite roller 2, 50% of the grains of toner having the −Q/M (Quantity of charge/Mass) distribution show in FIG. 22(*b*) is attached to the opposite roller 2, and the charge of attached grains of toner is about −11 ($\mu$C/g), as shown in FIG. 21. The charge of grains of toner remains on the transfer bard 1 is about −8.6 ($\mu$C/g), as shown in FIG. 21.

The charge quantity of grain of toner attached to the opposite roller 2 is measured by a suck-in method.

While raising the bias voltage VB for the opposite roller 2 makes grains of toner having a low Q/M transported and attached to the opposite roller 2, setting a proper bias voltage VB makes possible to classify only the grains of toner having a high Q/M to be transported and attached to the opposite roller 2.

As described above, when the classifier comprises the transfer member having a plurality of electrodes for generating the electric fields for transporting powder while transferring and hopping the powder by an electrostatic force, and the opposite member to which the powder transferred on the transfer member is transported and attached, the opposite member being almost opposite to the transfer member, the powder can be classified accurately and sequentially by the classifier of a simple constitution. In this case, providing the rotary opposite roller as the opposite member simplifies the constitution of the opposite member.

As described in this embodiment, the grains of toner that has been not transported and attached (captured) to the opposite roller 2 and transferred to the end of the transfer board 1 are collected by the collecting electrode 6. The collected grains of toner are then transferred on the recovery member 7 in the reverse direction to be transferred back to the charging means 5, where collected grains of toner are recharged. The recharged grains of toner are sent to the transfer board 1 again, where the opposite roller 2 captures the grains of toner having required quantity of charge and mass again. Therefore, it is possible to obtain grains of toner having almost uniform characteristic in a sequential manner.

Therefore, the powder can be classified accurately and sequentially using the classifier of a simple constitution, in which powder is transported while it is transferred and hopped by an electrostatic force, and the powder is classified by providing a member to which the powder transferred and hopped is transported and attached by an electric field. As described later, it is not necessary that the member for generating the electric field for transport and attachment of powder and the member to which the powder is transported and attached is the same.

As in the case of the first embodiment, the description of the following embodiments are made concerning the classification of negatively charged toner. When positively charged toner is classified, the polarity of bias voltage is set reverse to that for negatively charged toner.

Figure 23:
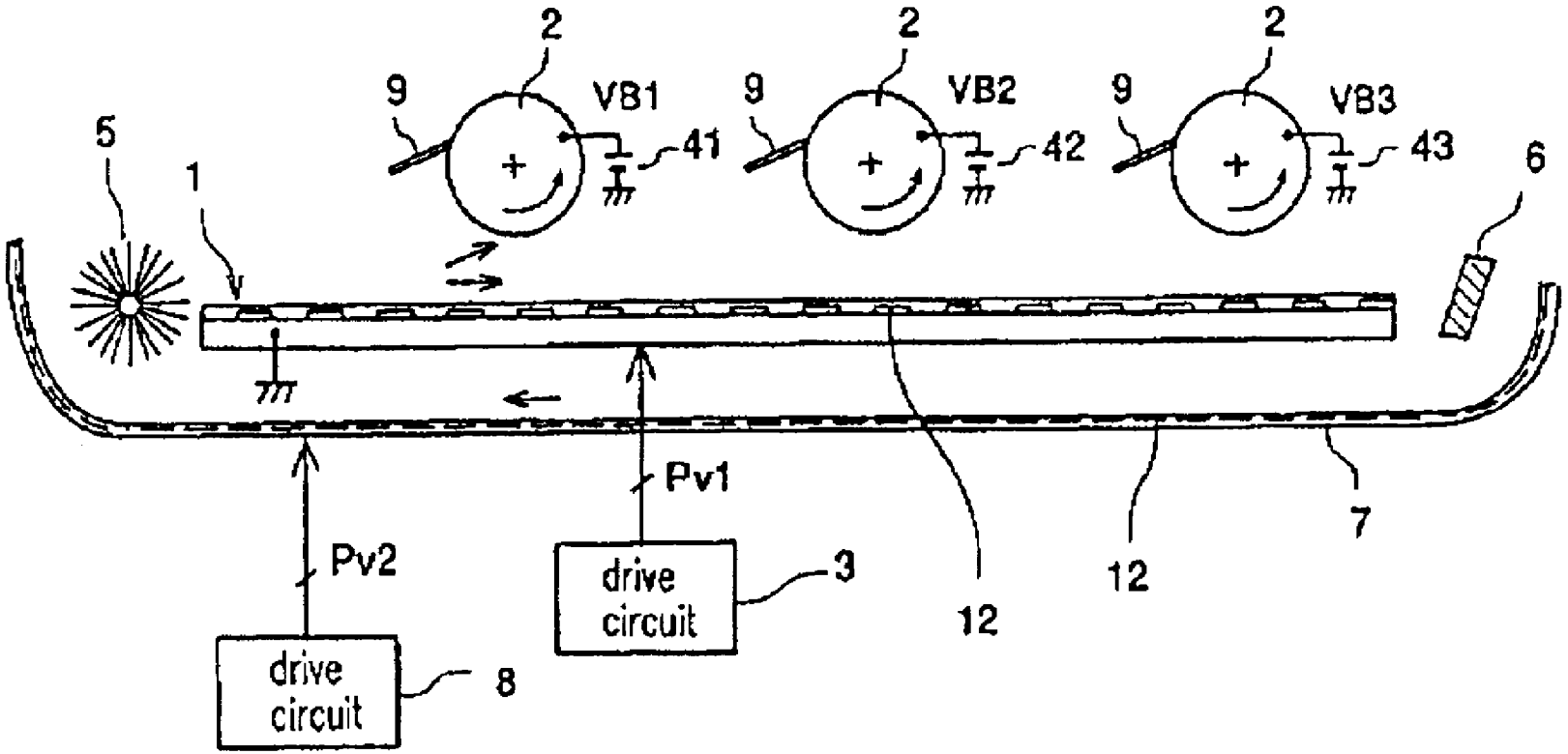
FIG. 23 is a schematic block diagram for explaining the second embodiment of the classifier of this invention.

Next, the second embodiment of the classifier of this invention is described referring to FIG. 23, which is the schematic block diagram of the classifier. In the classifier, three opposite rollers 2,2,2 opposite to the transfer board 1 are arranged in the transfer direction, respectively. A bias voltage VB1 from a bias power source 41 is applied to the opposite roller 2 on the upstream side, a bias voltage VB2 from a bias power source 42 is applied to the opposite roller 2 in the middle, and a bias voltage VB3 from a bias power source 43 is applied to the opposite roller 2 on the downstream side (VB1<VB2<VB3).

With this arrangement, grains of toner having a large quantity of charge per mass (q/m) among the toner transferred on the transfer board 1 are transported and attached to the opposite roller 2 on the upstream side, grains of toner having a middle quantity of charge per mass (q/m) among the toner transferred on the transfer board 1 are transported and attached to the opposite roller 2 on the middle side, and grains of toner having a small quantity of charge per mass (q/m) among the toner transferred on the transfer board 1 are transported and attached to the opposite roller 2 on the downstream side.

Since each opposite roller 2 generates an electric field of different strength, each grains of toner having different quantity of charge per mass (q/m) are transported and attached sequentially to each opposite roller 2 according to the large to small size of quantity of charge per mass (q/m) corresponding to the electric field strength from the upstream to the downstream. As a result, the toner are classified and captured in three steps. (The classification is described as four step process if grains of toner transferred through to the end of the transfer board 1 are included.)

Figure 24:
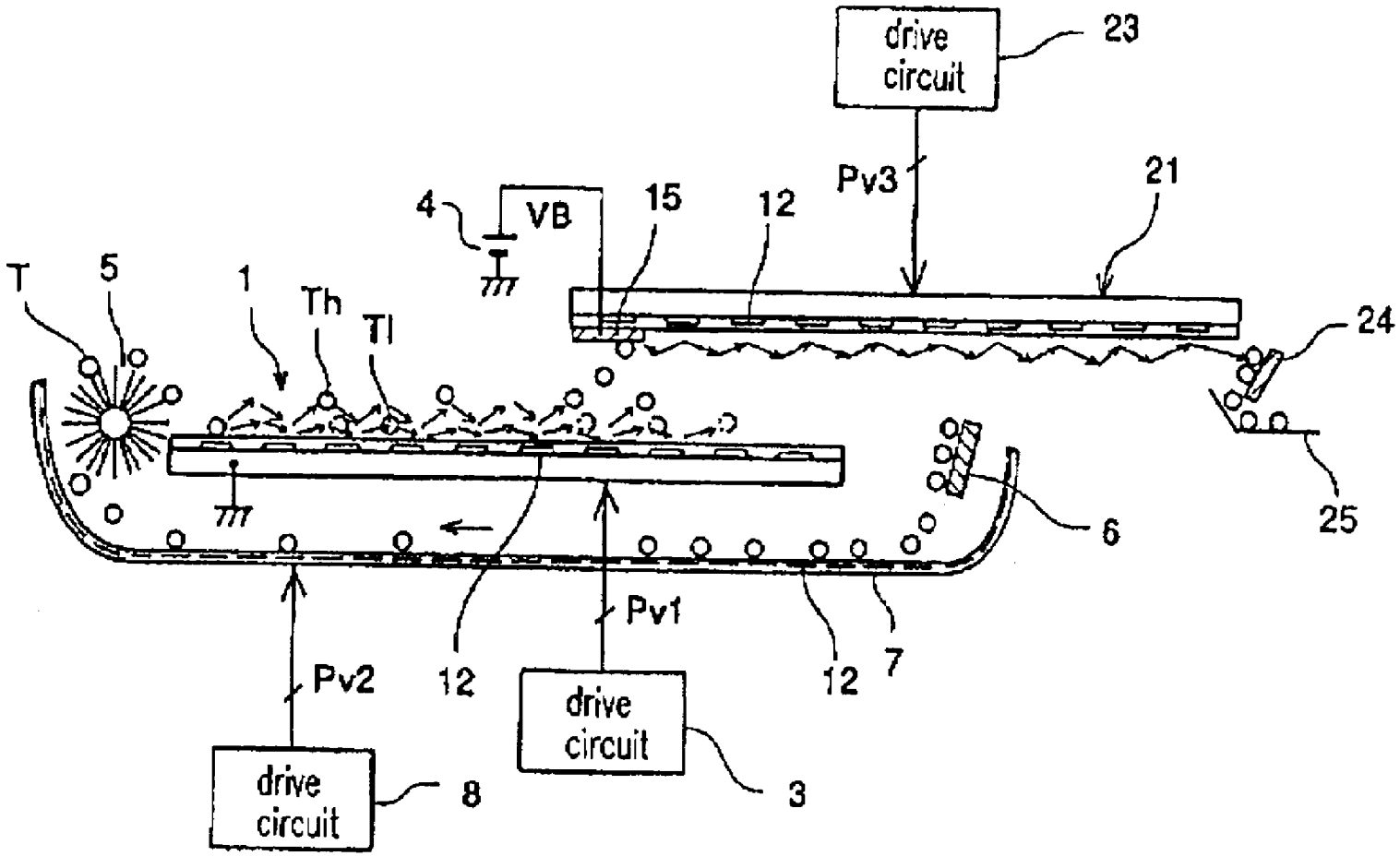
FIG. 24 is a schematic block diagram for explaining the third embodiment of the classifier of this invention.

Next, the third embodiment of the classifier of this invention is described referring to FIG. 24, which is the schematic block diagram of the classifier. The classifier of this embodiment is provided with an opposite transfer board 21, part of whose transfer surface, which is an opposite member, is made almost opposite to the transfer board 1. The constitution of the opposite transfer board 21 is essentially the same as that of the transfer board 1, and the opposite transfer board 21 is provided with a drive circuit 23, which applies drive waveforms Pv3 for generating traveling wave fields to respective electrodes 12 of the opposite transfer board 21. A collecting electrode 24 for collecting part of classified toner and a gutter 25 for taking in the collected toner are arranged on the transfer end of the opposite transfer board 21.

It is desirable that the setting of the drive waveforms (drive voltage) and the spaces between electrodes for the opposite transfer board 21 are made so as to suppress the hopping of toner during the transfer on the opposite transfer board 21 as much as possible.

The opposite transfer board 21 is also provided with a bias electrode 15. This electrode 15 is supplied with a bias voltage for generating an electric field for attracting the toner hopping on the transfer board 1 and transporting it to the opposite transfer board 21. A bias power source 4 applies a bias voltage VB to the bias electrode 15.

In this constitution, among the charged toner T transported while being transferred and hopped on the transfer board 1, grains of the toner T hopping high, having a large quantity of charge, or having a small mass are attracted to the electric field generated by the bias electrode 15 supplied with the voltage from the bias power source 4 of the opposite transfer board 21. The attracted grains of toner T are transported and attached to the opposite transfer board 21, thus classified.

The classified grains of toner T transported and attached to the opposite transfer board 21 are then transferred by the traveling wave fields generated on the opposite transfer board 21 to the collecting electrode 24, and are stored in the gutter 25 (or may be sent to a developing means as described later).

The opposite transfer board 21 comprises the part opposite to the transfer board 1 (the part on which the bias electrode 15 is arranged), which functions as an opposite member, and the part not opposite to the transfer board 1, which functions as a transfer member. Therefore, the opposite member and the transfer member are integrally formed to constitute the opposite transfer board 21, which is a single board. Besides, the support board 11 of the opposite transfer board 21 is made of a flexible board, so that prescribed classified grains of toner can be transferred in a desired direction.

Figure 25:
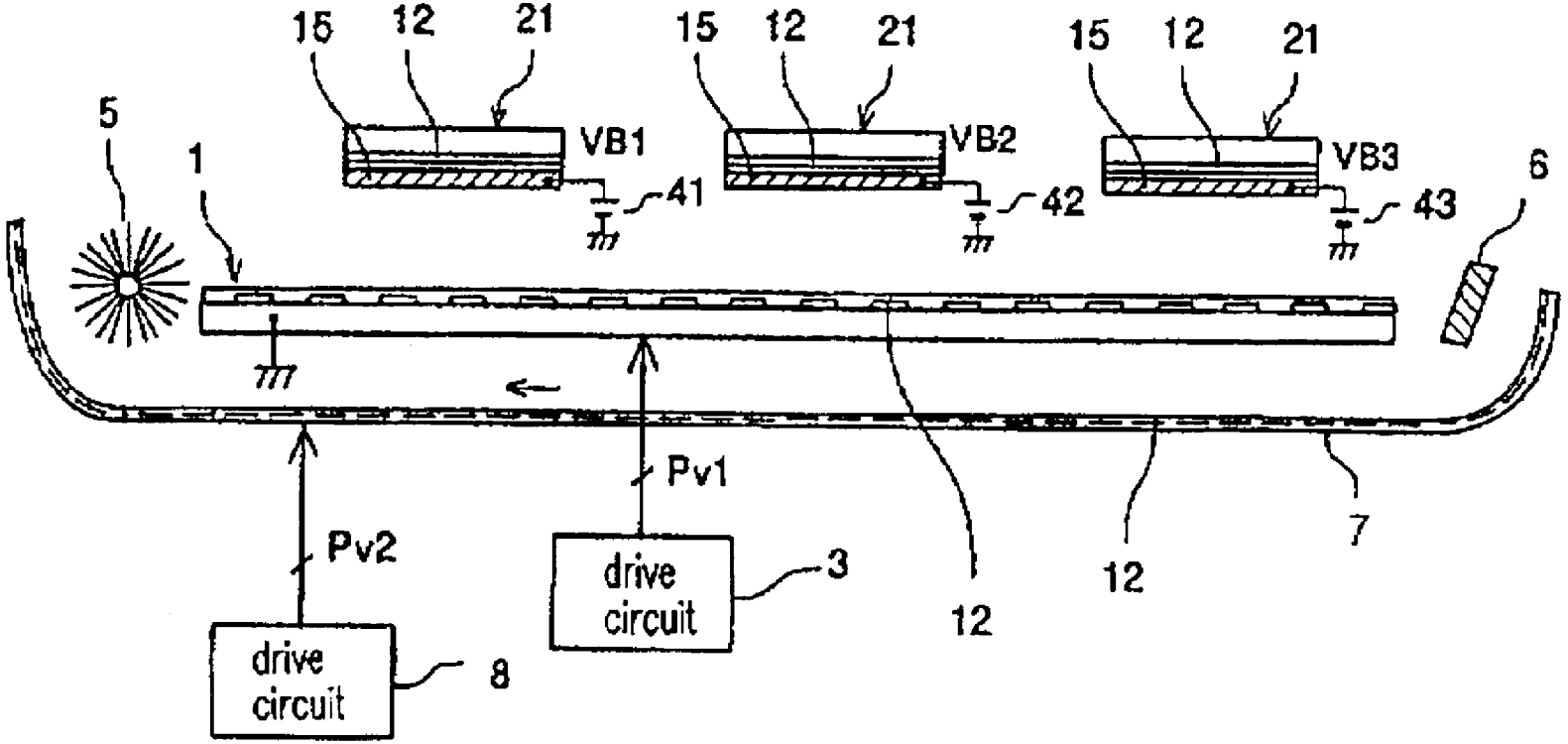
FIG. 25 is a schematic block diagram for explaining the fourth embodiment of the classifier of this invention.

Next, the fourth embodiment of the classifier of this invention is described referring to FIG. 25, which is the schematic block diagram of the classifier of this embodiment. The classifier of this embodiment is provided with three opposite transfer boards 21, 21, 21,which are opposite to the transfer board 1 and arranged in perpendicular to the transfer direction of toner T on the transfer board 1. The bias voltage VB1 from the bias power source 41 is applied to the opposite transfer board 21 on the upstream side, a bias voltage VB2 from a bias power source 42 is applied to the opposite transfer board 21 in the middle, and a bias voltage VB3 from a bias power source 43 is applied to the opposite transfer board 21 on the downstream side (VB1<VB2<VB3).

With this arrangement, grains of toner having a large quantity of charge per mass (q/m) among the toner transferred on the transfer board 1 are transported and attached to the opposite transfer board 21 on the upstream side, grains of toner having a middle quantity of charge per mass (q/m) among the toner transferred on the transfer board 1 are transported and attached to the opposite transfer board 21 on the middle side, and grains of toner having a small quantity of charge per mass (q/m) among the toner transferred on the transfer board 1 are transported and attached to the opposite transfer board 21 on the downstream side.

Since each opposite transfer board 21 generates an electric field of different strength, each grains of toner having different quantity of charge per mass (q/m) are transported and attached sequentially to each opposite transfer board 21 according to the large to small size of quantity of charge per mass (q/m) corresponding to the electric field strength from the upstream to the downstream. As a result, the toner are classified and captured in three steps. Besides, since the opposite transfer boards 21 are arranged in perpendicular to the transfer board 1 in this case, the transfer direction of the classified toner becomes perpendicular to the transfer direction of the transfer board 1.

Figure 26:
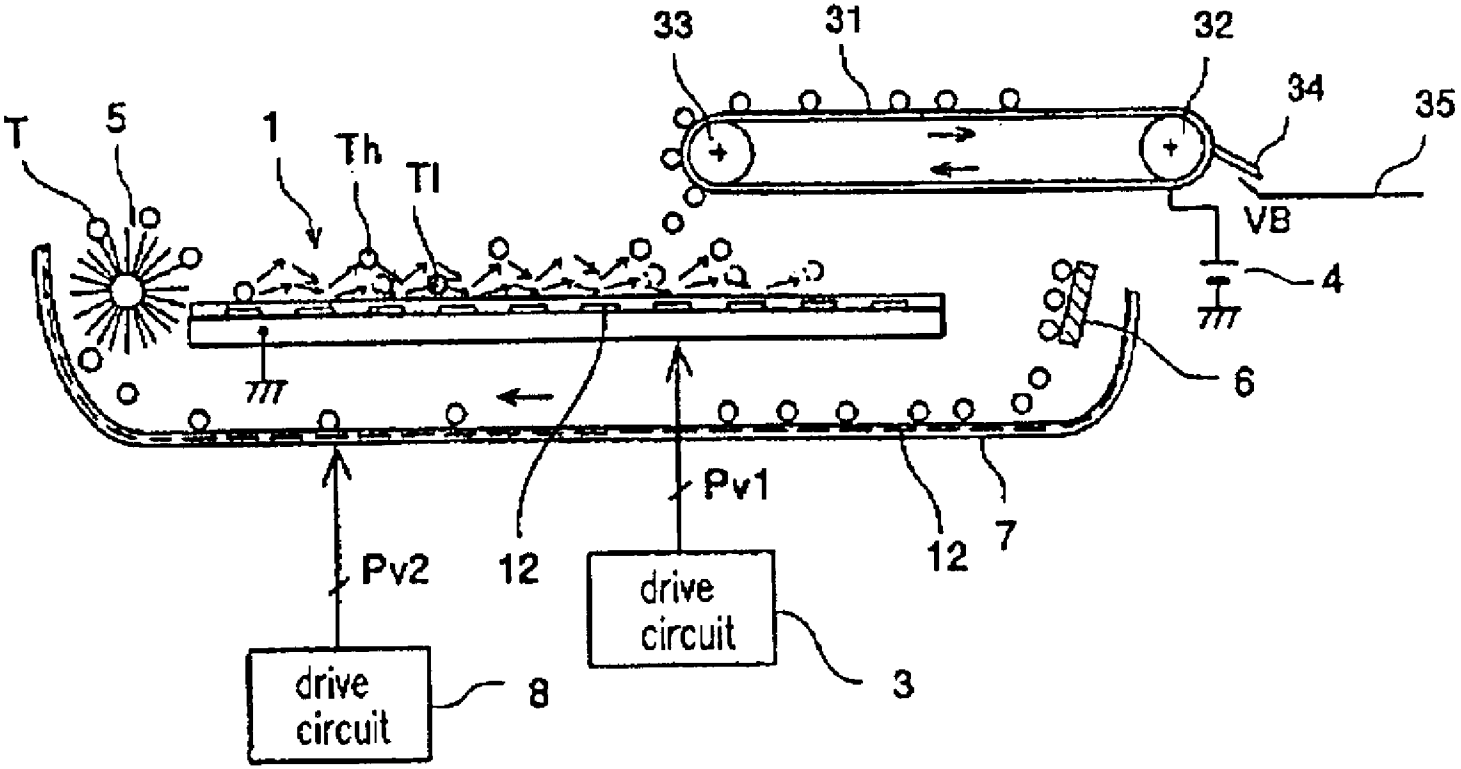
FIG. 26 is a schematic block diagram for explaining the fifth embodiment of the classifier of this invention.

Next, the fifth embodiment of the classifier of this invention is described referring to FIG. 26, which is the schematic block diagram of the classifier of this embodiment. In this classifier, an opposite belt 31 as the opposite member, part of which is opposite to the transfer board 1, is arranged in almost parallel to the transfer board 1. The opposite belt 31 consists of an endless belt, stretched across rotating rollers 32, 33, and is circulated on the rollers in the arrow direction. It is desirable to provide a metal film or a laminated films consisting of an organic film and a metal film on the surface of the opposite belt 31, because a bias voltage is applied to the opposite belt 31.

A bias voltage VB is applied from the bias power source 4 to the opposite belt 31. A blade 34 for separating the toner on the opposite belt 31 and a gutter 35 for storing the toner separated by the blade 34 are arranged near the periphery of the roller 32 of the opposite belt 31.

In this constitution, among the charged toner T transported while being transferred and hopped on the transfer board 1, grains of the toner T which hop high, have a large quantity of charge, or a small mass are attracted to the electric field generated by the bias electrode 15 supplied with the voltage from the bias power source 4 of the opposite belt 31. The attracted grains of toner T are transported and attached to the opposite belt 31, thus classified.

The classified grains of toner T transported and attached to the opposite belt 31 are then transferred on the circulating opposite belt 31 to the blade 34, where attached grains of toner T are separated from the opposite belt 31, and are stored in the gutter 35 (or may be sent to a developing means as described later).

The opposite belt 31 comprises the part opposite to the transfer board 1, which functions as the opposite member, and the part not opposite to the transfer board 1, which functions as the transfer member. Therefore, the opposite member and the transfer member are integrally formed to constitute the opposite belt 3, which is a single member.

In this embodiment, the toner can also be classified in three steps by providing a plurality of opposite belts 31.

Figure 27:
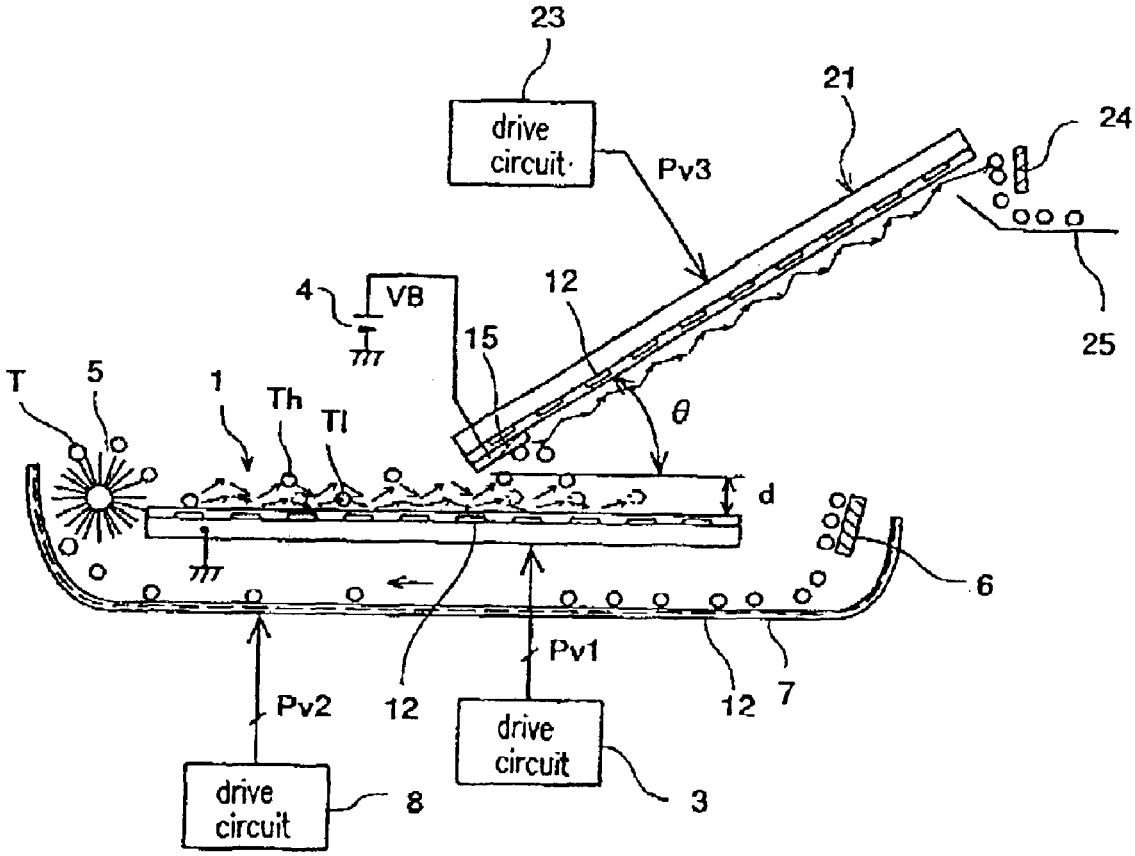
FIG. 27 is a schematic block diagram for explaining the sixth embodiment of the classifier of this invention.

Next, the sixth embodiment of the classifier of this invention is described referring to FIG. 27, which is the schematic block diagram of the classifier of this embodiment. In this classifier, the end part of the transfer surface of the opposite transfer board 21, which is the opposite member, is opposite to the transfer board 1 and the opposite transfer board 21 is inclined against the transfer board 1 at an angle of θ. The most closest distance d between the opposite transfer board 21and the transfer board 1 is set within a range of 0.5 to 100 mm, and the angle θ is made less than 45 degree. However, the values of distance d and the angle θ are not limited to the above range.

In this constitution, among the charged toner T transported while being transferred and hopped on the transfer board 1, grains of the toner T which hop high, have a large quantity of charge, or a small mass are attracted to the electric field generated by the bias electrode 15 supplied with the voltage from the bias power source 4 of the opposite transfer board 21, as in the case of the third embodiment. The attracted grains of toner T are transported and attached to the opposite transfer board 21, thus classified. Then classified grains of toner T are collected by a collecting electrode 24 at the end of the opposite transfer board 21 and are stored in a gutter 25.

The arrangement of this classifier may be changed in such a way that the closest distance d between the transfer surface of the transfer board 1 and the opposite transfer board 21 is changed from 5 to 100 mm, and the angle θ of the opposite transfer board 21 is changed from 0 degree to 45 degree, where the bias voltage VB is also adjusted. When the distance d is small, thin-film-shaped particle groups (groups of grains of the powder) can be captured sequentially with an applied voltage of 20 to 300 V. When the distance d is large, a large amount of thick-film-shaped particle groups (groups of grains of the powder) can be captured sequentially with an applied voltage of 100 to 2000 V.

Figure 28:
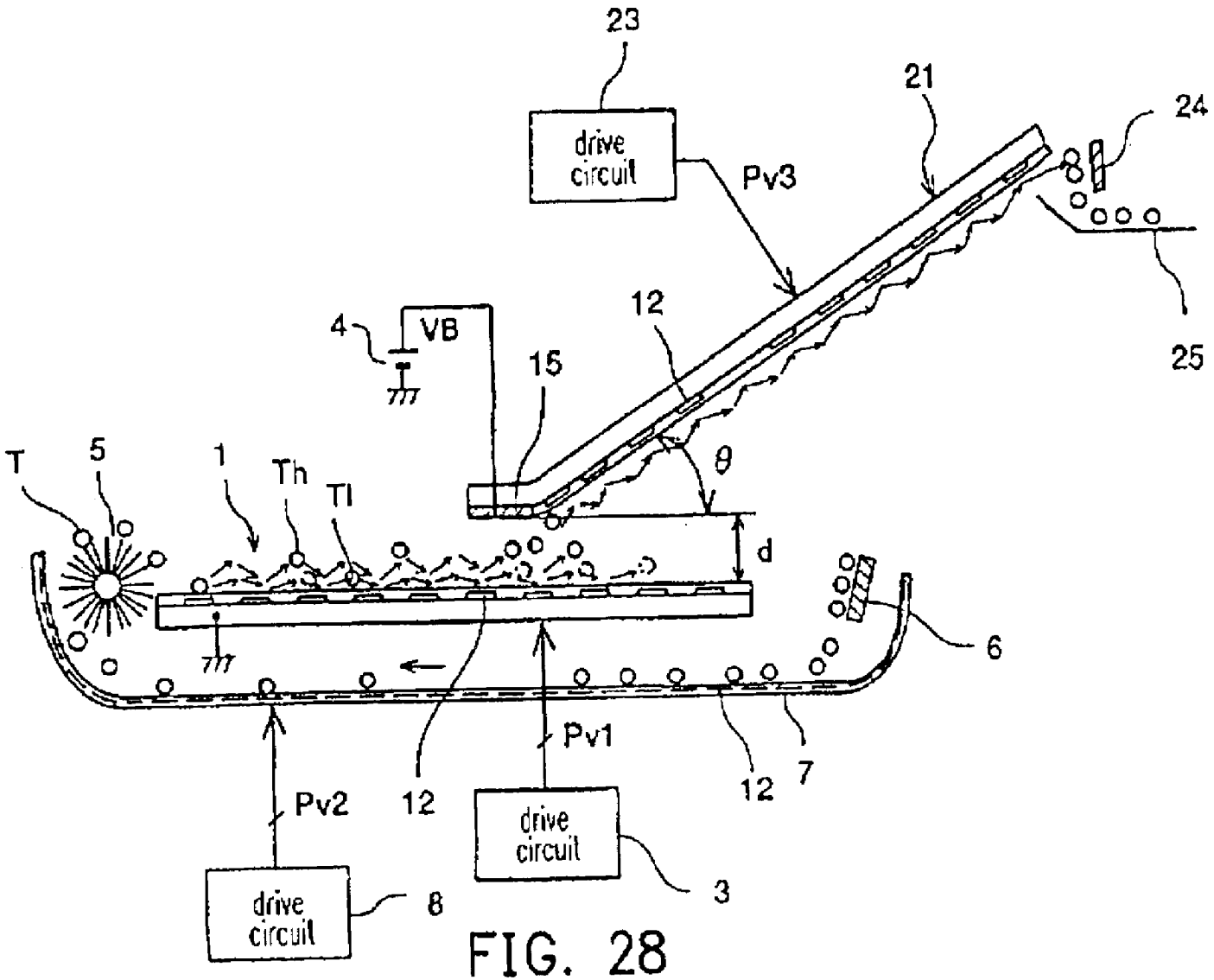
FIG. 28 is a schematic block diagram for explaining the seventh embodiment of the classifier of this invention.

Next, the seventh embodiment of the classifier of this invention is described referring to FIG. 28, which is the schematic block diagram of the classifier of this embodiment. In this classifier, the end part of the opposite transfer board 21 having the bias electrode 15 is the opposite member and is set almost parallel to the transfer board 1, while the other part of the opposite transfer board 21 is inclined against the transfer board 1 at an angle of θ. The most closest distance d between the opposite transfer board 21and the transfer board 1 is set within a range of 0.5 to 100 mm, and the angle θ is made less than 45 degree. However, the values of distance d and the angle θ are not limited to the above range.

The constitution of this embodiment provides the same effect provided by the above sixth embodiment. However, when the whole body of the opposite transfer board 21 is inclined, an edge effect tends to occur on the part of the opposite transfer board 21 most close to the transfer board 1,i.e., an edge, where the grains of toner transported come to concentrate on the edge. In this embodiment, the part to which the grains of toner are transported and attached is arranged in almost parallel to the transfer board 1, so that occurring of the edge effect is prevented.

Figure 29:
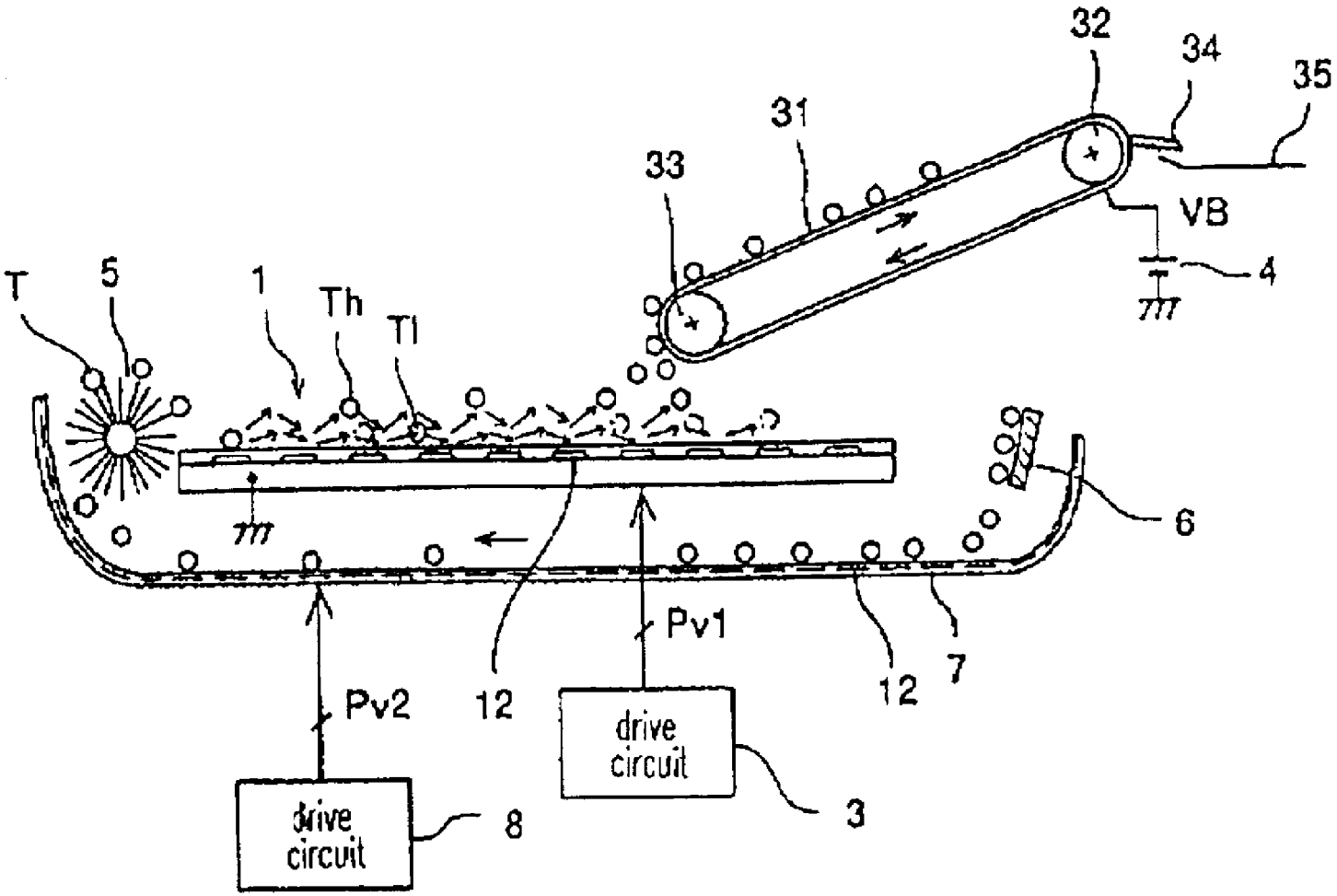
FIG. 29 is a schematic block diagram for explaining the eighth embodiment of the classifier of this invention.

Next, the eighth embodiment of the classifier of this invention is described referring to FIG. 29, which is the schematic block diagram of the classifier of this embodiment. In this classifier, the opposite belt 31 as the opposite member is inclined against the transfer board 1 at an angle of θ. The most closest distance d between the opposite belt 31 and the transfer board 1 is set within a range of 0.5 to 10 mm, and the angle θ is made less than 45 degree. However, the values of distance d and the angle θ are not limited to the above range.

In this constitution, among the charged toner T transported while being transferred and hopped on the transfer board 1, grains of the toner T which hop high, have a large quantity of charge, or a small mass are attracted to the electric field generated by the bias electrode 15 supplied with the voltage from the bias power source 4 of the opposite belt 31, as in the case of the fifth embodiment. The attracted grains of toner T are transported and attached to the opposite belt 31, thus classified. Then classified grains of toner T are separated from the surface of the belt 31 by the blade 34 as the belt 31 circulates and are stored in the gutter 35.

The arrangement of this classifier may be changed in such a way that the closest distance d between the transfer surface of the transfer board 1 and the opposite belt 31 is changed from 5 to 100 mm, and the angle θ of the opposite belt 31 is changed from 0 degree to 45 degree, where the bias voltage VB is also adjusted. When the distance d is small, thin-film-shaped particle groups (groups of grains of the powder) can be captured sequentially with an applied voltage of 20 to 300 V. When the distance d is large, a large amount of thick-film-shaped particle groups (groups of grains of the powder) can be captured sequentially with an applied voltage of 100 to 2000 V.

Figure 30:
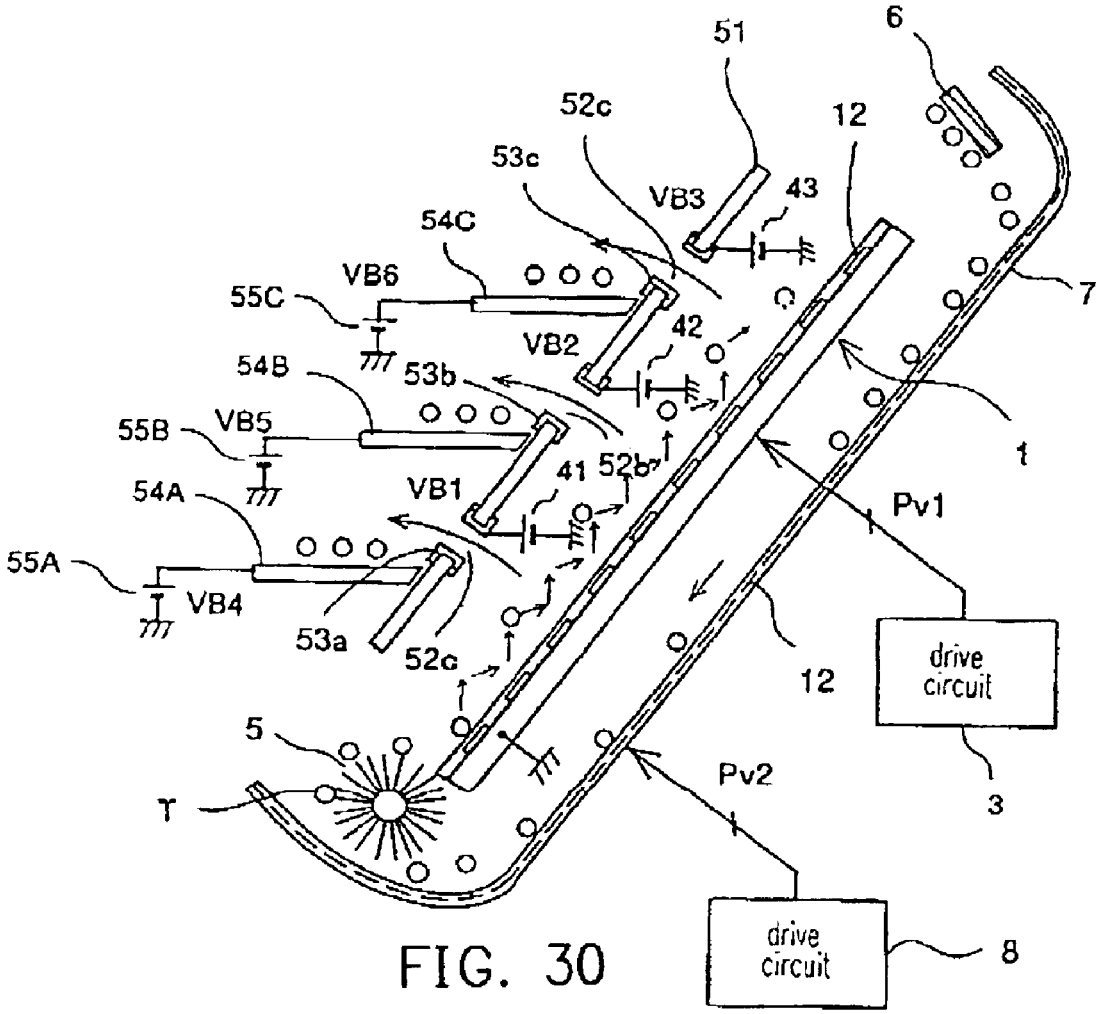
FIG. 30 is a schematic block diagram for explaining the ninth embodiment of the classifier of this invention.

Next, the ninth embodiment of the classifier of this invention is described referring to FIG. 30, which is the schematic block diagram of the classifier of this embodiment. In this classifier, the transfer board 1 is arranged in an inclined position, and a slit member 51 having slit holes 52*a*, 52*b*, 52*c* is set opposite to the transfer board 1. The slit holes 52*a*, 52*b*, 52*c* are provided with bias electrodes consisting of metal film 53*a*, 53*b*, 53*c*, respectively. Each bias voltage VB1, VB2, VB3 from respective bias power source 41, 42, 43 is applied to bias electrodes 53*a*, 53*b*, 53*c*, respectively.

Each slit hole 52*a*, 52*b*, 52*c* is provided with a corresponding gutter 54*a*, 54*b*, 54*c*, to which bias voltage VB4, VB5, VB6, which is higher than the bias voltage VB1, VB2, VB3, respectively, from bias power source 55A, 55B, 55C is applied The charged grains of toner T transported while they are hopped and transferred on the transfer board 1 are attracted to electric fields generated by the bias voltage VB1, VB2, VB3 according to each quantity of charge or mass, and are transported toward the slit hole 52*a*, 52*b*, 52*c*. As the grains of toner T approach the slit holes 52*a*, 52*b*, 52*c*, the bias fields of the gutters 54*a*, 54*b*, 54*c* act on the grains of toner T, making them pass through the slit holes 52*a*, 52*b*, 52*c* to be captured by the gutters 54*a*, 54*b*, 54*c*. In this case, the opposite member for generating the electric fields for the transport and attachment of the grains of toner T on the transfer board 1 is the slit member 51, but the grains of toner T are actually transported and attached to the gutters 54*a*, 54*b*, 54*c*. Therefore, the member for generating the electric fields for the transport and attachment of the toner and the member to which the toner is actually transported and attached is different in this embodiment. As a member to which the toner is transported and attached, a belt, roller, an electrostatic transfer board or the like may be employed, instead of a gutter, for facilitating the transfer of the toner.

In this embodiment, the toner transferred on the transfer board 1 can be classified in three steps as in the case of the second or the fourth embodiment.

Figure 31:
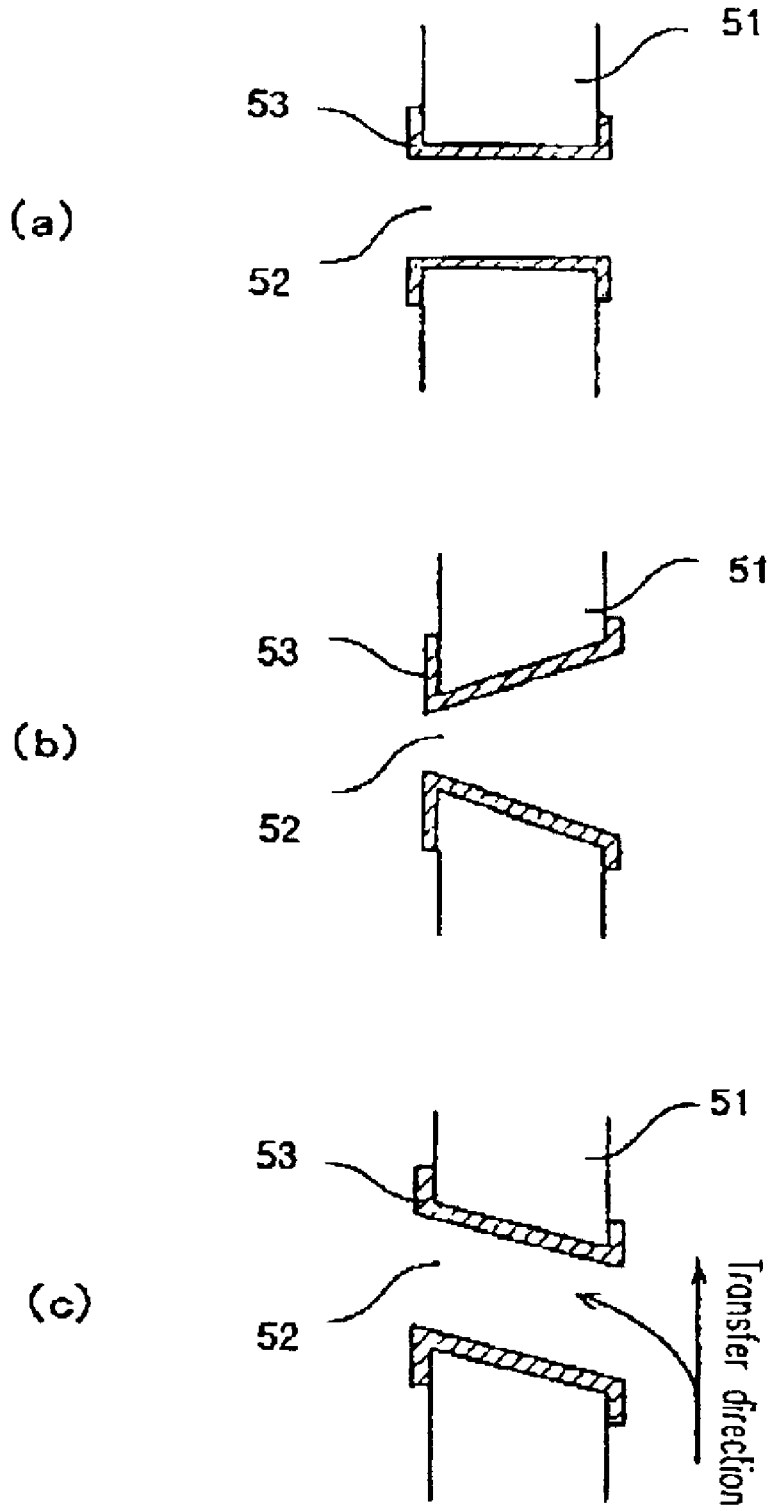
FIG. 31 is an explanatory drawing for describing the different shapes of the slit holes and electrodes employed in the ninth embodiment of the classifier.

As shown in FIG. 31, the slit holes and bias electrodes of the slit member 51 can be formed into various shapes, which are shown in FIG. 31. For example, as shown in FIG. 31(*a*), a slit hole 52 is square-shaped, and a bias electrode 53 is formed on the inner surface of the slit hole 52. FIG. 31(*b*) shows a tapered slit hole 52, where the bias electrode 53 is formed on the inner surface of the slit hole 52. FIG. 31(*c*) shows a slit hole 52 slant in the transfer direction of the toner, where the bias electrode 53 is formed on the inner surface of the slit hole 52.

Figure 32:
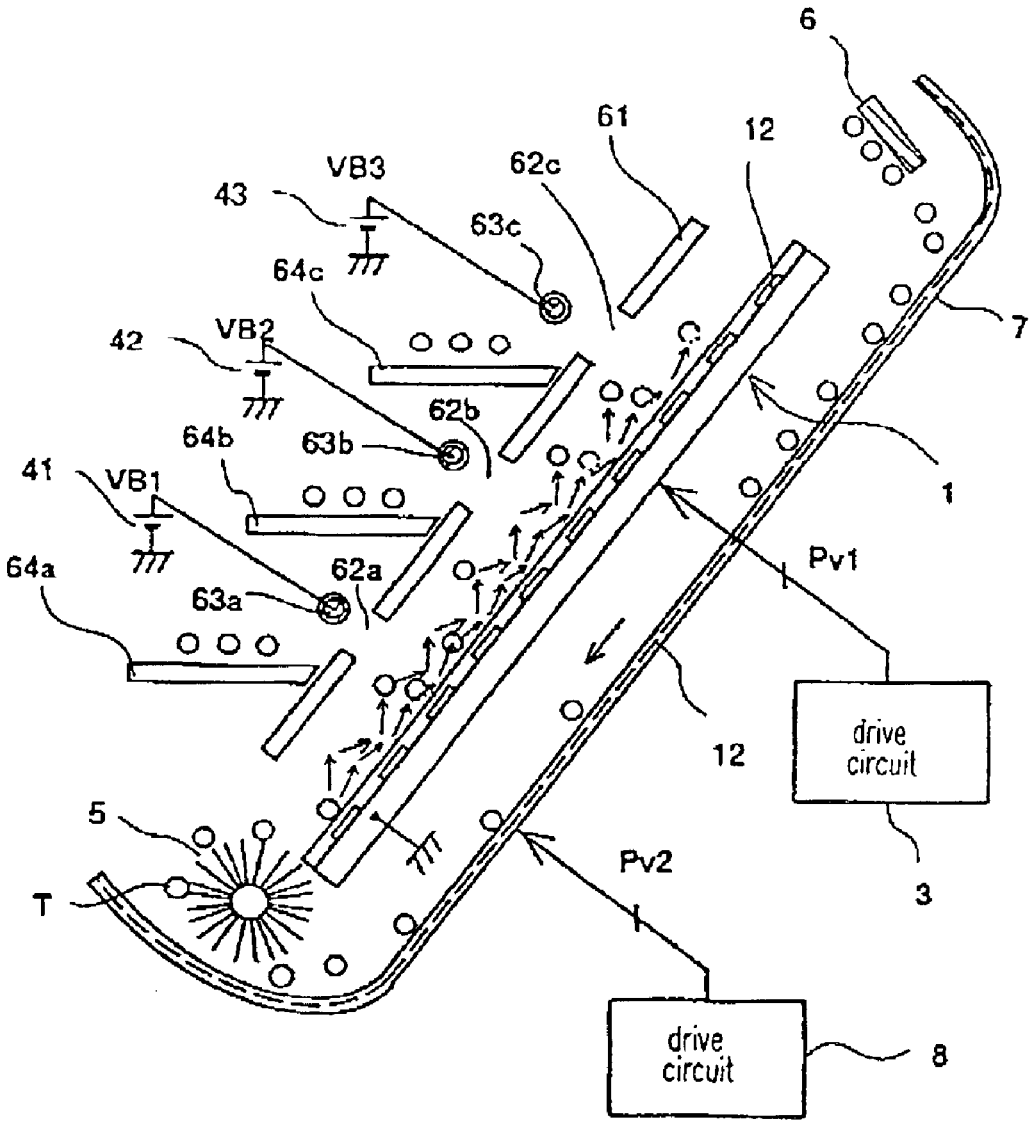
FIG. 32 is a schematic block diagram for explaining the tenth embodiment of the classifier of this invention.

Next, the tenth embodiment of the classifier of this invention is described referring to FIG. 32, which is the schematic block diagram of the classifier of this embodiment. In this classifier, the transfer board 1 is arranged in an inclined position, and a slit member 61 having slit holes 62*a*, 62*b*, 62*c* is set opposite to the transfer board 1. On the outside of the slit member 61, electrode wires 63*a*, 63*b*, 63*c* are arranged as the opposite member to the transfer member 1, where the electrode wires 63*a*, 63*b*, 63*c* correspond to the slit holes 62*a*, 62*b*, 62*c*, respectively. The bias voltage VB1, VB2, VB3 from the bias power source 41, 42, 43 is applied to each electrode wires 63*a*, 63*b*, 63*c*. It will be appreciated that, in this specification, the term "electrode wire" represents not only line electrode wires, but also includes bar-shaped one (electrode bars), and the section of "electrode wire" is not limited to circular-shape, but also includes ellipse-shape and square-shape.

Figure 33:
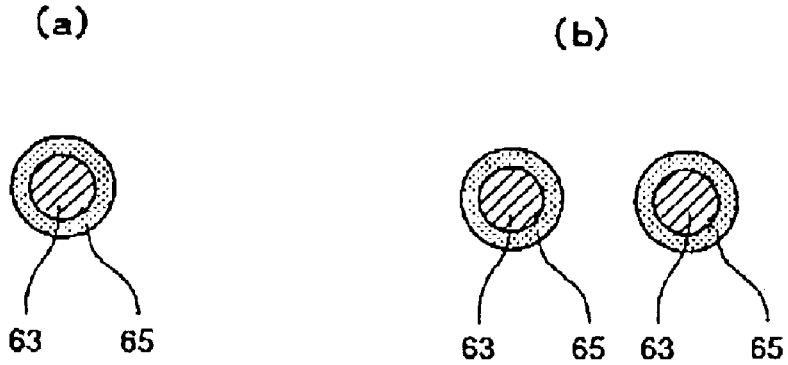
FIG. 33 is an explanatory drawing for describing the constitution of the electrode wires in the tenth embodiment and another example of the same.

The electrode wire 63 may be provided as a single wire, as shown in FIG. 33(*a*), or two or more than three of a plurality of wires, as shown in FIG. 33(*b*). The outer periphery of the electrode wire 63 is sheathed with an insulating protective film 65, whose thickness is, for example, 5 to 20 μm. The insulating protective film 65 prevents a change of the quantity of charge of the toner occurring when it sticks to the electrode wire 63.

By providing the insulating protective film 65 on the surface of the electrode wire 63, the charge given to the powder is controlled according to the conductivity, semiconductivity, or insulating property of the powder. When the powder comes in contact with the board or the electrode wire 63 for attracting the powder and causes a contact charge or a friction charge, a proper material of the protective film is selected to match the charge order of powder with that of the protective film. In this manner, the charge characteristics and the quantity of charge of powder can be controlled.

As a material forming the insulating protective film 65, when the charge polarity of toner is negative, it is desirable to use a material positioned near the material of the charge control agent (if the area for transfer and hoping is small) in the order in the friction charge series, or a material positioned on the positive side in the friction charge series. For example, when the charge control agent is a salicylic acid metal complex, it is desirable to use a polyamide 66, polyamide 11, $SiO_2$ and the like.

When the charge polarity of toner is positive, it is desirable to use a material positioned near the material of the charge control agency (if the area for transfer and hoping is small) in the order in the friction charge series, or a material positioned on the negative side in the friction charge series. For example, when the charge control agent is a fourth ammonium salt class, it is desirable to use a material near the fourth ammonium salt class in the friction charge series or Teflon (registered trademark) material, such as fluorine.

The classifier of this embodiment is also provided with gutters 64*a*, 64*b*, 64*c* for storing captured toner, gutters 64*a*, 64*b*, 64*c* corresponding to the electrode wires 63*a*, 63*b*, 63*c*.

The charged grains of toner T transported while they are hopped and transferred on the transfer board 1 are attracted to electric fields generated by the bias voltage VB1, VB2, VB3 applied to the electrode wires 63*a*, 63*b*, 63*c* according to each quantity of charge or mass, and are transported toward the slit holes 62*a*, 62*b*, 62*c*, then pass them through to stick to the electrode wires 63*a*, 63*b*, 63*c*, and finally stored in the gutter 54*a*, 54*b*, 54*c*.

Therefore, in this embodiment, the toner transferred on the transfer board 1 can be classified in three steps as in the case of the second or the fourth embodiment.

Figure 34:
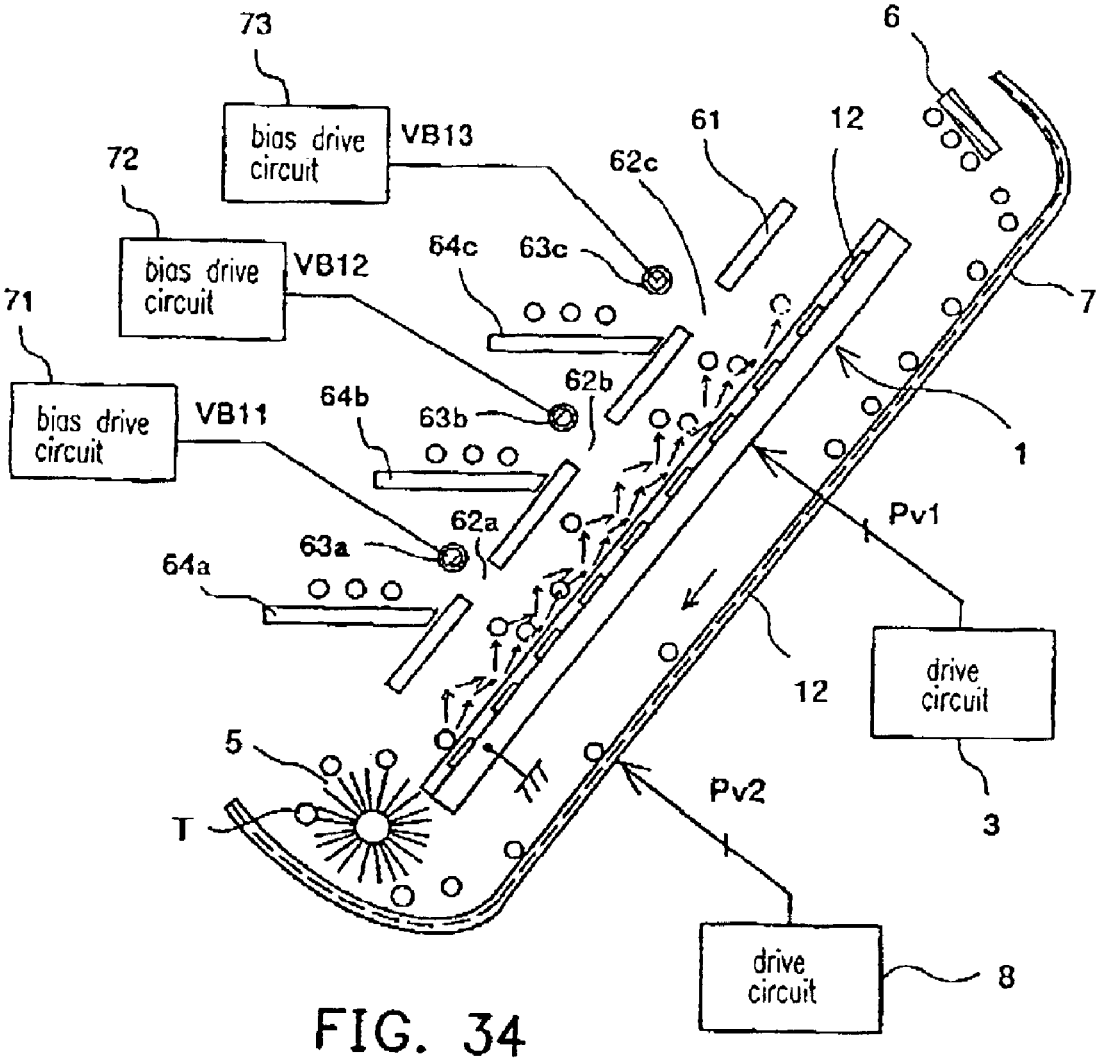
FIG. 34 is a schematic block diagram for explaining the eleventh embodiment of the classifier of this invention.

Next, the eleventh embodiment of the classifier of this invention is described referring to FIG. 34, which is the schematic block diagram of the classifier of this embodiment. In this classifier, as in the case of the tenth embodiment, the transfer board 1 is arranged in an inclined position, and a slit member 61 having slit holes 62*a*, 62*b*, 62*c* is set opposite to the transfer board 1. On the outside of the slit member 61, electrode wires 63*a*, 63*b*, 63*c* are arranged as the opposite member to the transfer member 1, where the electrode wires 63*a*, 63*b*, 63*c* correspond to the slit holes 62*a*, 62*b*, 62*c*, respectively. Each bias voltage VB11, VB12 and VB13 from bias drive circuits 71, 72, 73 is applied to each electrode wire 63*a*, 63*b* and 63*c*.

Figure 35:
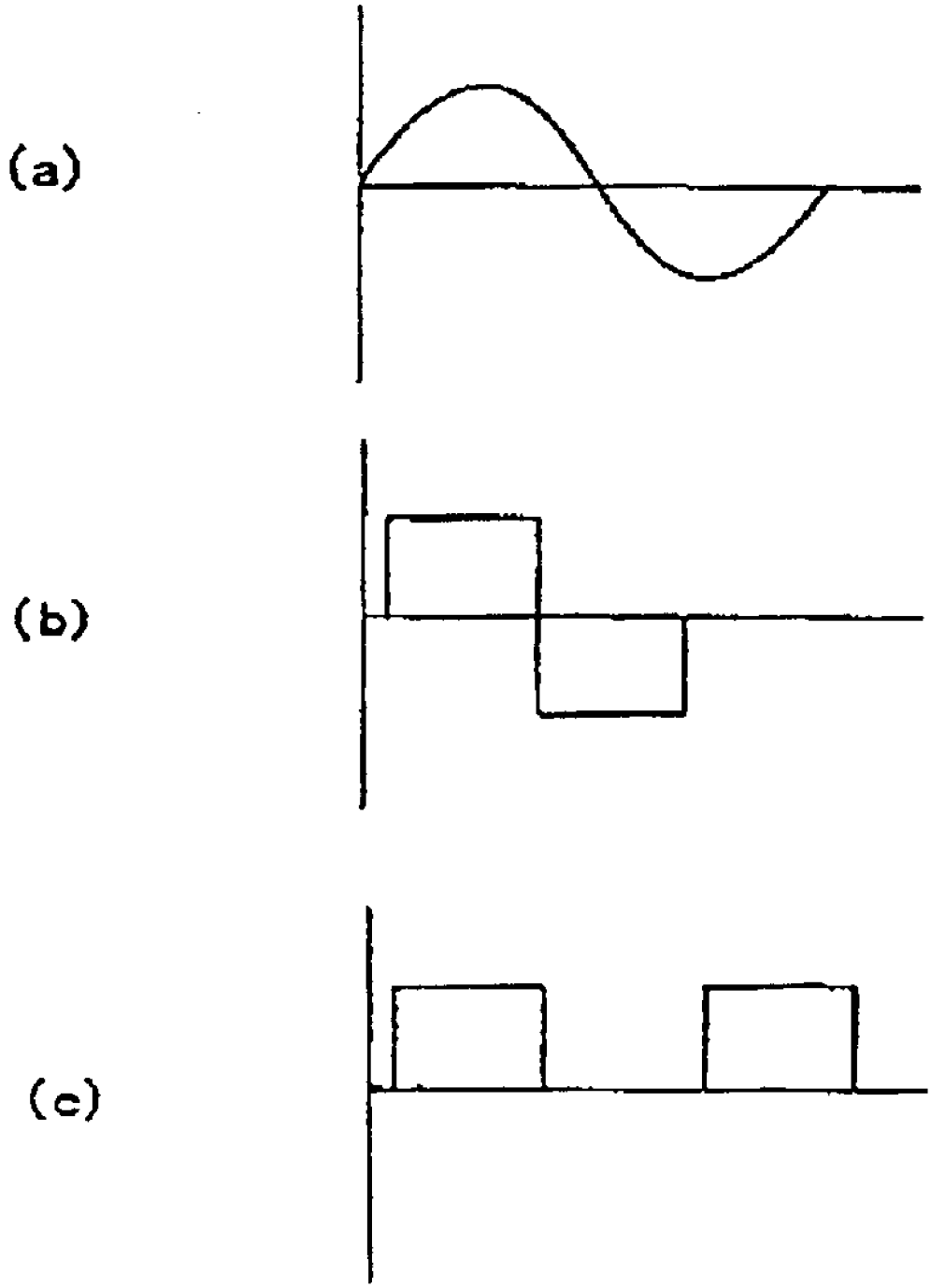
FIG. 35 is an explanatory drawing showing different examples of the drive waveforms generated through the bias drive circuits in the eleventh embodiment.

The electrode wire 63 (63*a*, 63*b*, 63*c*) may be provided as a single wire, or two or more than three of a plurality of wires, as described before. The outer periphery of the electrode wire 63 is sheathed with the insulating protective film 65 made of a selected material having a proper charge order. The drive waveforms the bias drive circuits 71, 72, 73 applied to the electrode wires 63*a*, 63*b*, 63*c* are sine waves, as shown in FIG. 35(*a*), bipolar pulse waves, as shown in FIG. 35(*b*), or unipolar pulse waves, as shown in FIG. 35(*c*), where each drive waveform applied to each electrode is all the same.

As in the case of the tenth embodiment, the charged grains of toner T transported while they are hopped and transferred on the transfer board 1 are attracted to electric fields generated by the bias voltage VB1, VB2, VB3 applied to the electrode wires 63*a*, 63*b*, 63*c* according to each quantity of charge or mass, and are transported toward the slit holes 62*a*, 62*b*, 62*c*, then pass them through to stick to the electrode wires 63*a*, 63*b*, 63*c*, and finally stored in gutters 64*a*, 64*b*, 64*c*.

As described before, since the drive waveforms of sine waves, bipolar waves, or unipolar waves from the bias drive circuits 71, 72, 73 are applied to the electrode wires 63*a*, 63*b*, 63*c*, there are moments that the bias voltage is not applied to the electrode wires 63*a*, 63*b*, 63*c*. Upon cutting off of the bias voltage on the electrode wires 63*a*, 63*b*, 63*c*, the electric fields disappear, causing the toner sticking to the electrode wires 63*a*, 63*b*, 63*c* to drop by its own weight.

Therefore, the constitution provided in this embodiment requires no means for dropping the toner sticking to electrode wires 63*a*, 63*b*, 63*c*, such as forced vibration of the electrode wires 63*a*, 63*b*, 63*c*, which is required for the tenth embodiment. Thus, a simpler constitution of the classifier is provided in this embodiment.

Figure 36:
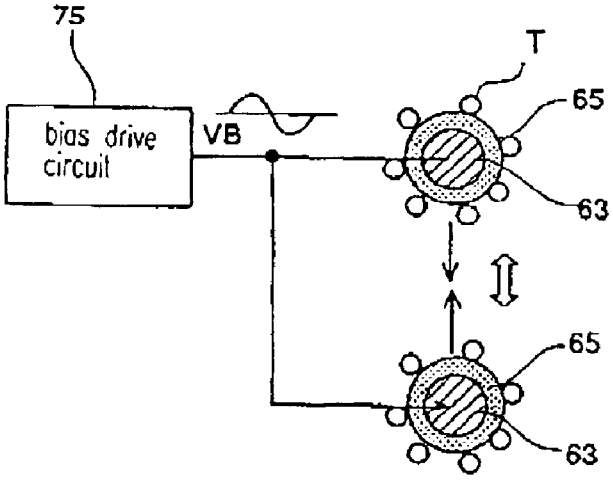
FIG. 36 is an important element on large scale for explaining the twelfth embodiment of the classifier of this invention.

Next, the twelfth embodiment of the classifier of this invention is described referring to FIG. 36, which is the schematic block diagram of an important element of the classifier of this embodiment. In this classifier, two electrodes wires 63, 63 spaced apart at a prescribed gap are provide for each slit hole 62*a*, 62*b*, and 62*c* in the constitution of eleventh embodiment. A bias drive circuit 74 applies a bias voltage VB of sine wave drive waveforms to the electrodes wires 63, 63.

Two electrodes wires 63, 63 repeatedly attract and repel each other as the sine wave drive waveforms are applied, thus vibrate. The vibration shakes off the toner sticking to electrodes wires 63, so that it becomes possible to remove the toner sticking to electrodes wires 63 by arranging a simply constituted element.

Figure 37:
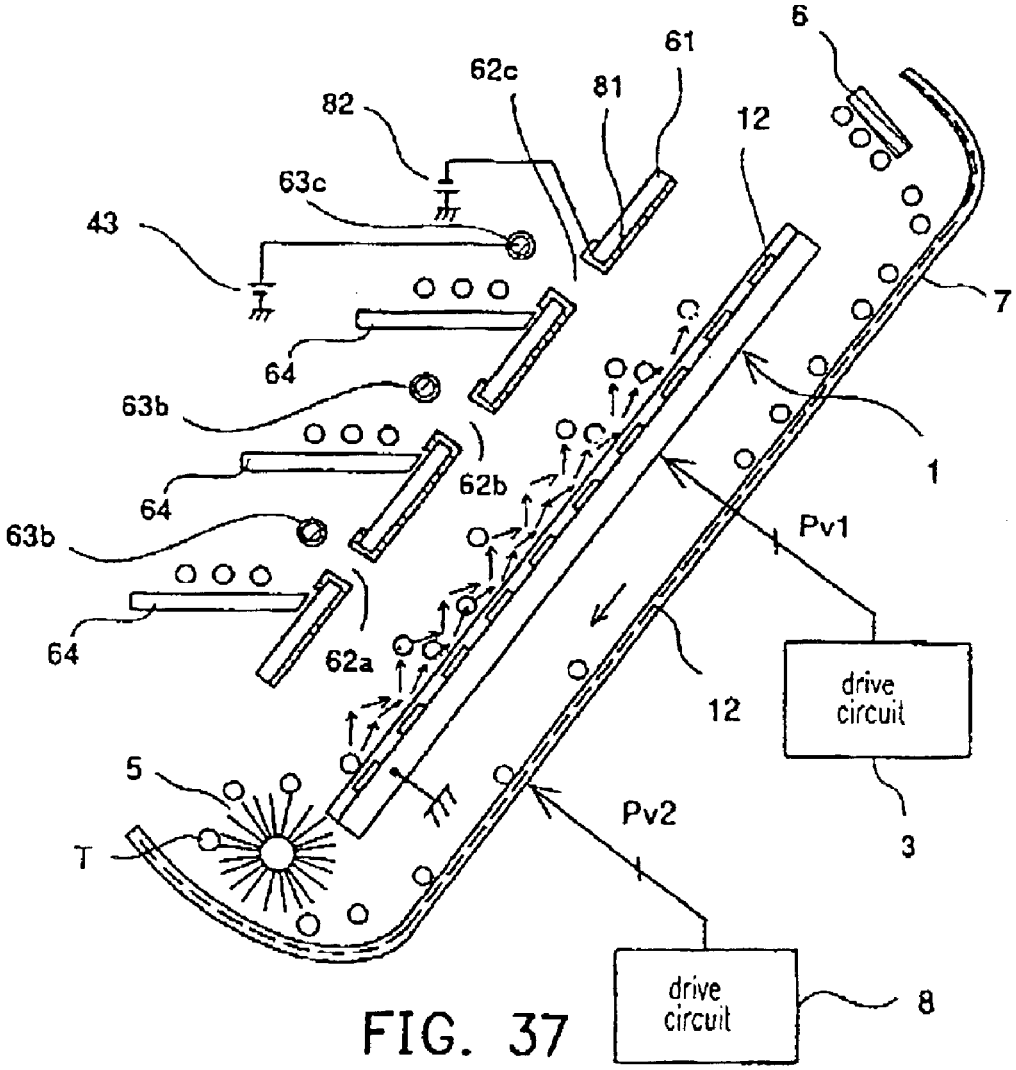
FIG. 37 is a schematic block diagram for explaining the thirteenth embodiment of the classifier of this invention.
Figure 38:
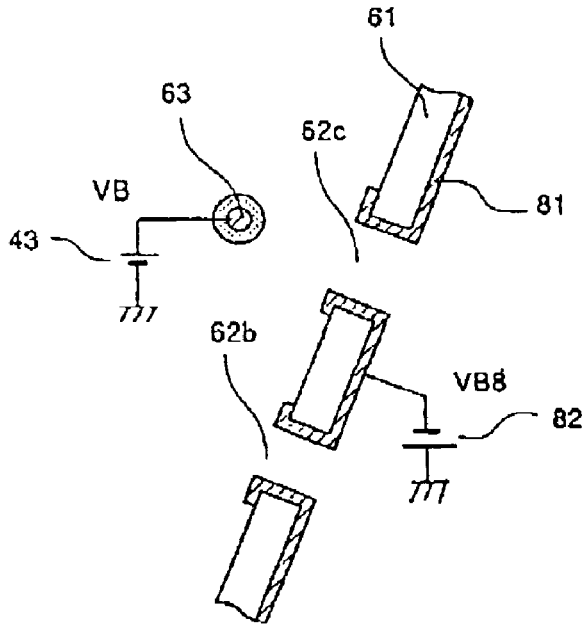
FIG. 38 is an enlarged detail of FIG. 37.

Next, the thirteenth embodiment of the classifier of this invention is described referring to FIGS. 37 and 38, where FIG. 37 is the schematic block diagram of the classifier of this embodiment and FIG. 38 is the enlarged detail of FIG. 37. The drawings of bias power sources for respective electrodes and the like are partially omitted.

In the classifier of this embodiment using the constitution of the tenth embodiment, each slit hole 62*a*, 62*b*, and 62*c* is covered with a metal films 81, which is provided with a bias power source 82 applying a bias voltage VB8 having the same polarity as charge polarity of the toner to be classified (which is negative, so the bias voltage is negative), as shown in FIG. 38. The electric field generated by the bas voltage VB8 is made weaker than the electric fields by the electrode wires 63.

The bias voltage VB8 prevents the negatively charged toner, which passes through the slit holes 62*a*, 62*b*, 62*c* as it is attracted by the electric fields generated by the electrode wires 63, from sticking to the walls of the slit holes 62*a*, 62*b*, 62*c* or to the surface of the slit member 1 opposite to the transfer board 1. Therefore, it is possible to prevent the decrease of the transport efficiency of powder due to the deposition or attachment of classified powder on the slit or the opposite surface. It is also possible to prevent the deterioration of the residence characteristic of the grains of powder which occurs when the grains of powder are left on the board for a long time.

Figure 39:
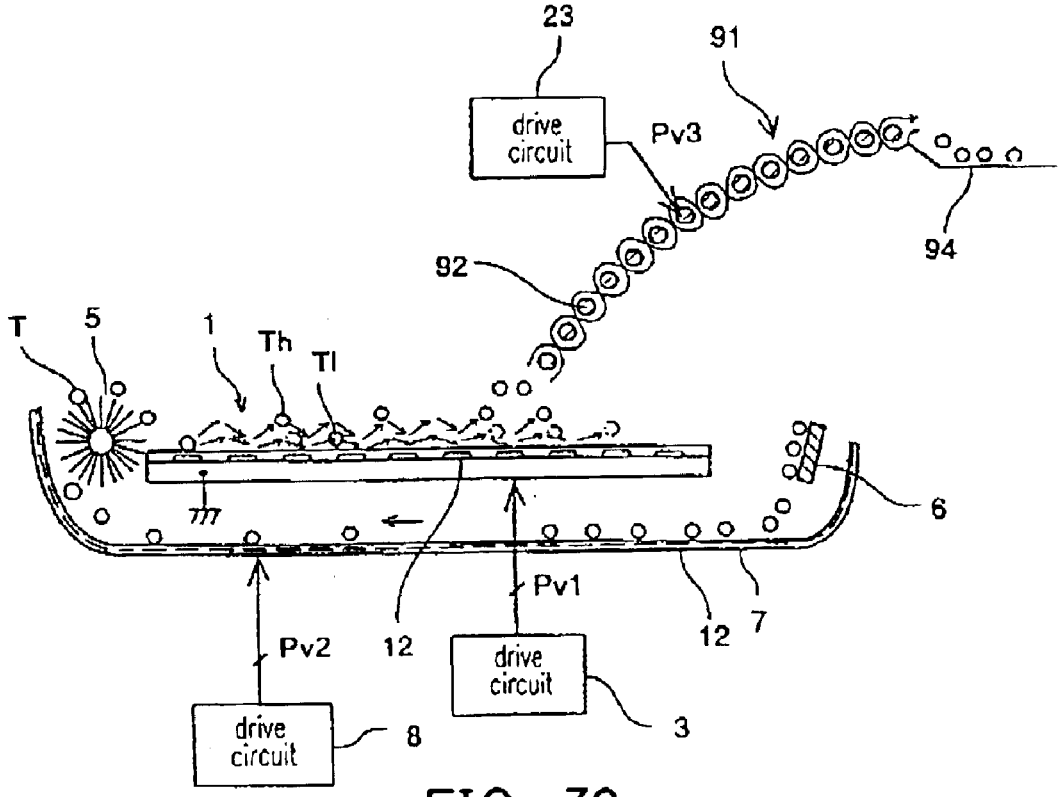
FIG. 39 is a schematic block diagram for explaining the fourteenth embodiment of the classifier of this invention.
Figure 40:
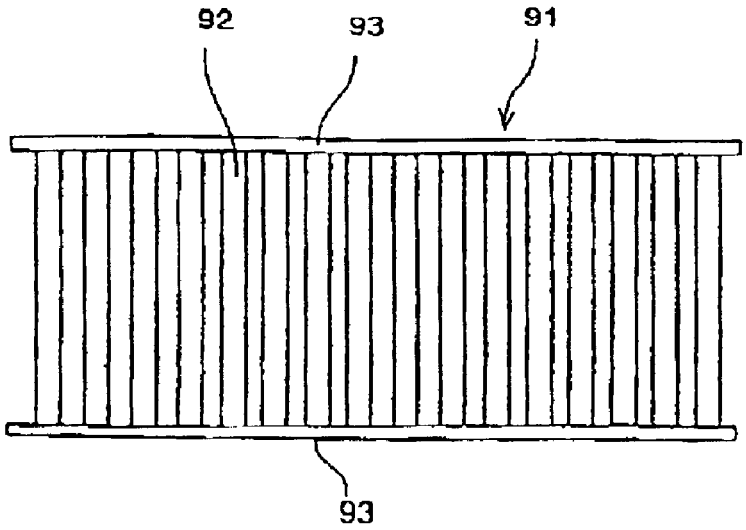
FIG. 40 is a plain view showing the electrode wire line member in the fourteenth embodiment.

Next, the fourteenth embodiment of the classifier of this invention is described referring to FIGS. 39 and 40, where FIG. 39 is the schematic block diagram of the classifier of this embodiment and FIG. 40 is the plain view of the electrode wire lines shown in FIG. 38.

In this embodiment, the electrode wire line member 91 is provided as the opposite member generating the electric fields for transporting and attaching the toner on the transfer board 1 to the electrode wire line member 91. As shown in FIG. 40, the electrode wire line member 91 comprises a number of electrode wires 92 (including the electrode wire 63 and the insulating protective film 65) held by a flexible holding frame member 93, which makes possible to deform the electrode wire line member 91 into a desired shape, such as linear shape or curved shape.

One or a plurality of electrode wires 92 on the end of the electrode wire line member 91 are made to be the opposite member opposite to the transfer board 1, and the other electrode wires 92 are used as a transfer means. In this case, n-phase drive waveforms Pv3 are applied to each electrode wire 92 of electrode wire line member 91 to generate traveling wave fields on the surface of the electrode wires 92, which forms the transfer part (transfer means).

The electrode wires 92 of the electrode wire line member 91 form a line of electrode wires set in a space, on which drive phase-shafting fields are formed around every electrode wire enabling a transfer of a large amount of the powder. It is desirable to apply the n-phase drive waveforms Pv3 for transferring the powder, mainly toner, to each electrode wire 92 of the electrode wire line member 91.

With this arrangement, the charged grains of toner T transported while they are hopped and transferred on the transfer board 1 are attracted to electric fields generated by the one or a plurality of electrode wires 92 of the electrode wire line member 91 opposed to the transfer board 1, according to each quantity of charge or mass, and are transported and attached to the electrode wires 92 of the electrode wire line member 91. The attached grains of toner T are transferred by the traveling wave fields generated by the electrode wire line member 91, reaching the end of it, and are stored in a gutter 94.

In this embodiment, the transfer course of classified toner can be arranged more freely and the transfer volume of toner can be increased by using the electrode wire line.

Figure 41:
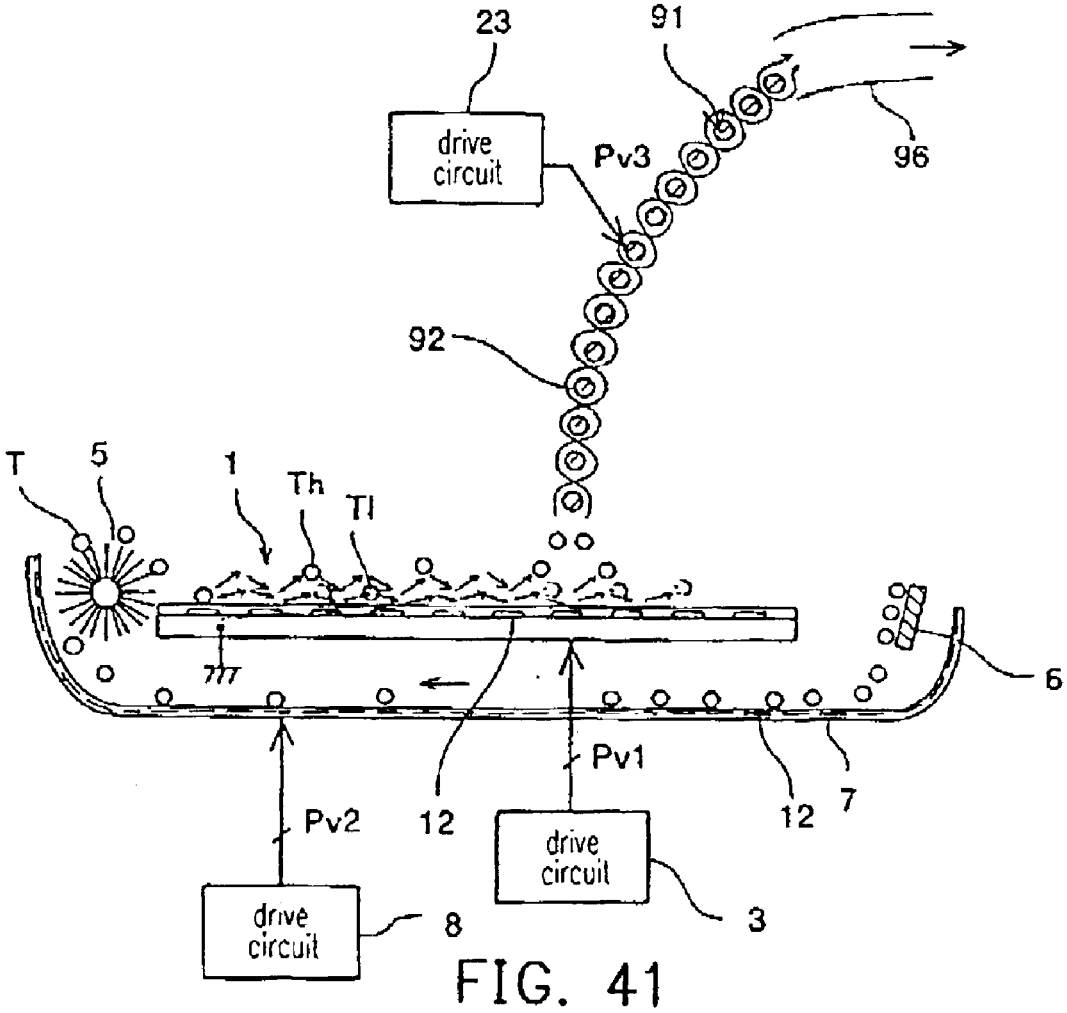
FIG. 41 is a schematic block diagram for explaining the fifteenth embodiment of the classifier of this invention.

Next, the fifteenth embodiment of the classifier of this invention is described referring to FIG. 41, which is the schematic block diagram of the classifier of this embodiment. The classifier of this embodiment is provided with the electrode wire line member 91 of the fourteenth embodiment, and a suction duct 96 is arranged at the end of the electrode wire line member 91. The suction duct 96 sucks in the classified toner transferred by the traveling wave fields generated by the electrode wires 92 of the electrode wire line member 91 to transport the toner to a prescribed place.

In this embodiment, using the electrode wire line enables a more freer arrangement of the transfer course of toner and increase the transfer volume of toner, as in the case of the fourteenth embodiment. With these advantages, the classifier of this embodiment can also be utilized for a manufacturing process of toner.

Figure 42:
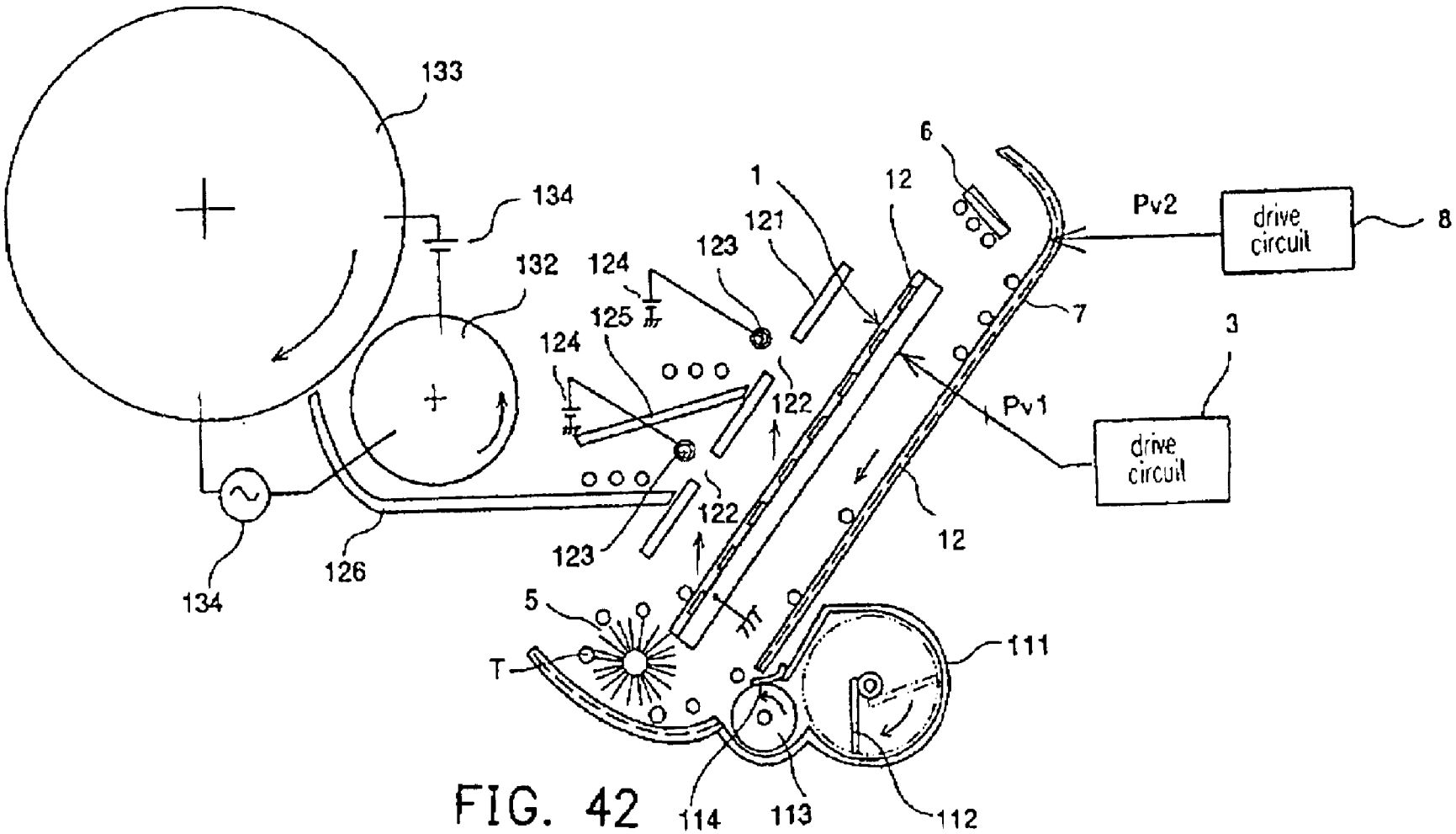
FIG. 42 is a schematic block diagram for explaining the first embodiment of the developer of this invention.

Next, the first embodiment of the developer of this invention including the classifier is described referring to FIG. 42, which is the schematic block diagram of the developer of this embodiment. In this developer, classified almost uniform grains of toner are attached to an electrostatic latent image formed on a photosensitive drum 131, which is a latent image carrier, for development. The photosensitive drum 131 may be substituted with a belt-shape photosensitive body in this embodiment as well as the following embodiments.

The developer comprises a toner hopper 111 for storing toner supplied from a toner bottle and the like arranged outside, an agitator 12 for agitating the toner in the toner hopper 111, a toner supply/recovery member 113, a charging roller 113 for charging the toner in the toner hopper 111 and sending them into a toner supply member 7*a*, and a doctor blade 114 set in contact with the periphery of charging roller 113. The developer further includes a recovery member 7 consisting of a recovery member 7*a*, i.e., the toner supply member 7*a*, and a sending member 7*b* for sending the toner to the charging means 5, both of which are supplied with drive waveforms applied by the drive circuit 8.

A slit member 121 having a plurality of slit holes 122, similar to that of the tenth embodiment, is arranged in opposite to the transfer board 1. Electrode wires 123 sheathed with a insulating protective film are arranged in opposite to transfer board 1 and corresponding to each slit hole 122, where each electrode wire 123 generates an electric field for transporting and attaching the classified toner. The same bias voltage VB from a bias power source 124 is applied to each electrode wire 123 so as to classify the grains of toner having almost same characteristics from the toner hopping and being transferred on the transfer board 1.

Toner guide members 125 each corresponding to each electrode wire 123 are provided. The captured grains of toner are guided with the guide members 125 to join on a toner guide members 126, from which the captured grains of toner are supplied to a developing roller 132 that is a developing means for attaching the toner to an electrostatic latent image formed on the photosensitive drum 131, which is the latent image carrier. An AC voltage from an AC power source 133 and DC voltage from a DC power source 132 are applied across the photosensitive drum 131 and the developing roller 132 so as to make the toner jump from the developing roller 132 to the photosensitive drum 131 to develop the latent image.

The toner guide member 126 comprises a board similar to the transfer board 1, which makes possible to send the toner to the developing roller 132 without fail.

With the constitution described above, it becomes possible to classify charged grains of toner having a large q/m and supply them to the developing roller 132. As a result, the uniformity of the toner for development is enhanced, so that the quality of development is improved, thus the quality of images is improved. Besides, the grains of toner having small q/m are not captured or classified and are discharged from the transfer board 1, then sent back again to the charging means 5 through the recovery means 5 and are recharged. As a result, it is possible to make grains of toner having a large q/m captured in a stable manner.

Since a plurality of electrode wires 123 (may be more than three), which is the opposite member for generating electric fields for classification, are provided in the developer of this embodiment, it is possible to compensate a short supply of the toner to the developing roller, so that the decrease of developing speed can be prevented substantially.

Figure 43:
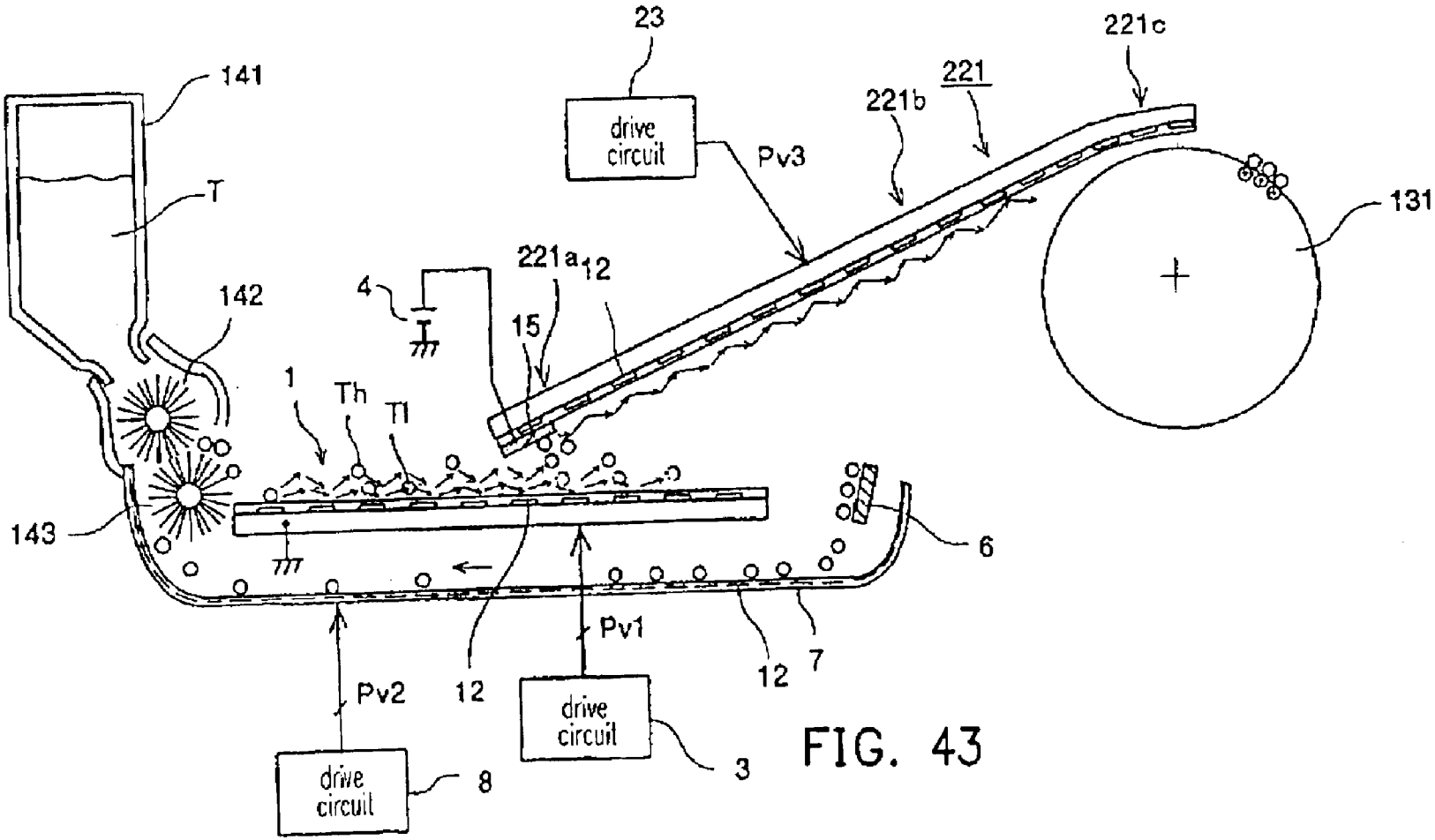
FIG. 43 is a schematic block diagram for explaining the second embodiment of the developer of this invention.

Next, the second embodiment of the developer of this invention including the classifier is described referring to FIG. 43, which is the schematic block diagram of the developer of this embodiment. In this developer, toner is classified into almost uniform grains of toner using a classifier almost the same one of the sixth embodiment. The classified toner is attached to an electrostatic latent image on the photosensitive drum 131, which is the latent image carrier, to develop the image.

In the developer of this embodiment, the toner T is fed from a toner tank 141 to charging brushes 142, 143, which are in contact with each other and rotate, causing friction to charge the toner, which is then sent to the transfer board 1 to which an opposite transfer board 221 is arranged in an inclined position. The opposite transfer board 221 comprises a classifying part 221*a* having the bias electrode 15, to which the bias voltage VB is applied and the grains of toner having required characteristics are transported and attached, as in the case of the sixth embodiment, a transfer part 221*b* for transferring the attached grains of toner by the traveling wave fields generated by the electrodes 12, and a developing part 221*c* for hopping and transferring the toner near the photosensitive drum 131, wherein the classifying part 221*a*, the transfer part 221*b*, and the developing part 221*c* are integrally formed. Therefore, the opposite transfer board 221, which is the opposite means, also functions as the developing means.

With the constitution described above, it becomes possible to classify charged grains of toner having a large q/m and supply them to the developing part of the opposite transfer board 221. As a result, the uniformity of the toner for development is enhanced, so that the quality of development is improved, thus the quality of images is improved. Besides, the grains of toner having small q/m are not captured or classified and are discharged from the transfer board 1, then sent back again to the charging brush 143 and the like through the recovery means 7 and are recharged. As a result, it is possible to make grains of toner having a large q/m captured in a stable manner. The developing operation utilizing the electrostatic transfer including hopping phenomenon is described in detail later.

The constitution of the developer of this embodiment is made simple by carrying out classifying of the toner, supplying of the toner to the developing part, and hopping of the toner on the developing part using the opposite transfer board only.

Figure 44:
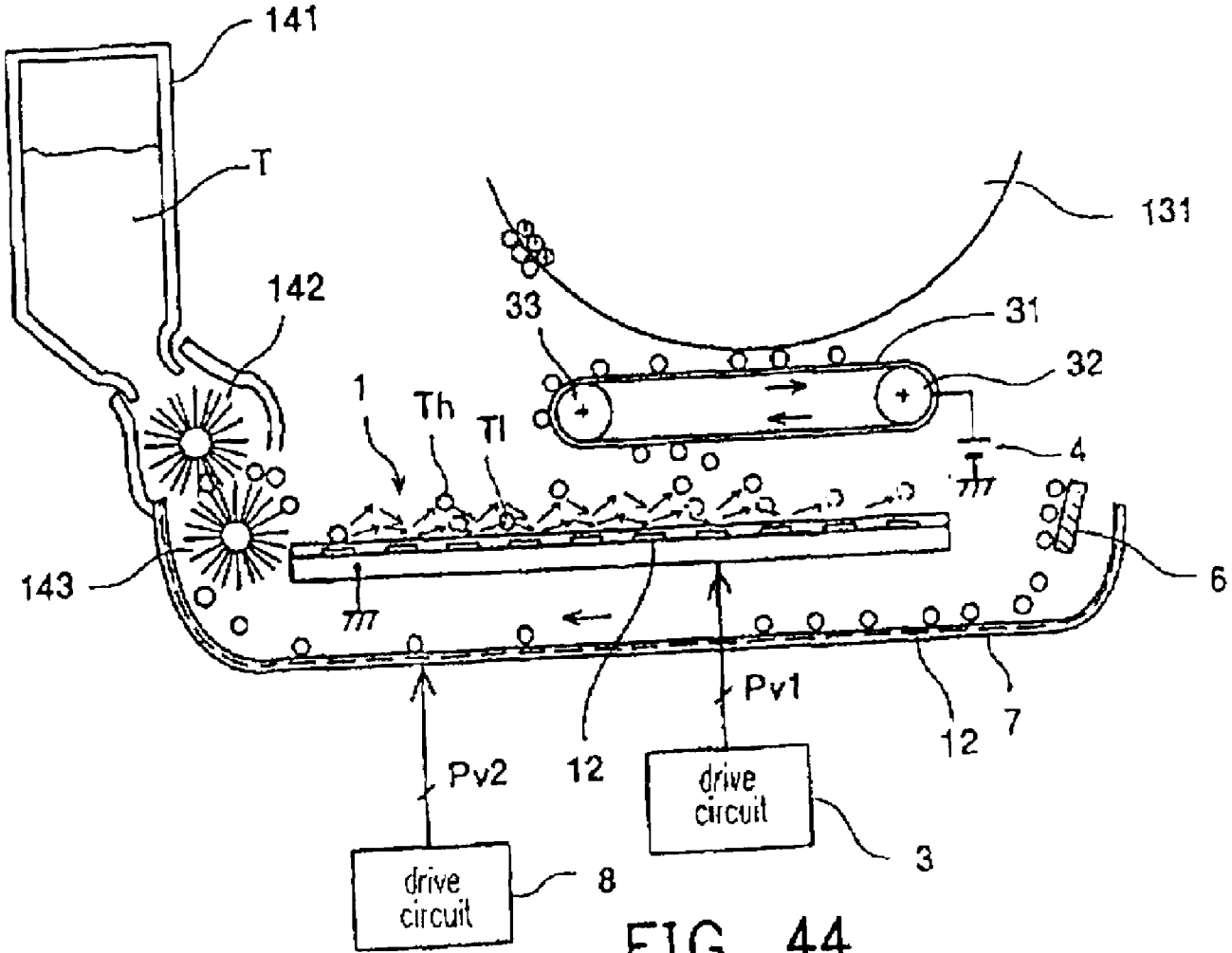
FIG. 44 is a schematic block diagram for explaining the third embodiment of the developer of this invention.

Next, the third embodiment of the developer of this invention including the classifier is described referring to FIG. 44, which is the schematic block diagram of the developer of this embodiment. In this developer, toner is classified into almost uniform grains of toner using a classifier almost the same one of the fifth embodiment. The classified toner is attached to an electrostatic latent image on the photosensitive drum 131, which is the latent image carrier, to develop the image.

In this developer, the grains of toner having required characteristics transferred and attached to the opposite belt 31 from the toner transferred and hopped on the transfer board 1. The attached grains of toner are then sent to the developing part opposite to the photosensitive drum 131 via the circulation of the opposite belt 31, where the toner on the opposite belt 31 attached to a latent image part by an electric field from the electrostatic latent image. This development is a result of the contact between the opposite belt 31 and the photosensitive drum 131, that is, the opposite belt 31, which is the opposite means, also functions as the developing means. Though the developer of this embodiment is not provided with the blade 34, as different from the case of the fifth embodiment, the blade 34 may be provided to drop the grains of toner that has been not used for development to the collecting electrode 6 so that they are recycled.

With the constitution described above, it becomes also possible for the developer of this embodiment to classify charged grains of toner having a large q/m and supply them from the opposite belt 31 to the developing part. As a result, the uniformity of the toner for development is enhanced, so that the quality of development is improved, thus the quality of images is improved. Besides, the grains of toner having small q/m are not captured or classified and are discharged from the transfer board 1, then sent back again to the charging brush 143 and the like through the recovery member 7 and are recharged. Thus, it is possible to make grains of toner having a large q/m captured and used for development in a stable manner.

Figure 45:
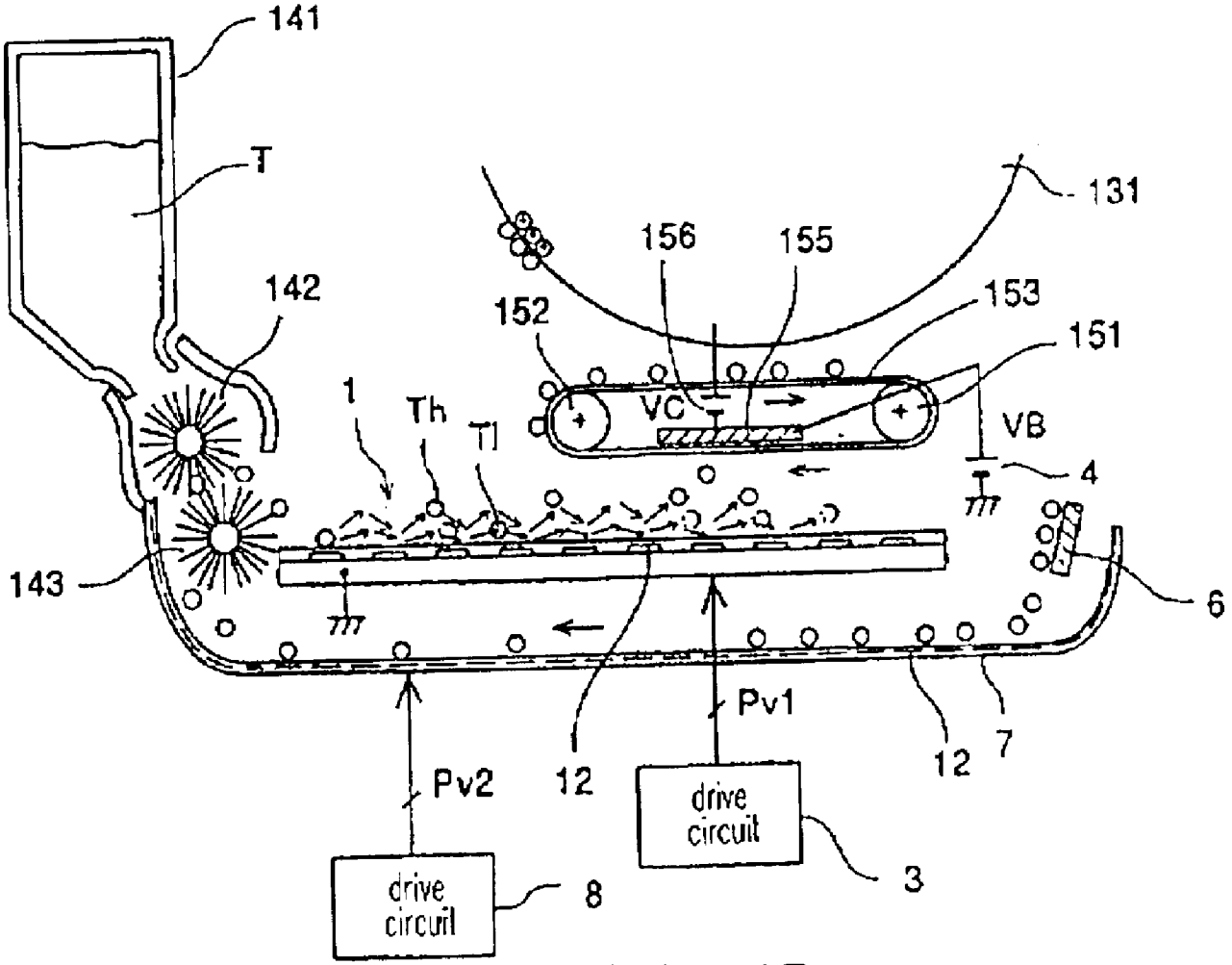
FIG. 45 is a schematic block diagram for explaining the fourth embodiment of the developer of this invention.

Next, the fourth embodiment of the developer of this invention including the classifier is described referring to FIG. 45, which is the schematic block diagram of the developer of this embodiment. This developer is provided with a belt 153 stretched across rollers 151, 152 arranged above the transfer board 1. An opposite electrode 155 is arranged on the back of the part of the belt 153 opposite to the transfer board 1, where the opposite electrode 155 functions as the opposite member opposite to the transfer board 1. A bias voltage VB from the bias power source 4 is applied to the opposite electrode 155 to generate an electric field for transporting and attaching the grains of toner having required characteristics among the toner transferred and hopped on the transfer board 1. A bias power source 156 is provided between the opposite electrode 155 and the photosensitive drum 131, where the bias power source 156 applies the bias voltage VC higher than the bias voltage VB to the opposite electrode 155. In this developer, the opposite member for generating an electric field and the member to which the powder is transported and attached are separately provided.

The grains of toner having the required quantity of charge and mass among the toner transferred and hopped on the transfer board 1 are attracted to the electric field from the opposite electrode 155, and are transported and attached to the surface of the belt 153. The attached grains of toner are sent onto the side where the belt 153 faces the photosensitive drum 131 via the circulation of the belt 153, and are transported and attached to the latent image part on the photosensitive drum 131 by a bias field formed across the belt 153 and the photosensitive drum 131 and an electric field from an electrostatic latent image, thus the image is developed.

With the constitution described above, it is possible for the developer of this embodiment to classify charged grains of toner having a large q/m, and transport and attach them to the belt 153, then supply them to the developing part. As a result, the uniformity of the toner for development is enhanced, so that the quality of development is improved, thus the quality of images is improved. Besides, the grains of toner having small q/m are not captured or classified and are discharged from the transfer board 1, then sent back again to the charging brush 143 and the like through the recovery member 7 and are recharged. Thus, it is possible to make grains of toner having a large q/m captured and used for development in a stable manner.

Figure 46:
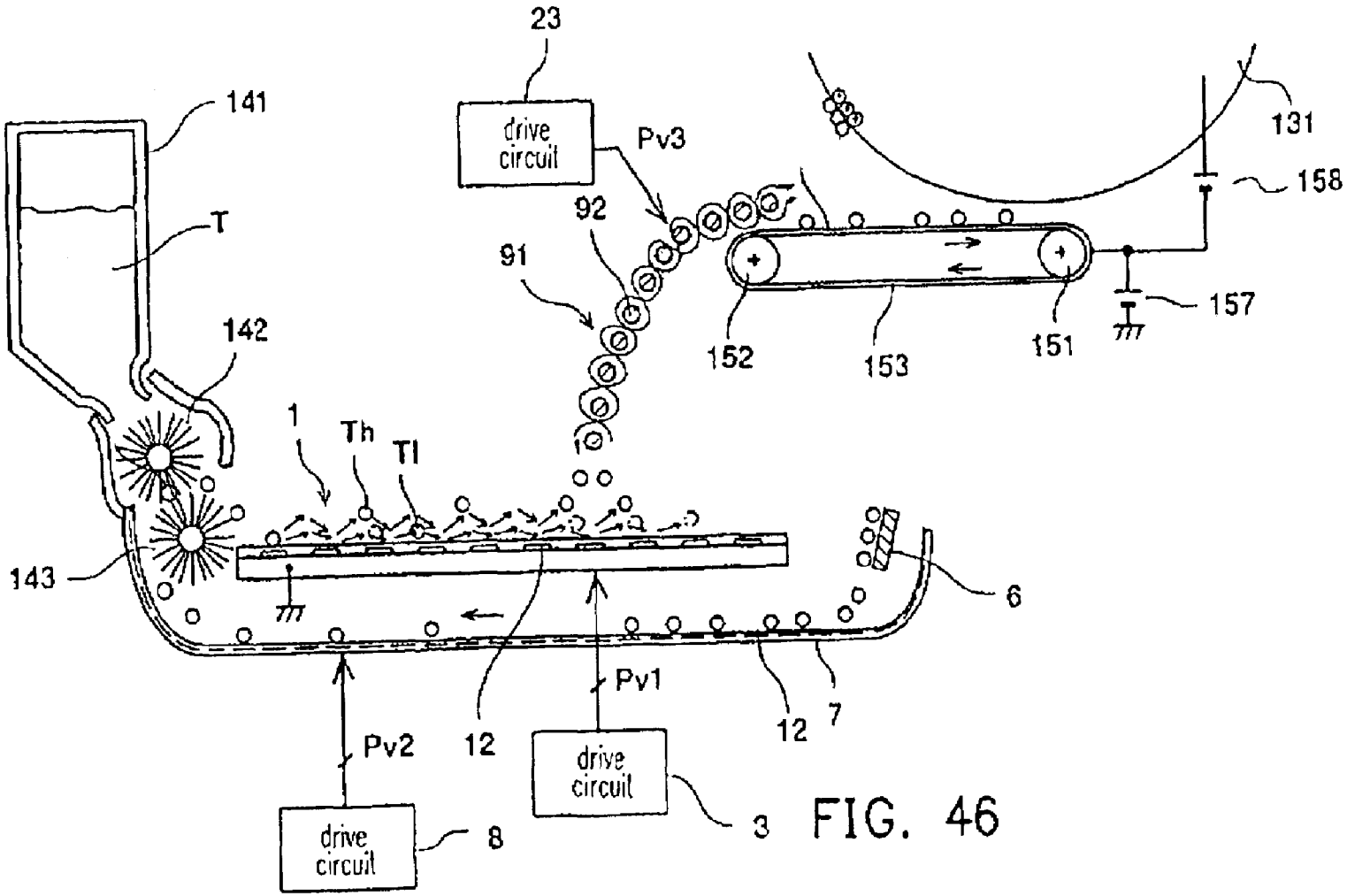
FIG. 46 is a schematic block diagram for explaining the fifth embodiment of the developer of this invention.

Next, the fourth embodiment of the developer of this invention including the classifier is described referring to FIG. 46, which is the schematic block diagram of the developer of this embodiment. In this developer, toner is classified into almost uniform grains of toner using a classifier almost the same one of the fifteenth embodiment. The classified toner is attached to an electrostatic latent image formed on the photosensitive drum 131, which is the latent image carrier, to develop the image.

The developer of this embodiment is provided with the belt 153 stretched across the rollers 151, 152, which is arranged in opposite to the photosensitive drum 131. The grains of toner having required characteristics are transported and attached to the electric wires 92 of the electric wire line member 91 opposite to the transfer board 1, then are transferred to the belt 153. A bias voltage VD from a bias power source 157 for retaining the transported toner is applied to the belt 153. A bias voltage VD from a bias power source 158, which is higher than the bias voltage VD for retaining the toner, is also applied across the photosensitive drum 131 and the belt 153.

The grains of toner having the required quantity of charge and mass among the toner transferred and hopped on the transfer board 1 are attracted to the electric field from the electrode wires 92 of the electric wire line member 91 opposite to the transfer board 1, and are transported and attached to the electric wire line member 91. The attached grains of toner are transported onto the belt 153 by the traveling wave fields from the electrode wires 92, then sent to the side where the belt 153 faces the photosensitive drum 131 via the circulation of the belt 153, and are transported and attached to the latent image part on the photosensitive drum 131 by a bias field formed across the belt 153 and the photosensitive drum 131 and an electric field from an electrostatic latent image, thus the image is developed.

With the constitution described above, it is possible for the developer of this embodiment to classify charged grains of toner having a large q/m, and transport and attach them to the belt 153, then supply them to the developing part. As a result, the uniformity of the toner for development is enhanced, so that the quality of development is improved, thus the quality of images is improved. Besides, the grains of toner having small q/m are not captured or classified and are discharged from the transfer board 1, then sent back again to the charging brush 143 and the like through the recovery member 7 and are recharged. Thus, it is possible to make grains of toner having a large q/m captured and used for development in a stable manner.

Figure 47:
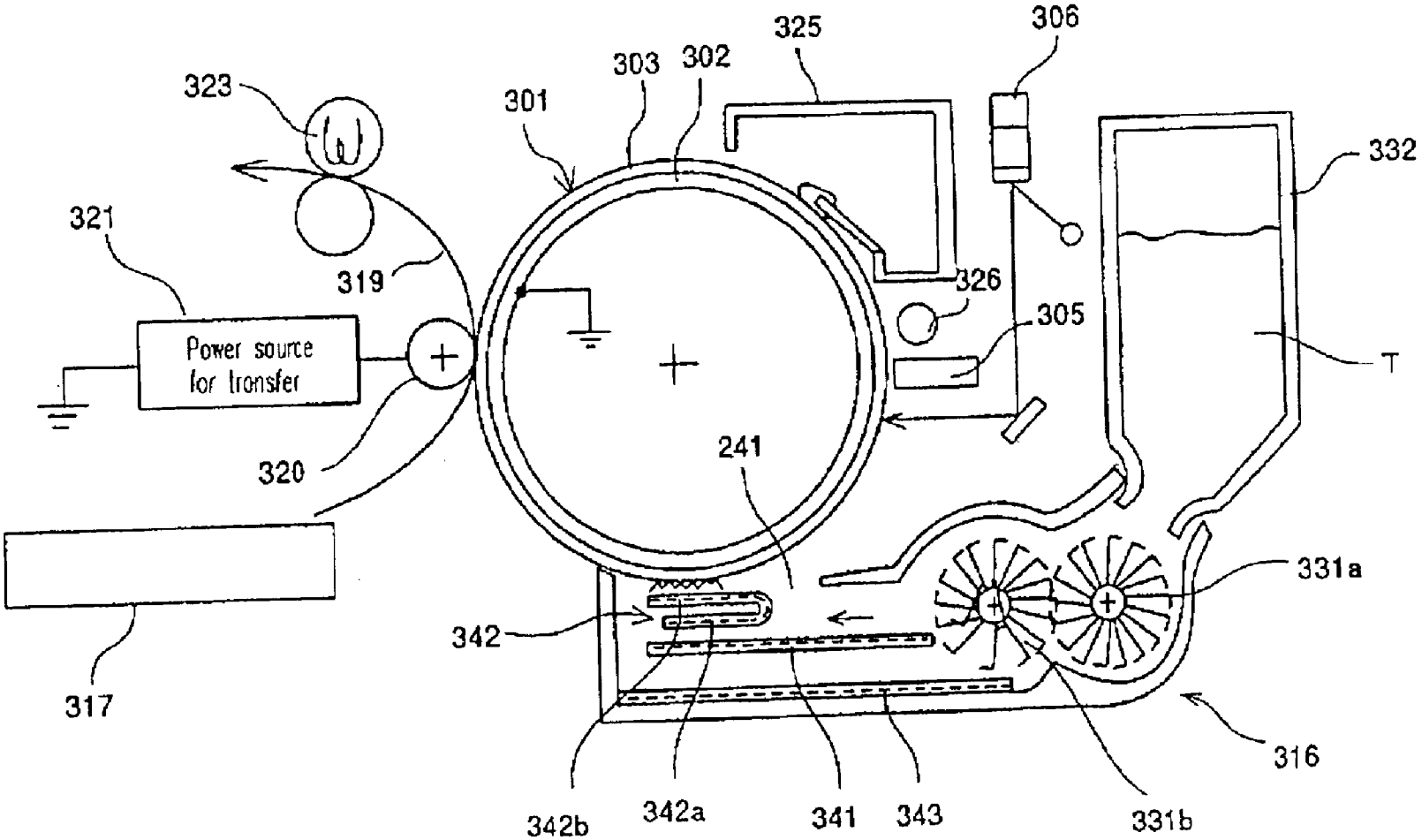
FIG. 47 is a schematic block diagram for explaining the first embodiment of the image forming apparatus of this invention.

Next, the first embodiment of the image forming apparatus of this invention comprising the developer of this invention including the classifier of this invention is described referring to FIG. 47. In this image forming apparatus, the photosensitive drum 301, i.e., latent image carrier, comprises a basic substance 302 on which a photosensitive layer 303 formed, and is rotated in the arrow direction shown in FIG. 47. The photosensitive drum 301 is charged uniformly with a charging apparatus 305, and an electrostatic latent image is formed on the photosensitive drum 301 when a laser beam writes in an image read from an exposure part 306 on the surface of the photosensitive drum 301.

Then, toner is attached to the electrostatic latent image on the photosensitive drum 301 by the developer 316 of this invention, so that the electrostatic latent image is visualized. The visualized latent image is transferred to a transfer paper (recording medium) 319 fed from a paper feed cassette 317 by a transfer roller 302, to which the voltage from a transfer power source 321 is applied. The transfer paper 319 with the transferred visualized image is removed from the surface of the photosensitive drum 301, and is made to pass through rollers constituting a fixing unit, where the visualized image is fixed, then is ejected to a ejected paper try provided on the outside of the image forming apparatus.

Meanwhile, part of the toner remaining on the surface of the photosensitive drum 301 after the image transfer has been completed is removed by a cleaning apparatus 326, and residual charge on the surface of the photosensitive drum 301 is neutralized by a charge neutralizing lump 326.

The developer 316 houses a pair of charging brushes 331*a*, 331*b* arranged in contact with each other and made to rotate, which is one example of members for charging toner. The toner T fed from a toner tank 332 to the charging brushes 331*a*, 331*b* is electrified with friction charge caused by the charging brushes.

The electrified toner is sent to a transfer board 341 constituting the developer 316, where the transfer board 341 also functions as part of classifier by transferring the toner for classification. The developer 316 also comprises an opposite transfer board 342 having an opposite part 342*a*, which is an opposite member opposed to transfer board 341 and to which grains of toner having a required large q/m separated from the toner transferred and hopped on the transfer board 341 is transported and attached, and a developing part 342*b* for transferring the grains of toner attached to the opposite part 342*a* and further hopping and transporting them near the latent image carrier 301, wherein the opposite part 342*a* and the developing part 342*b* are integrally formed. The classifier further includes a recovery transfer board 343 for transferring unused grains of toner falling from the end of the transfer board 341 and the opposite transfer board 342 toward a recharging member (charging brush 331*b*).

The constitution of the transfer board 341 is the same as that of the transfer board 1 described before in the embodiments of the classifiers. Respective constitutions of transfer board 342 and the recovery transfer board 343 are virtually the same as that of the transfer board 341, (except that transfer board 342 consists of a flexible board and is shaped into a reversed transfer course). Though the drawings of a bias power source and a drive circuit supplying drive waveforms for the transfer and hopping of toner are omitted here, they are the same one used in the classifier and developers described before.

With the constitution described above, it is possible to classify charged grains of toner having a large q/m, and transport and hop near the photosensitive drum 301. As a result, the uniformity of the toner for development is enhanced, so that the quality of development is improved, thus the quality of images is improved. It will be appreciated that the classifier and the developer shown in FIG. 47 do not limit the scope of this embodiment. The classifiers and the developers described before in respective embodiments are also applicable to this embodiment.

Figure 48:
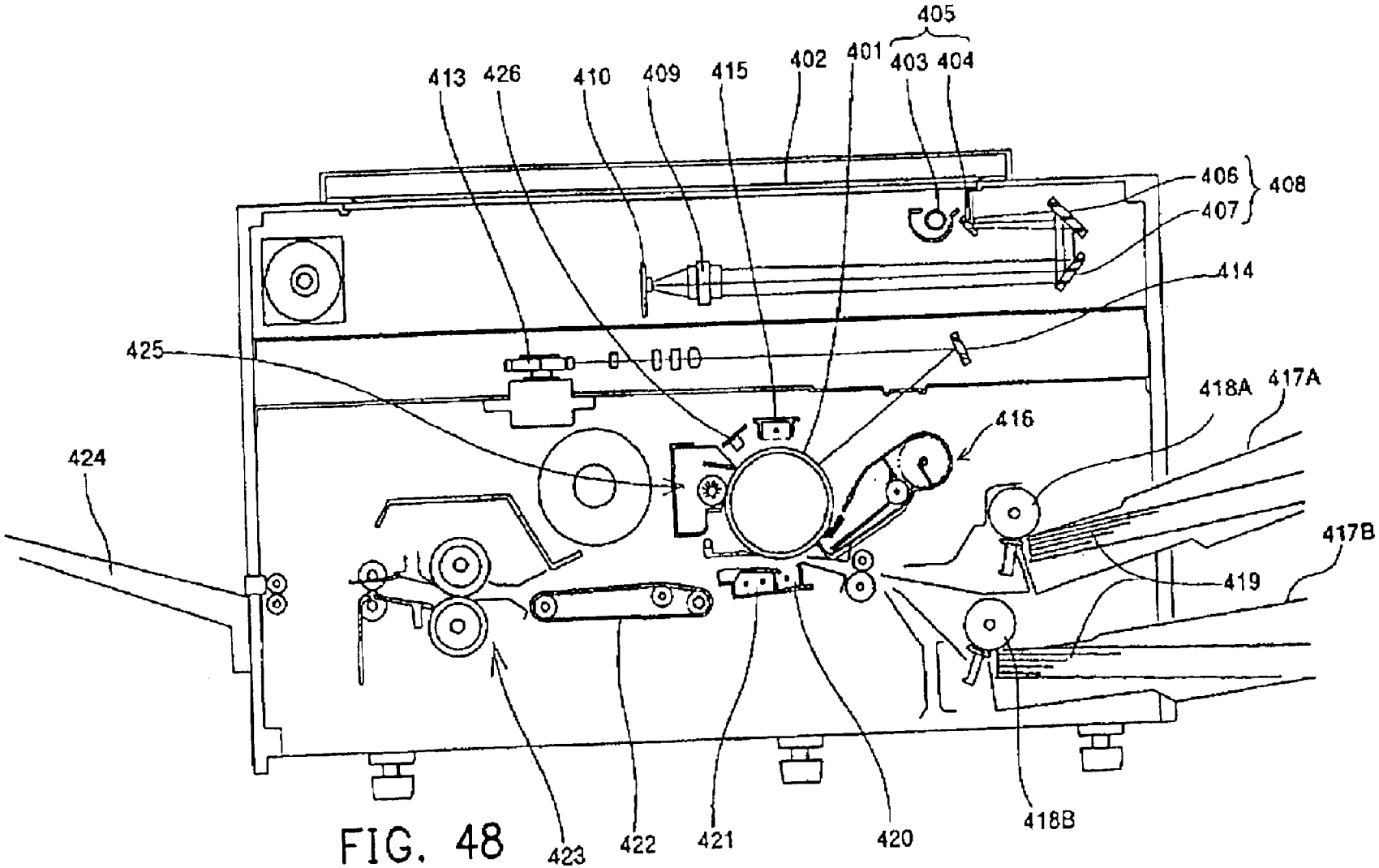
FIG. 48 is a schematic block diagram for explaining the second embodiment of the image forming apparatus of this invention.

Next, the second embodiment of the image forming apparatus of this invention is described referring to FIG. 48, which is the schematic block diagram of the developer of this embodiment. In this image forming apparatus, a photosensitive drum 401 (for example, organic photosensitive body: OPC (Organic Photosensitive Column)) is rotated clockwise as shown in FIG. 48. When an image manuscript is placed on a contact glass 402 and a print start switch (not shown in the figure) is pressed, a scanning optical system 405, comprising a manuscript lighting source 403 and a mirror 404, and a scanning optical system 408, comprising a mirrors 406, 407, are actuated to read the image manuscript.

The scanned image manuscript is read in by a image reading element 410 arranged on the rear of a lens 409 as an image signal, which is digitized in an image process. The processed signal actuates a laser diode (LD), which emits a laser beam in response to the processed signal. The beam is then reflected at a polygon mirror 413 and further reflected at mirror 414 to reach the photosensitive drum 401, which is charged uniformly with a charging apparatus 415. The laser beam writes in an electrostatic image on the surface of the photosensitive drum 401.

Then, toner is attached to the electrostatic image on the surface of the photosensitive drum 401 by the developer 416 of this invention, where the image is visualized. The visualized image (toner image) is transferred to a transfer paper (recording medium) 419 fed from paper feed 417A or 417B via paper feed roller 418A or 418B, as a transfer charger 420 discharges corona currents. The transfer paper 419 having the transferred image thereon is removed from the surface of the photosensitive drum 401 and is transferred on a transfer belt 422 to a fixing roller pair 423. When the transfer paper 419 passes through the pressure contact part of the fixing roller pair 423, the visualized image is fixed on the transfer paper 419, which is further transferred to be ejected to an ejected paper try 424 provided on the outside of the image forming apparatus.

Meanwhile, part of the toner remaining on the surface of the photosensitive drum 401 after the image transfer has been completed is removed by a cleaning apparatus 425, and residual charge on the surface of the photosensitive drum 401 is neutralized by a charge neutralizing lump 426.

Figure 49:
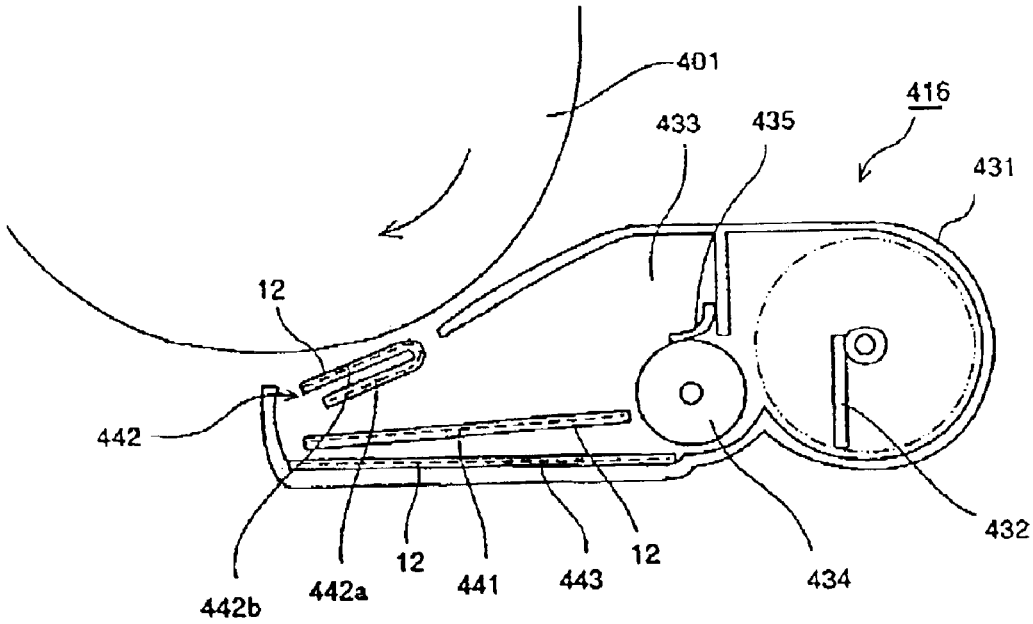
FIG. 49 is a magnified view showing the developer of the above image forming apparatus.
Figure 50:
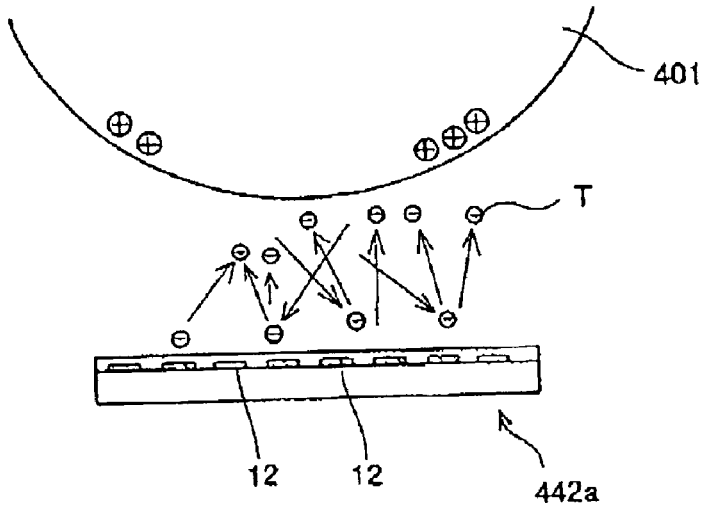
FIG. 50 is an explanatory drawing for describing the developing operation of the above developer.

As shown in FIG. 49, the developer 416 comprises a toner hopper 431 for storing the toner, an agitator 432 for agitating the toner in the toner hopper 431, a charging roller 434 for charging the toner in the toner hopper 431 and supplying the toner to a toner box 433, and a doctor blade 435 arranged in contact with the periphery of the charging roller 434.

The toner supplied to the toner box 433 is sent to a transfer board 441 for transferring the toner for classification, which is also included in the developer 416. The developer 416 further comprises an opposite transfer board 442 having an opposite part 442*a*, which is an opposite member opposed to transfer board 441 and to which grains of toner having a required large q/m separated from the toner transferred and hopped on the transfer board 441 is transported and attached, and a developing part 442*b* for transferring the grains of toner attached to the opposite part 442*a* and further transporting and hopping them near the photosensitive drum 401, wherein the opposite part 442*a* and the developing part 442*b* are integrally formed. The developer 416 further includes a recovery transfer board 443 for transferring unused grains of toner falling from the end of the transfer board 441 and the opposite transfer board 442 toward a recharging member (charging roller 434).

As described in the first embodiment of the image forming apparatus, the constitution of transfer board 441 is the same as that of the transfer board 1 described before in the embodiments of the classifiers. Respective constitutions of transfer board 442 and the recovery transfer board 443 are virtually the same as that of the transfer board 441, (except that transfer board 442 consists of a flexible board and is shaped into a reversed transfer course). Though the drawings of a bias power source and a drive circuit supplying drive waveforms for the transfer and hopping of toner are omitted here, they are the same one used in the classifier and developers described before.

With this arrangement, the grains of toner having a large q/m are classified out of supplied charged toner, and are transported and attached to the opposite transfer board 442, then further transferred to the vicinity of the photosensitive drum 401, where the classified toner T hop. To attach the toner hopping near the photosensitive drum 401 to the latent image on the photosensitive drum 401, preset electric fields are required to be generated. It is required to set in such a way that the combined electric field between electric fields generated by the average of the pulse drive voltage applied to the electrodes of the opposite transfer board 442 and that generated by the voltage of latent image formed on the photosensitive drum 401 attracts the toner to the photosensitive drum 401. It is also required to set in such a way that the combined electric field between the electric fields generated by the average of the pulse drive voltage applied to the electrodes of the opposite transfer board 442 and that generated by the voltage of the part of the photosensitive drum 401 where latent image is not formed repels the toner against the photosensitive drum 401. It is also desirable that drive waveforms for transferring classified toner and that for transferring and hopping the toner near the latent image carrier be different.

Hopping grains of toner are already free from an absorption force capturing them on the opposite transfer board 442, and can be easily transported to the latent image carrier (photosensitive drum 401), so that a development providing a high quality image can be carried out at a relatively low voltage.

In a conventional jumping development method, an applying voltage generating electric field stronger enough to overcome an adhesive force of toner to a developing roller must be provided for removing charged toner from the developing roller to transport to a photosensitive body, which means that a bias DC voltage of more than 600 to 900 V is required. On the other hand, according to the ETH phenomenon method, while the adhesive force of a grain of toner is usually 50 to 200 nN, the adhesive force becomes almost zero because the grains of toner are hopping on the opposite transfer board 442. Therefore, the force required to removing the toner from the opposite transfer board 442 is not required, so that the toner can be transported sufficiently to the photosensitive body at a low voltage.

The width L of electrodes and the space R between electrodes of the opposite transfer board 442 are set within the range conforming to that of the transfer board 1 of the classifier described before. This electrode arrangement allows the electrodes to generate electric line of force as a vertical component, which makes grains of toner hop on the electrodes 12. Therefore, it becomes possible to hop the toner more effectively, thus improving a developing efficiency.

The thickness of the surface protective layer 13 of the opposite transfer board 442, at least that of the part near the latent image carrier where the hopping occurs, is also set within the range conforming to that of the transfer board 1 of the classifier described before. At the height equal to the diameter of a grain of toner from the center surface of electrode 12, the vertical strength of electric field capable of giving a force to hop the toner is more than (5E+5) V/m. As the strength eliminating a problem of absorption, more than (1 E+6) V/m is desirable. Further, as a more desirable strength to give an enough force, more than (2E+6) V/m is desirable.

The thickness of the surface protective layer affects the strength of electric field acting on the grains of toner hopping near the center surface of the electrode. Making the surface protective layer thicker increases electric fields heading for the adjacent electrode through the protective layer having a dielectric constant higher than that of air. As a result, the vertical component of the field is reduced. Therefore, an allowable range of the thickness of the surface protective layer to the hopping efficiency decrease is 10 $\mu$m or less, and a range for eliminating a concern of electric field attenuation in the vertical direction is 5 $\mu$m or less. With a surface protective layer of that range, it is possible to obtain a desirable electric field of more than (1 E+6) V/m, which gives an enough force to hop the toner free from the problem of absorption.

As for the charge potential of the surface of photosensitive drum 401, i.e., the latent image carrier, if toner is negatively charged, it is set to −300 V or less, and if positively charged, it is set to +300 V or less. Therefore, the charge potential of the surface of the latent image carrier should be 300V or less.

With the above setting, when fine-pitched electrodes are formed, a quite a large electric fields are generated even if a voltage applied between the electrodes 12 is a low voltage of 100 to 150 V or less, thus toner sticking to the surface of electrodes 12 is easily removed and hopped. Besides, the above arrangement reduces or eliminates ozone or NOx produced upon electrifying the photosensitive body, such as OPC, making the image forming apparatus advantageous for an environment problem and the photosensitive body more durable.

Therefore, in this embodiment, it is not necessary to apply a high bias voltage of 500 V to several KV across the developing roller and the photosensitive body, as in the case of conventional method, to remove the toner sticking to the developing roller surface or carrier surface. Thus it is possible to form a latent image and develop it while setting the charge potential of photosensitive body to a very low value.

For example, when an OPC photosensitive body with a surface CTL (Charge Transport Layer) of 15 $\mu$m thick and a dielectric constant $\epsilon$ of 3 is used for charged toner having charge density of −3 E-4 C/m$^2$, the surface potential of the photosensitive body is −170 V. In this case, the surface potential becomes −50 V in average when a pulse drive voltage of 0 to −100 V with a duty of 50% is applied as an applied voltage for the electrodes of the transfer board. When toner is negatively charged and the above setting and result is obtained, the electric fields formed between the electrodes of transfer board and the OPC photosensitive body comes to such a state described before that respective fields for attracting or repulsing the toner are set to a prescribed strength.

When the above state of electric fields is achieved, development becomes possible with a given gap between the transfer board and the OPC photosensitive body of 0.2 to 0.3 $\mu$m. While this requirement varies according to Q/M of toner, an applied voltage for the electrodes of the transfer boards, and a print speed, i.e., the rotating speed of the photosensitive body, development can be carried out in a sufficient manner with a charging potential for the photosensitive body of −300 V or less when the toner is negatively charged. If development efficiency is prioritized, charging potential of −100 V or less is also allowable. If the toner is positively charged, the charging potential is positive potential.

The gap between the photosensitive drum 401, i.e., latent image carrier, and the opposite transfer board 442 is further described. When the gap between the toner transfer surface and the latent image carrier is set within a range of 2 to 100 times the height of the hopping of toner, the grains of toner hopping high further fly up to the latent image carrier and contribute to a development process. Contrary to that, the grains of toner hopping low cannot reach the latent image carrier, thus do not contribute to the development process.

FIG. 15 shows an example of the relation between an applied voltage and the height of hopping of the grains of toner. For example, when the applied voltage is set to 100 V and Q/M of the grains of toner is changed to −10 $\mu$C/g, −20 $\mu$C/g, and −30 $\mu$C/g, the speed of the grains of toner in the vertical direction changes to gain the maximum speed of 0.65 m/sec to 1.25 m/sec. The height of the hopping increases from 100, to 125 to 150 $\mu$m as Q/M of the toner is increased.

Therefore, when toner having a certain Q/M distribution is transferred to the area for hopping to the latent image carrier, the grains of toner having a small Q/M, for example, of smaller than 10 to 5 $\mu$C/g, cannot contribute to development process, because their jump height is not enough. As a result, only the grains of toner having a Q/M more than a prescribed value are used for development.

Using the toner having a Q/M more than a prescribed value makes possible to attach the toner surely to a latent image, and eliminates a splatter or move of attached toner, thus enables a development producing high quality images. Further, it also becomes possible to prevent a foul printing caused by weakly charge toner or a group of grains of reversely charged toner. Therefore, the developer of this invention, in which toner is hopped, makes possible to select the grains of toner having an Q/M effective for contributing to the development process, thus to obtain an image forming apparatus having a developing unit (developer) capable of performing a high quality development at a low voltage.

The gap between the toner transfer surface and the latent image carrier may be set within a range of ½ to 2 times the height of the hopping of toner.

In this case, most part of hopping grains of toner collide against the surface of the latent image carrier with a prescribed speed, irrespective of the electric field from a latent image on the latent image carrier. As a result, unnecessary grains of toner attached to the area other than the latent image have a weak absorption force, and the grains of toner forming the surface of layer-shaped grains of toner attached to the latent image are also have weak absorption force. Both grains of toner are eventually removed as following grains of toner collide against the latent image carrier, which produces a more great scavenger effect, making possible to obtain more sharp images. Besides, in this case, more large volume of toner can be transported to the surface of photosensitive body, so that more strong images can be developed at a high speed.

Figure 51:
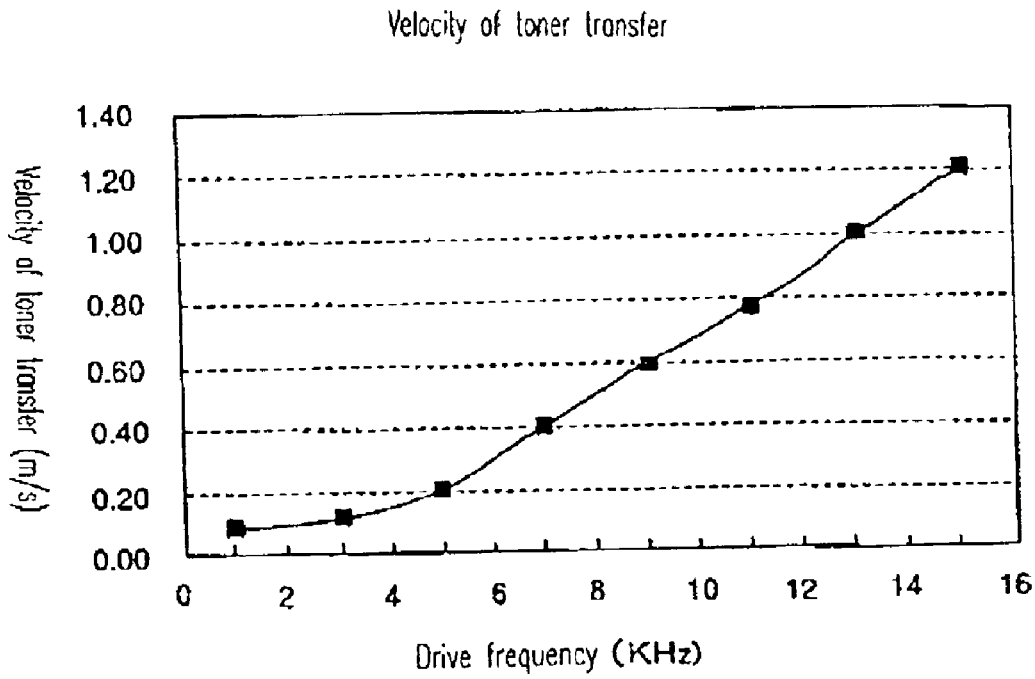
FIG. 51 is an explanatory drawing for describing one example of the relation between the drive frequency of drive waveform and a toner transfer velocity.

Next, the transfer board, the opposite transfer board, and the drive frequency of drive waveforms applied to the electrodes 12 of the recovery transfer board are described referring to FIG. 51, which shows a result of a measurement of the relation between a drive frequency and a transfer speed. In the figure, the axis of ordinate represents transfer speed, but also indicates the hopping of grains of toner in the vertical direction.

As shown in FIG. 51, the transfer speed goes up as the drive frequency increases. This is because the number of hopping of the grains of toner near the electrodes increase as the direction of electric fields is changed more frequently.

The result indicates that the hopping and transfer of toner are correctly performed when the drive frequency of drive waveforms is set within a range of 1 to 15 KH. Therefore, high quality images can be formed by setting a proper drive frequency of drive waveforms, according to a print speed or the strength of images.

When the strength of images is constant, the higher a print speed is, the more the amount of toner consumed for development is. When a print speed is constant, the high the strength of images is, the more the amount of toner consumed for development is. When a consumed amount of toner increases, more toner needs to be supplied to the toner hopping part (developing part). By setting a proper drive frequency of drive waveforms, according to a print speed or the strength of images, a shortage of toner supply can be prevented and high quality images can be created.

Figure 52:
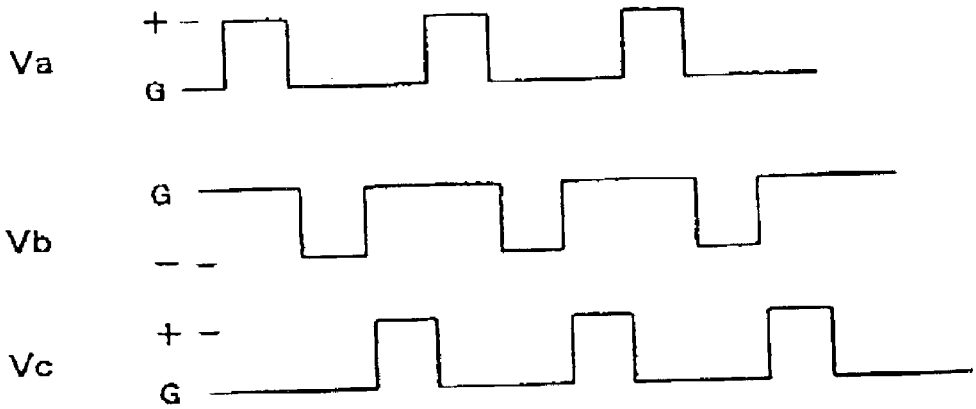
FIG. 52 is an explanatory drawing for describing other examples of the drive waveforms.

Next, another example of the transfer board, the opposite transfer board, and the drive frequency of drive waveforms applied to the electrodes 12 of the recovery transfer board are described referring to FIG. 52. The figure shows an example that drive waveforms of n phases (three phases in the figure) are applied in such a way that the polarity of one phase is different from that of other two phases. When the polarities of three phases are different to each other, (positive to negative to zero potential), the potential difference between adjacent electrodes becomes high, so that the hopping can be carried out without fail.

Figure 53:
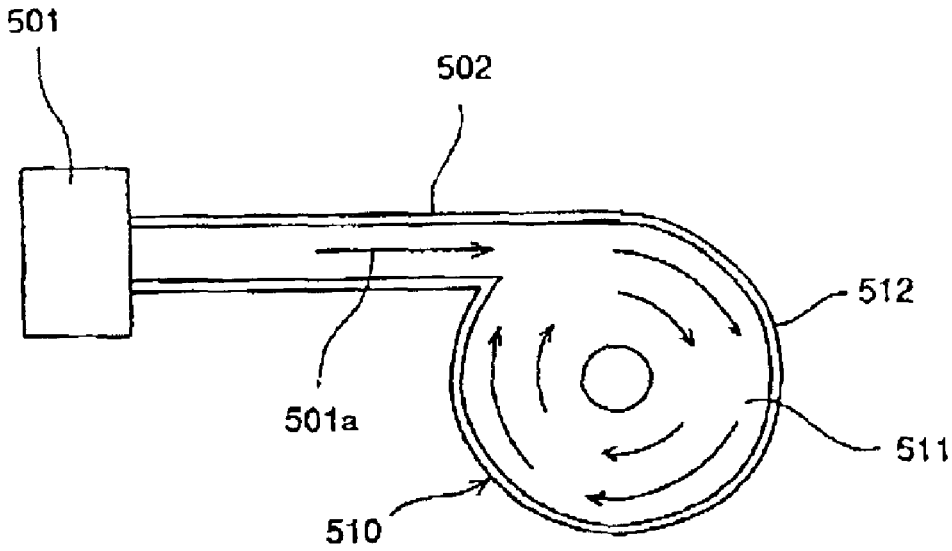
FIG. 53 is a flat view showing a powder charging and selecting apparatus constituted according to the classifier of this invention.
Figure 54:
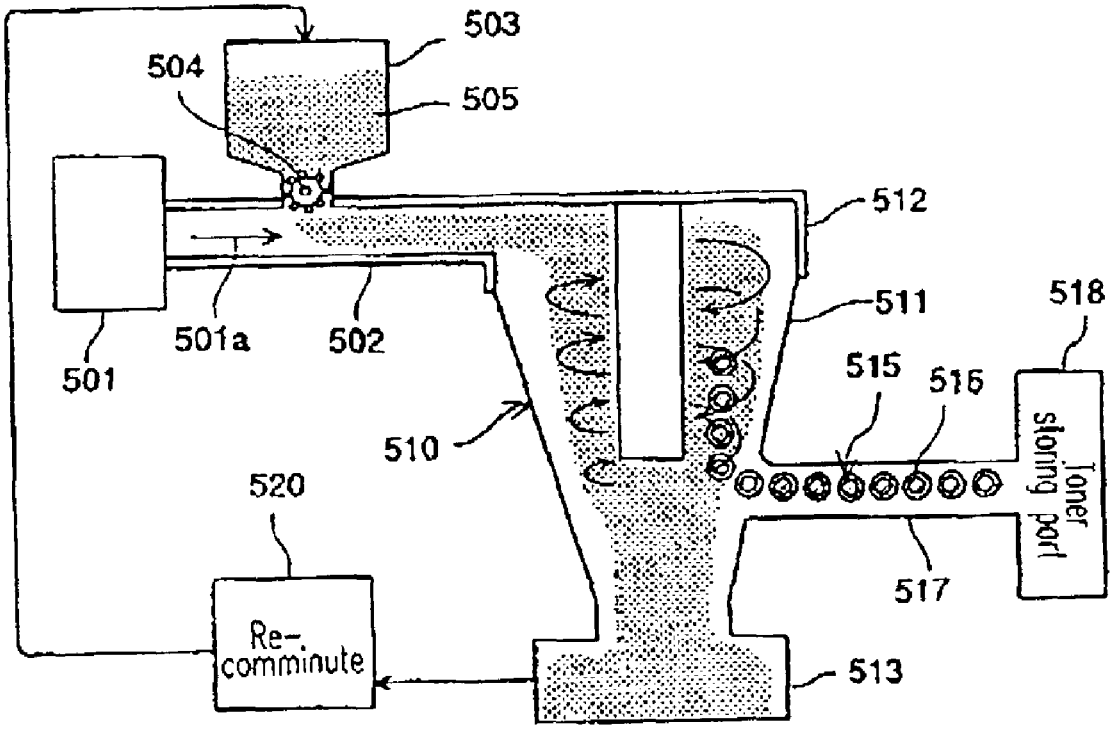
FIG. 54 is another flat view showing the powder charging and selecting apparatus constituted according to the classifier of this invention.

Next, the powder charging and selecting apparatus is described as another application of the classifier of this invention, referring to FIGS. 53 and 54. FIG. 53 is the flat view showing a powder charging and selecting apparatus, and FIG. 54 is the modeled sectional view of the powder charging and selecting apparatus.

An airflow generating apparatus 501 generates a jet airflow 501*a*, of which the relative humidity is lowered to keep the atmosphere of jet airflow lower than 70% by a nozzle jet method using an air pump, a jet method utilizing high-pressure adiabatic expansion, a turbofan method and the like. A powder supply 503 is arranged on the side of a transfer passage 502 through which a jet airflow 501*a* flows. The powder supply 503 supplies powder 505 by means of a supply roller 504 to the transfer passage 502, then the powder 505 is transfer through the transfer passage 502 by the jet airflow 501*a* to a cyclone apparatus 510. The powder 505 transferred by a gas-phase transfer is charged by the friction with a charging mechanism provided on the pipe wall 502*a* of the transfer passage 502, and is further charged by the friction with the charging mechanism on the lid inner wall on the upper part of the cyclone apparatus 510.

More specifically, the pipe wall 502*a* of the transfer passage 502 and the lid inner wall on the upper part of the cyclone apparatus 510 are made of a charging function material, and the powder carried by the airflow made to come in contact with the charging function material to come to have a friction charge.

The charging function material comes to have a charge polarity reverse to that of the powder upon contacting the powder, such as toner, facilitating a proper friction charge of the powder. The strength of charge can be adjusted by selecting a proper material. More specifically, the charging function material can be selected from a substance of acrylic series, silicon series, fluorine resin series, urea resin series, polyester series, polyimide series, polyamide series, polyformamide series, poly vinyl chloride series, olefin series, anine series, polyurethane series, and ethyl cellulose series, or a mixture of these substance. The charging function material can also selected among metal oxide conductors, compound semiconductors, or mixtures consisting of these conductors or semiconductors and the above resin series substances.

The cyclone apparatus 510 classifies or selects the charge powder by double-clone or multi-clone method, and comprises a reversed-cone-shape cylindrical body 511, an upper lid 512, and a powder recovery part 513 arranged below the cylindrical body 511, where one end of a electric wire line member 515 constituted as described before faces the inside of the cylindrical body 511. Each electric wire 516 of the electric wire line member 515 is sheathed with an insulating protective film and the electric wire line member 515 penetrates through a duct 517 to face the other end of it in a toner storing part 518. A drive circuit, which is not shown in the figure, applies n-phase drive waveforms for generating electric fields for transferring the powder by an electric statistic force to each electric wire 516 of the electric wire line member 515.

The powder recovered at the powder recovery part 513 of the cyclone apparatus 510 is supplied again to the powder supply 503 via a re-comminuting part 520.

Among the powder moving through the cyclone apparatus 510 by being carried by the airflow, the grains of powder that are properly charged have a good dispersibility owing to a charge repulsion between each grain of powder and have a great flowability to avoid granulation. As a result, such grains of powder receives traveling wave fields generated by each electric wire 516 of the electric wire line member 515 and are sent along the electric wire line member 515, even in the vortex caused by the cyclone apparatus 510, to the toner storing part 518 and stored there.

Meanwhile, the grains of powder having a small charge and inferior dispersibility tend to granulate to form lumps or clusters and have a relatively large mass. As a result, such grains of powder are not retained by traveling wave fields generated by each electric wire 516 of the electric wire line member 515 and falls into the recovery part 513 arranged below.

As described above, the charging and selection of toner during a manufacturing process of toner is facilitated by using the powder charging and selecting apparatus.

According to the description made heretofore, the classifier of the present invention comprises the transfer member having a plurality of electrodes for generating electric fields for transporting powder while transferring and hopping the powder by an electrostatic force, and the opposite member to which the powder transferred by the transfer member is transported and attached, the opposite member being almost opposite to the transfer member. Therefore, the classifier of the present invention makes possible to classify the powder with a high accuracy and a simple constitution.

According to the classifier of the present invention, powder is transported while it is transferred and hopped on the transfer board by an electrostatic force, and the powder transferred and hopped is classified by transporting and attaching the powder to another member by an electric field. Therefore, the classifier of the present invention makes possible to classify the powder with a high accuracy and a simple constitution.

According to the developer of the present invention, the powder classified by the classifier of this invention is supplied to the developing means, so that the quality of development is improved.

According to the image forming apparatus of the present invention, the image forming apparatus is provided with the classifier of this invention or the developer of the present invention, so that images are formed using uniformed powder, thus the quality of development is improved.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said opposite member is an opposite transfer member which has a plurality of electrodes for generating electric fields and which is configured to for transfer said powder by an electrostatic force.

2. The classifier of claim 1, wherein part or the whole of said opposite transfer member is inclined position against said transfer member.

3. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said opposite member is a rotary roller member.

4. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said opposite member is a rotary pelt member.

5. The classifier of claim 4, wherein said belt member is inclined against said transfer member.

6. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said opposite member comprises electrode wires.

7. The classifier of claim 6, wherein said each of the electrode wires is covered with a protective layer.

8. The classifier of claim 6, further comprising a slit member having slit holes arranged between the electrode wires, which are arranged at a position substantially opposite to said transfer member, and the transfer member.

9. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said opposite member comprises an array of electrode wires.

10. The classifier of claim 9, wherein a voltage for generating electric fields is applied to each of the electrode wires.

11. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said opposite member comprises a slit member having slit holes; and electrodes formed on wall surfaces of the slit holes.

12. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein a width of each of said electrodes of said transfer member in a transporting direction of said powder is 1 to 20 times an average grain diameter of said powder, and each space between said electrodes in the transporting direction of said powder is 1 to 20 times the average grain diameter of said powder, wherein drive waveforms of n phases are applied to each of the plurality of electrodes, wherein a represents an integer not less than 3.

13. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein said transfer member has an inorganic or organic surface protective layer covering said plurality of electrodes, and wherein a thickness of the surface protective layer is not more than 10 $\mu$m.

14. A classifier for classifying a powder comprising:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member, wherein the classifier bas a plurality of said opposite members, and the plurality of said opposite members selectively catch the particles of said powder depending on a quantity of charge or a mass of the particles of said powder.

15. A developer, comprising:

a classifier configured to classify a powder; and a developing means for developing a latent image on a latent image carrier the classified powder to form a visual image on the latent image carrier, and wherein said classifier comprises:

a transfer member which has a plurality of electrodes for generating electric fields and which is configured to transport said powder while transferring and hopping said powder by an electrostatic force; and an opposite member configured to selectively catch particles of said powder transferred and hopped by the transfer member, the opposite member being arranged in a position substantially opposite to the transfer member.

16. The developer of claim 15, wherein said developing means comprises a developing roller facing to said latent image carrier.

17. The developer of claim 16, wherein said developing roller also functions as said opposite member.

18. The developer of claim 15, wherein said developing means is a member having a plurality of electrodes for generating electric fields for transferring and hopping the powder by an electrostatic force at a position near said latent image carrier.

19. The developer of claim 18, wherein said member having a plurality of electrodes also functions as said opposite member.

20. The developer of claim 15, wherein said developer means comprises a rotary belt facing to said latent image carrier.

21. The developer of claim 20, wherein said rotary belt member also functions as said opposite member.

22. An image forming apparatus, comprising:

a latent image carrier; and a developer configured to develop a latent image with a powder, wherein the developer is the developer of claim 15.

* * * * *